US008801492B2

(12) United States Patent
O'Connor et al.

(10) Patent No.: US 8,801,492 B2
(45) Date of Patent: Aug. 12, 2014

(54) TOY TRACK SET AND RELAY SEGMENTS

(75) Inventors: Stacy Lynn O'Connor, Long Beach, CA (US); Brendon Vetuskey, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 834 days.

(21) Appl. No.: 12/906,600

(22) Filed: Oct. 18, 2010

(65) Prior Publication Data

US 2011/0124265 A1 May 26, 2011

Related U.S. Application Data

(63) Continuation-in-part of application No. 12/111,168, filed on Apr. 28, 2008, now Pat. No. 7,857,679, which is a continuation-in-part of application No. 12/581,762, filed on Oct. 19, 2009, now Pat. No. 8,006,943, and a continuation-in-part of application No. 12/717,645, filed on Mar. 4, 2010, now Pat. No. 8,382,553, and a continuation-in-part of application No. 12/766,804, filed on Apr. 23, 2010, which is a continuation-in-part of application No. 12/766,808, filed on Apr. 23, 2010, now Pat. No. 8,690,632.

(60) Provisional application No. 61/252,596, filed on Oct. 16, 2009, provisional application No. 61/329,921, filed on Apr. 30, 2010, provisional application No. 60/966,029, filed on Aug. 24, 2007, provisional application No. 60/926,583, filed on Apr. 27, 2007, provisional application No. 61/106,553, filed on Oct. 17, 2008, provisional application No. 61/172,617, filed on Apr. 24, 2009, provisional application No. 61/252,596, filed on Oct. 16, 2009, provisional application No. 61/172,631, filed on Apr. 24, 2009, provisional application No. 61/172,575, filed on Apr. 24, 2009, provisional application No. 61/214,775, filed on Jun. 1, 2009, provisional application No. 61/214,774, filed on Jun. 1, 2009.

(51) Int. Cl.
*A63H 18/00* (2006.01)

(52) U.S. Cl.
USPC ..... 446/444; 446/168

(58) Field of Classification Search
USPC ..... 446/168–174, 444, 423; 104/53, 127, 104/128; 238/10 A; 273/118 R, 119 R, 121 R, 273/122 R, 123 R, 125 R
See application file for complete search history.

(56) References Cited

U.S. PATENT DOCUMENTS 283,661 A 8/1883 Reed
1,235,771 A 8/1917 Dettra (Continued)

FOREIGN PATENT DOCUMENTS

WO 9303808 A1 3/1993
WO 9949948 A1 10/1999

(Continued)

OTHER PUBLICATIONS

International Search Report dated Jan. 18, 2012 for International Application No. PCT/US2011/034788.

(Continued)

*Primary Examiner* — Gene Kim
*Assistant Examiner* — Urszula M Cegielnik
(74) *Attorney, Agent, or Firm* — Cantor Colburn LLP

(57) ABSTRACT

Disclosed herein is a relay for a toy track set, the relay having: a first actuator; a second actuator; an object movably secured to the relay for movement from a first elevated position to a second lower position; a first trigger moveably secured to the first actuator for movement between a first position and a second position wherein movement of the trigger from the first position towards the second position causes the actuator to release the object from the first elevated position such that the object travels towards the second lower position; and a second trigger coupled the second actuator wherein movement of the second trigger launches an object from the second actuator, wherein the second trigger is moved when the object is at the second lower position.

17 Claims, 35 Drawing Sheets

(56) References Cited

U.S. PATENT DOCUMENTS

| | | | | |
|---|---|---|---|---|
| 1,523,243 | A | 1/1925 | Bain | |
| 2,385,724 | A | 9/1945 | Olson | |
| 2,416,473 | A | 2/1947 | Fields | |
| 2,735,221 | A | 2/1956 | Fields | |
| 3,025,846 | A | 3/1962 | Crosman | |
| 3,031,797 | A | 5/1962 | Gelfand | |
| 3,145,991 | A | 8/1964 | Benditt | |
| 3,148,478 | A | 9/1964 | Miller | |
| 3,398,956 | A | 8/1968 | Lukes | |
| 3,402,503 | A | 9/1968 | Glass et al. | |
| 3,599,365 | A | 8/1971 | Carver et al. | |
| 3,601,402 | A * | 8/1971 | Kohner et al. | 273/399 |
| 3,603,024 | A | 9/1971 | Davis et al. | |
| 3,633,308 | A | 1/1972 | Yang | |
| 3,734,500 | A | 5/1973 | Cooper | |
| 3,751,847 | A | 8/1973 | Neuhierl | |
| 3,777,391 | A | 12/1973 | Barcus et al. | |
| 3,789,538 | A * | 2/1974 | Spengler et al. | 446/423 |
| 3,858,875 | A | 1/1975 | Nemeth et al. | |
| 3,896,735 | A | 7/1975 | Fischer | |
| 3,928,934 | A | 12/1975 | Lewis et al. | |
| 3,998,460 | A | 12/1976 | Dyer | |
| 4,094,089 | A | 6/1978 | Sano | |
| 4,112,610 | A * | 9/1978 | Sano | 446/423 |
| 4,128,964 | A | 12/1978 | Ogasawara | |
| 4,140,276 | A | 2/1979 | Halford | |
| 4,145,049 | A | 3/1979 | Papazian, Sr. | |
| 4,185,409 | A | 1/1980 | Cheng | |
| 4,219,198 | A * | 8/1980 | Meyer et al. | 446/166 |
| 4,221,170 | A | 9/1980 | Koudelka | |
| 4,249,733 | A | 2/1981 | Eddins et al. | |
| 4,267,661 | A | 5/1981 | Hanson | |
| 4,290,605 | A * | 9/1981 | Matsumoto | 273/120 R |
| 4,355,807 | A | 10/1982 | Prehodka | |
| 4,357,778 | A | 11/1982 | Matsumoto et al. | |
| 4,383,688 | A | 5/1983 | Prehodka | |
| 4,401,050 | A | 8/1983 | Britt et al. | |
| 4,423,871 | A | 1/1984 | Mucaro | |
| 4,475,303 | A | 10/1984 | Ribas et al. | |
| 4,479,650 | A | 10/1984 | Neuhierl | |
| 4,504,242 | A | 3/1985 | Crain et al. | |
| 4,509,760 | A | 4/1985 | Goldfarb et al. | |
| 4,513,966 | A | 4/1985 | Mucaro et al. | |
| 4,520,732 | A | 6/1985 | Schwarzkopf | |
| 4,564,197 | A | 1/1986 | Lambert et al. | |
| 4,605,230 | A | 8/1986 | Halford et al. | |
| 4,639,236 | A | 1/1987 | McKay et al. | |
| 4,644,869 | A | 2/1987 | Rhodes | |
| 4,661,080 | A | 4/1987 | Goldstein et al. | |
| 4,715,843 | A | 12/1987 | Ostendorff et al. | |
| D305,676 | S | 1/1990 | Ngai | |
| 4,897,065 | A | 1/1990 | Fertig et al. | |
| 4,932,917 | A | 6/1990 | Klitsner | |
| 5,011,138 | A | 4/1991 | Rankin | |
| 5,038,685 | A | 8/1991 | Yoneda et al. | |
| 5,154,615 | A | 10/1992 | Joubert | |
| 5,174,569 | A | 12/1992 | Ngai | |
| 5,234,216 | A | 8/1993 | Ostendorff | |
| 5,254,030 | A | 10/1993 | Ostendorff et al. | |
| 5,299,809 | A | 4/1994 | Evangelista et al. | |
| 5,299,969 | A | 4/1994 | Zaruba | |
| 5,370,571 | A | 12/1994 | Bosch | |
| 5,435,553 | A | 7/1995 | Arima et al. | |
| 5,499,940 | A | 3/1996 | Johnson et al. | |
| 5,542,668 | A | 8/1996 | Casale et al. | |
| 5,586,923 | A | 12/1996 | Hippely et al. | |
| 5,701,878 | A | 12/1997 | Moore et al. | |
| 5,775,016 | A | 7/1998 | Chien | |
| 5,788,553 | A | 8/1998 | Shivers et al. | |
| 5,816,887 | A | 10/1998 | Rudell et al. | |
| 5,819,717 | A | 10/1998 | Johnson et al. | |
| 5,871,385 | A | 2/1999 | Hippely et al. | |
| 5,899,789 | A | 5/1999 | Rehkemper et al. | |
| 6,007,402 | A | 12/1999 | Nelson, II | |
| 6,022,263 | A | 2/2000 | Liu et al. | |
| 6,099,380 | A | 8/2000 | Rasmussen | |
| 6,170,754 | B1 | 1/2001 | Halford | |
| 6,241,573 | B1 | 6/2001 | Ostendorff et al. | |
| 6,358,112 | B1 | 3/2002 | Lambert et al. | |
| 6,435,929 | B1 | 8/2002 | Halford | |
| 6,445,960 | B1 | 9/2002 | Borta | |
| 6,478,654 | B1 | 11/2002 | Rehkemper et al. | |
| 6,676,480 | B2 | 1/2004 | Sheltman | |
| 6,783,419 | B1 | 8/2004 | Paukert et al. | |
| 6,808,458 | B1 | 10/2004 | Jung | |
| 6,871,596 | B2 | 3/2005 | De-Gol | |
| 6,913,508 | B2 | 7/2005 | Hornsby et al. | |
| 6,951,497 | B1 | 10/2005 | Ngan | |
| 7,036,307 | B2 | 5/2006 | Rehkemper et al. | |
| 7,104,543 | B2 | 9/2006 | Wilk et al. | |
| 7,225,492 | B2 | 6/2007 | Pratt | |
| 7,614,931 | B2 * | 11/2009 | Nuttall | 446/444 |
| 7,618,301 | B2 | 11/2009 | Knight et al. | |
| 7,628,674 | B2 | 12/2009 | Nuttall et al. | |
| 7,766,720 | B2 | 8/2010 | Ostendorff | |
| 7,794,301 | B2 | 9/2010 | Ostendorff et al. | |
| 7,819,720 | B2 | 10/2010 | Nuttall et al. | |
| 7,892,068 | B2 | 2/2011 | Nuttall et al. | |
| 7,901,266 | B2 | 3/2011 | Ostendorff | |
| 7,967,688 | B2 | 6/2011 | Lai et al. | |
| 8,011,994 | B2 * | 9/2011 | Fink et al. | 446/168 |
| 2005/0191938 | A1 | 9/2005 | Sheltman et al. | |
| 2005/0287915 | A1 | 12/2005 | Sheltman et al. | |
| 2005/0287918 | A1 | 12/2005 | Sheltman et al. | |
| 2005/0287919 | A1 | 12/2005 | Sheltman et al. | |
| 2006/0286896 | A1 | 12/2006 | Bedford et al. | |
| 2006/0286897 | A1 | 12/2006 | Bedford et al. | |
| 2007/0049160 | A1 | 3/2007 | Matthes et al. | |
| 2008/0268743 | A1 | 10/2008 | O'Connor et al. | |
| 2009/0071137 | A1 | 3/2009 | Harris | |
| 2010/0096509 | A1 | 4/2010 | O'Connor | |
| 2010/0273394 | A1 | 10/2010 | O'Connor et al. | |
| 2011/0021111 | A1 | 1/2011 | Nuttall et al. | |

FOREIGN PATENT DOCUMENTS

| | | | |
|---|---|---|---|
| WO | 2007025353 | A1 | 3/2007 |
| WO | 2008134663 | A1 | 11/2008 |
| WO | 2009036298 | A2 | 3/2009 |

OTHER PUBLICATIONS

Written Opinion dated Jan. 18, 2012 for International Application No. PCT/US2011/034788.

International Search Report for PCT/US2008/061820 dated Oct. 17, 2008.

International Search Report for PCT/US2009/061192 dated May 10, 2010.

Written Opinion of the International Searching Authority for PCT/US2008/061820 dated Oct. 17, 2008.

Written Opinion of the International Searching Authority for PCT/US2009/061192 dated May 10, 2010.

* cited by examiner

TOY TRACK SET AND RELAY SEGMENTS

CROSS-REFERENCE TO RELATED APPLICATIONS

This application claims the benefit of U.S. Provisional Patent Application Ser. No. 61/252,596, filed Oct. 16, 2009, the contents of which are incorporated herein by reference thereto.

This application claims the benefit of U.S. Provisional Patent Application Ser. No. 61/329,921, filed Apr. 30, 2010, the contents of which are incorporated herein by reference thereto.

This application is also a continuation-in-part of U.S. patent application Ser. No. 12/111,168 filed Apr. 28, 2008, which claims the benefit of U.S. Provisional Patent Application Ser. Nos. 60/926,583 filed Apr. 27, 2007 and 60/966,029 filed Aug. 24, 2007, the contents each of which are incorporated herein by reference thereto.

This application is also a continuation-in-part of U.S. patent application Ser. No. 12/581,762 filed Oct. 19, 2009, which claims the benefit of U.S. Provisional Patent Application Ser. No. 61/106,553 filed Oct. 17, 2008, the contents each of which are incorporated herein by reference thereto.

This application is also a continuation-in-part of U.S. patent application Ser. No. 12/717,645 filed Mar. 4, 2010, the contents of which are incorporated herein by reference thereto.

This application is also a continuation-in-part of U.S. patent application Ser. No. 12/766,804 filed Apr. 23, 2010, which claims the benefit of U.S. Provisional Patent Application Ser. Nos. 61/172,617 filed Apr. 24, 2009, the contents each of which are incorporated herein by reference thereto.

This application is also a continuation-in-part of U.S. patent application Ser. No. 12/766,808 filed Apr. 23, 2010, which claims the benefit of U.S. Provisional Patent Application Ser. Nos. 61/214,774 filed Jun. 1, 2009; 61/214,775 filed Jun. 1, 2009; 61/172,575 filed Apr. 24, 2009; 61/172,631 filed Apr. 24, 2009; and 61/252,596, filed Oct. 16, 2009, the contents each of which are incorporated herein by reference thereto, the contents each of which are incorporated herein by reference thereto.

BACKGROUND

Toy vehicle track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, various track amusement features have been added to the track sets. For example, track features, such as stunt devices or elements, including loops, jumps, collision intersections, etc., have been included in such track sets to increase the play value of the track sets.

However, with many track sets, the vehicles run on a closed loop track moving through the same track features lap after lap. Although such track sets may have one or more stunt devices, a vehicle in the track set may perform the same stunt over and over as it travels along the track. Thus, even in track sets with more than one stunt device, the motion of the vehicle generally remains consistent for each vehicle as it travels along a specific section of the track. This repetitive nature of vehicle travel may result in loss of interest in the track set over a short period of time.

Some track sets have incorporated switching mechanisms to enable a user to direct a vehicle to a select travel path. However, generally such systems require manual manipulation of the track and/or manual actuation of a switch to reroute one or more vehicles traveling on the track. Play possibilities may be limited as travel along the select paths may again become repetitive over a short period of time.

Accordingly, it is desirable to provide toy track set with interchangeable elements to provide numerous configurations.

SUMMARY OF THE INVENTION

In one embodiment, a relay segment for a toy track set is provided, the relay segment having: a first actuator; a second actuator; an object movably secured to the relay for movement from a first elevated position to a second lower position; a first trigger moveably secured to the first actuator for movement between a first position and a second position wherein movement of the trigger from the first position towards the second position causes the actuator to release the object from the first elevated position such that the object travels towards the second lower position; and a second trigger coupled the second actuator wherein movement of the second trigger launches an object from the second actuator, wherein the second trigger is moved when the object is at the second lower position.

In another embodiment, a relay segment for a toy track set is provided, the relay segment having: a base structure; a guide member mounted to the base; a carrier moveably mounted to the guide member, wherein the carrier is configured to descend along the guide member from a first raised position to a second base position by the force of gravity; a launcher configured to propel an object away from the relay; a first trigger configured to activate the descent of the carrier from the first raised position; and a second trigger configured to activate the launcher, wherein the second trigger is configured to be actuated by the carrier when it reaches the second base position.

In another exemplary embodiment, an interchangeable toy track set is provided, the interchangeable toy track set having a plurality of interchangeable relay segments each of which may be coupled to each other to create a plurality of variations for the toy track set, wherein at least one of the plurality of interchangeable relay segments has: a base structure; a guide member mounted to the base; a carrier moveably mounted to the guide member, wherein the carrier is configured to descend along the guide member from a first raised position to a second lower position by the force of gravity; a launcher configured to propel an object away from the relay on an outgoing track segment; a first trigger configured to activate the descent of the carrier from the first raised position, wherein the first trigger is positioned to receive an object launched by another relay segment; a second trigger configured to activate the launcher, wherein the second trigger is configured to be actuated by the carrier when it reaches the second base position; and wherein the object propelled onto the outgoing track segment is received on an incoming track segment of another relay.

DETAILED DESCRIPTION

In accordance with exemplary embodiments of the present invention a customizable track set is provided. In one embodiment, the track set includes a plurality of interchangeable relay segments each of which may be coupled to each other to create a customized expandable track set. The relay segments may include one or more stunt elements and may be selectively positioned at the beginning, middle, or end of the track set. Each relay segment may be configured to enable a toy vehicle to traverse an obstacle and/or perform a stunt and launch the toy vehicle down a track towards another relay segment, which then may initiate a second vehicle to be released and traverse still another obstacle and/or perform still another stunt.

Figure 1:
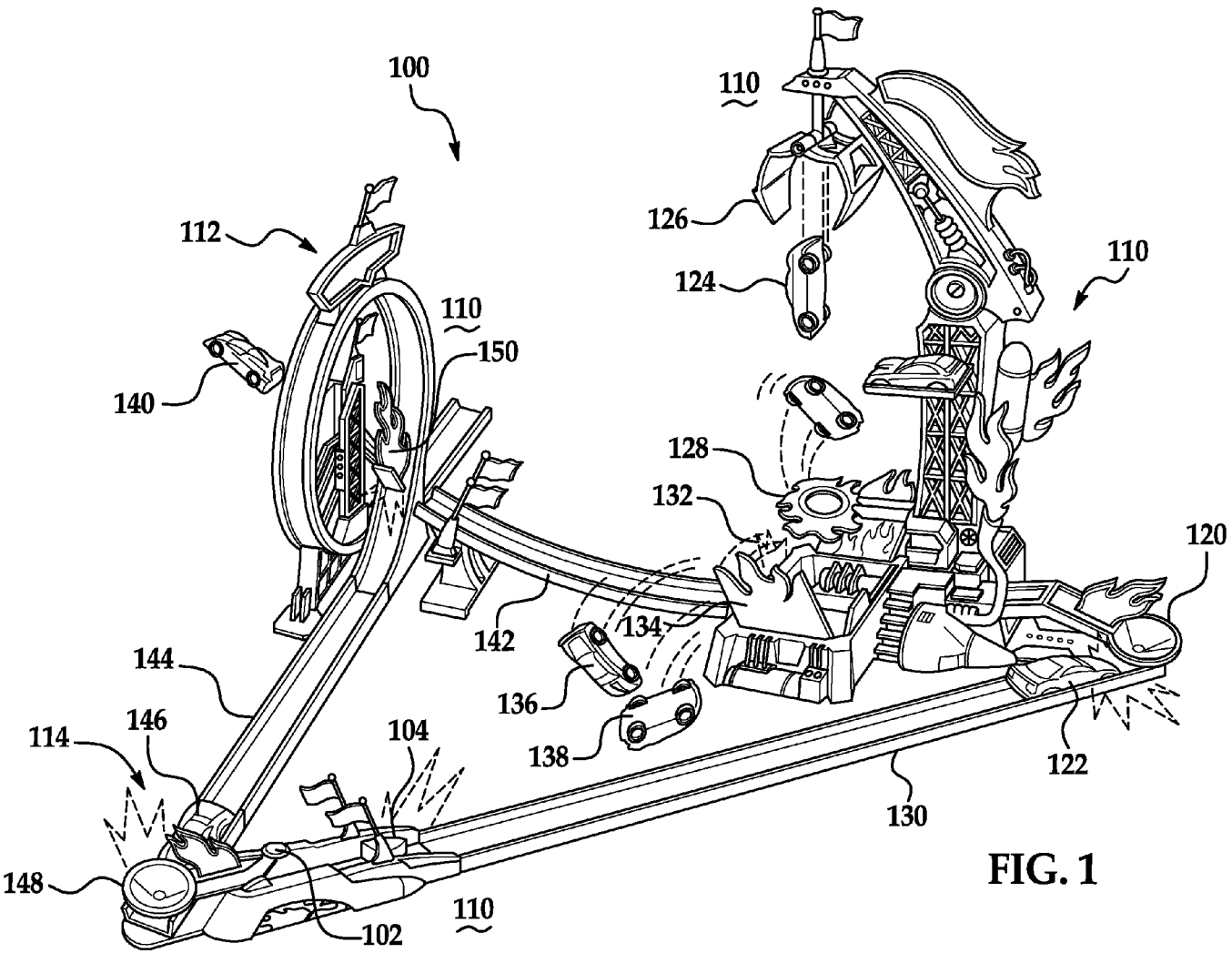
FIG. 1 shows an example toy vehicle track set including a plurality of relay segments in accordance with an exemplary embodiment of the present invention.

An example track set 100 having three relay segments 110, 112, and 114 is shown in FIG. 1. As discussed in more detail below, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns. In this way, a user can experience diverse track play and excitement time and time again.

In this first example, each relay segment 110, 112, and 114 may include an incoming vehicle trigger which may directly or indirectly causes the launching of another outgoing vehicle. The outgoing vehicle from one segment may become the incoming vehicle of a next segment. One or more launchers may be provided to accelerate toy vehicles along the track. As such, the launchers may be configured to engage and urge a toy vehicle to travel along the track. It should be appreciated that although launchers are described herein, vehicles may be manually propelled along the track without the use of a launcher without departing from the scope of the disclosure.

Although any suitable launcher may be used, in the illustrated embodiments, various automatically and manually-triggered release launcher elements are illustrated. A vehicle may be positioned in launch position such that a launch element may slidingly engage the vehicle to propel the vehicle along the track. The launch element may be biased to a launch position, such as by springs, elastic bands or any other suitable biasing mechanism such that release of an activator releases its stored potential energy.

Figures 1A, 1B:
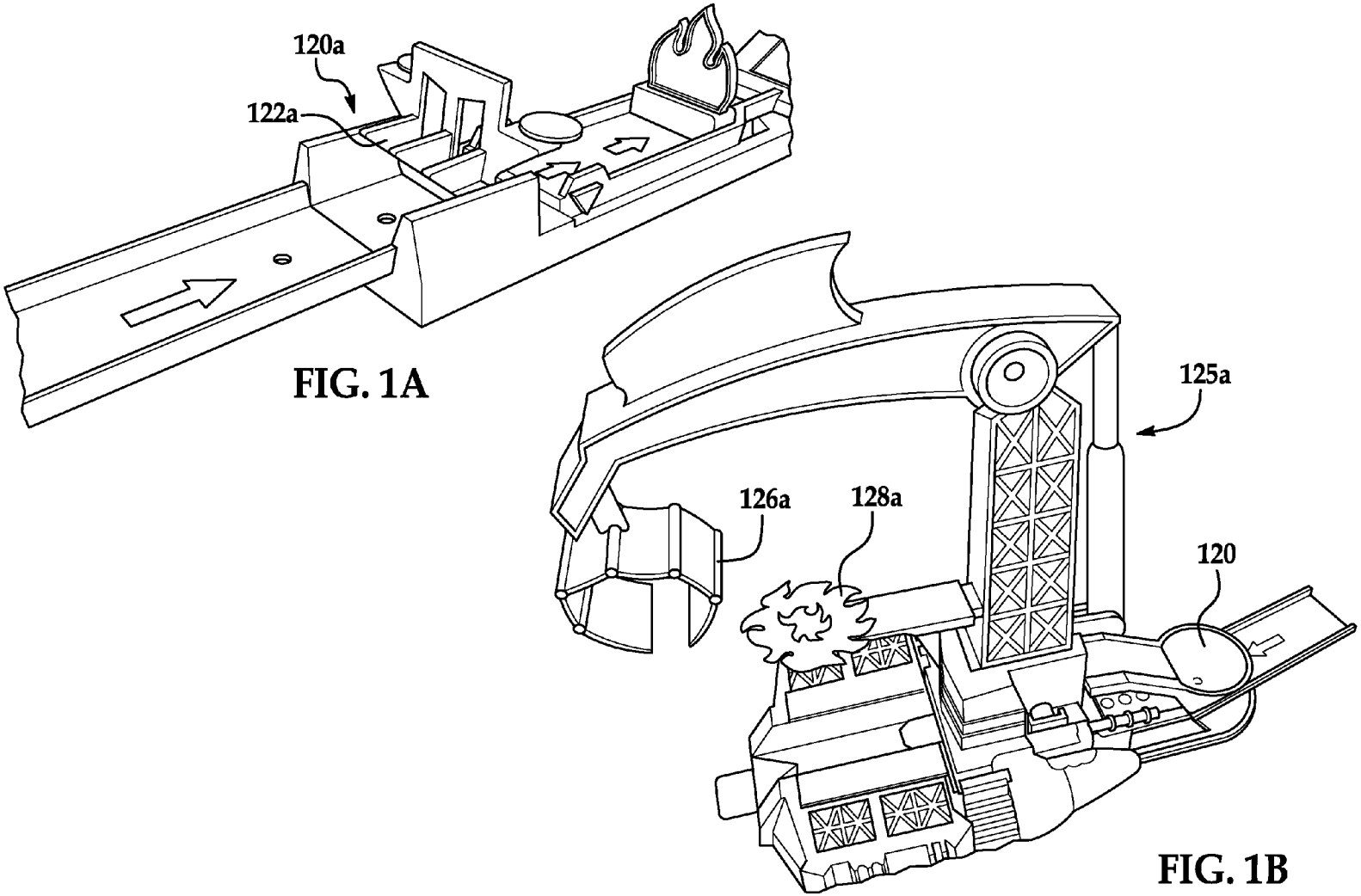
FIGS. 1*a* and 1*b* further illustrate segments of an exemplary toy vehicle track set.

In one example, the relay segments may include triggers, such as conical shaped triggers (shown in FIG. 1 at 120) or angled trigger shapes that are not necessarily conical (shown in FIG. 1*a* at 120*a*). As an example, conically shaped trigger 120 may have a cone angle of approximately 45 degrees, which is actuated vertically via contact with a horizontally moving incoming vehicle. It should be appreciated that the cone angle may be of any suitable angle such that an incoming vehicle actuates the trigger. Thus, as a non-limiting example the cone angle may be anywhere from 5-90 degrees.

Further, while this example shows a conical trigger, alternatively, it may be planar shaped and angled (e.g., approximately 45 degrees) relative to an incoming track. As a further example and as shown in FIG. 1*a*, trigger 120*a* may have a flat, angled plane 122*a* (formed by a plurality of ridges) that is contacted by a vehicle on a track. Again, although shown with an angle of approximately 45 degrees, any suitable angle may be applied (e.g. 5-90 degrees) such that a vehicle actuates the trigger.

In some relay segments, actuation of a trigger by a first vehicle initiates a stunt and release of a second vehicle on the track set. As an example and referring again to FIG. 1, in the configuration illustrated, track play may be commenced with stunt element or relay segment 114. For example, actuation of a manual release or manual 102 may propel or launch vehicle 122 along track 130 toward a second relay segment 110. In one example embodiment, a relay segment may enable a variable change of vehicle traveling direction (between an incoming and outgoing vehicle), thus further providing variable configurations for more diverse track play.

It is noted that track 130 includes direction indicators, such as molded-in arrows, or cut-outs which may indicate vehicle direction and/or assembly instructions for a toy track set. For example, the direction indicators may aid in the ease of assembly for an expandable track set, may provide specific direction of vehicle travel used to initiate stunts, or enable passage past obstacles. Although the direction indicators are shown as a row of cut-out arrows, it should be appreciated that the direction indicators may be of any size and/or shape to indicate assembly direction and/or vehicle travel direction. Further, although a plurality of arrows is illustrated, a single arrow or other cut-out may also be used without departing from the scope of the disclosure. Further, in some embodiments, the direction indicators may be positioned in a center of the track so that the wheels of the vehicles are not impeded. It further should be appreciated that although shown as cut-outs, the direction indicators may be surface indicators, raised moldings, etc.

Referring back to FIG. 1, vehicle 122 traveling along track 130 in the direction of the direction indicators may contact or engage a second relay segment, e.g. relay segment 110. For example, relay segment 110 may be a stunt element, such as a crane element 125. Upon contact or actuation of trigger 120 through vehicle 122, a crane stunt event may be initiated. In the crane stunt event, a second vehicle, e.g. vehicle 124, may be released from jaws 126 of crane element or crane 125. FIG. 1*b* further illustrates another embodiment of a crane relay segment.

Figure 1C:
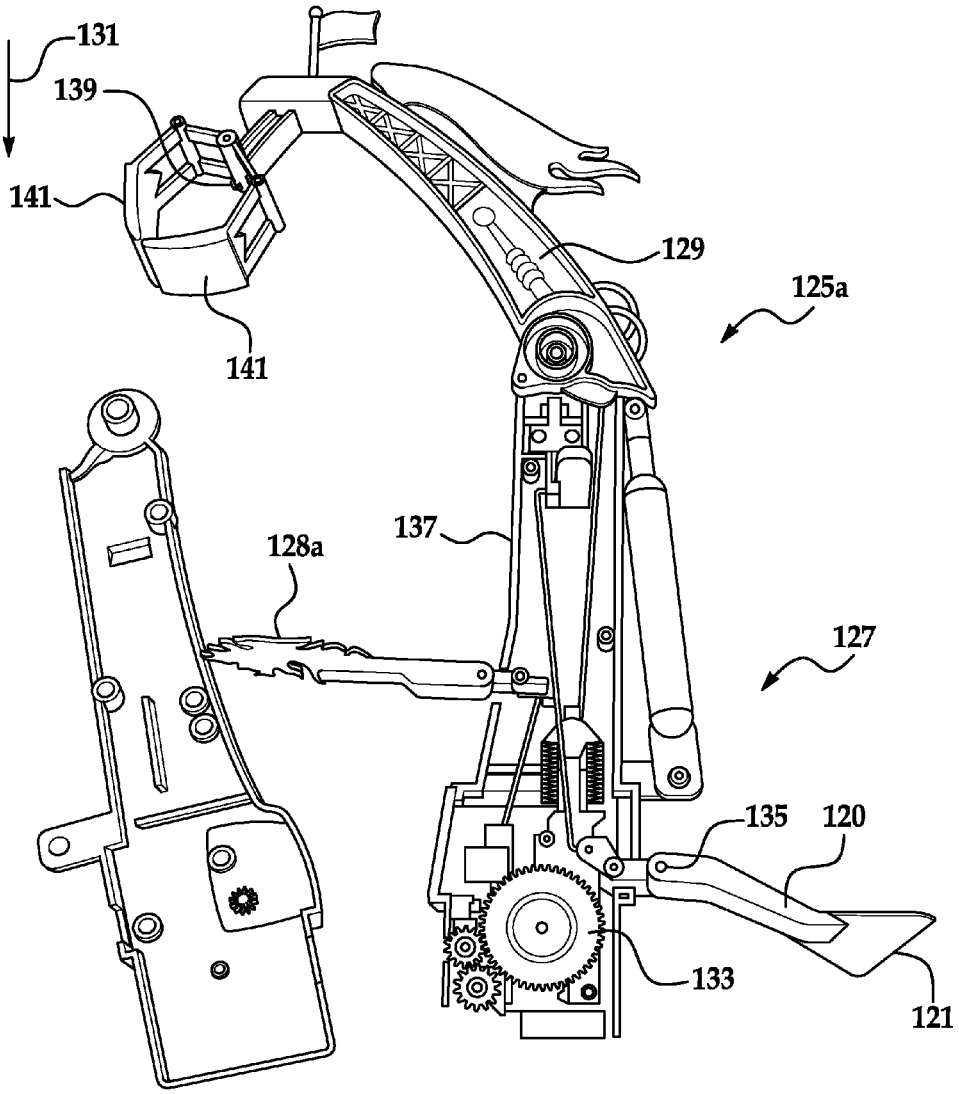
FIG. 1*c* shows an internal view of an example relay segment.

As shown in FIG. 1*b*, a crane relay segment 125*a* may include two triggers to perform a crane-based stunt. The first trigger may be a switch, such as a cone or other shaped actuation switch 120 at the end of an incoming track. A first vehicle may engage the first trigger and initiate release of a second vehicle which is held in the crane jaws. The vehicle released from the crane jaws 126*a* may fall and actuate a second trigger 128*a* to initiate the launch of a third vehicle onto an outgoing track. In addition, in some embodiments, the second trigger may also release a spring-loaded platform to knock off a stack of vehicles. The jaws of the crane, when fully closed, may hold the vehicle in a ready-to-be-released position. FIG. 1*c* further illustrates the mechanics of an example crane relay segment 125*a*.

FIG. 1*c* illustrates a mechanism 127 for performing the affirmation two trigger event. In one embodiment an upper portion 129 of the crane is moved downward in the direction of arrow 131 wherein a plurality of gears 133 are rotated and potential energy is stored in a spring mechanism that is wound as the gears are rotated and a pawl or catch mechanism engages the gears to prevent back driving of the gears by this spring mechanism, wherein the pawl or catch mechanism is released from the engaging position when a conical surface 121 of trigger 120 is engaged thus causing the same to pivot about a pivot point 135 with respect to a lower portion 137 of the crane. Once the kinetic energy of the spring mechanism is released the gear train causes the upper portion of the crane to move upward in a direction opposite to arrow 131 which also causes a clasp 139 to release a pair of claw members 141 from their grasping position illustrated in FIG. 1*c* to the open position illustrated in FIG. 1, wherein a car 124 is dropped and second trigger 128*a* is activated again releasing stored potential energy to cause another stunt to occur for example the flipping of the toy vehicles illustrated in FIG. 1. Clasp 139 may be any suitable arrangement comprising a hook of one of the claw members configured to engage a member of the other one of the claw members to retain the claw members in the position illustrated in FIG. 1*c* and thus allowing them to open to the position illustrated in FIG. 1 when the upper portion crane is moved upwardly such that the vehicle retained in the claw members is now above trigger 128*a*.

Referring again to FIG. 1, following activation of relay segment 110, and release of vehicle 124 onto target 128, launching element 132 and opening shelf 134 may be actuated. Specifically, launching element 132 may launch vehicle 140 along track 142, while opening shelf 134 throwing vehicles 136 and 138. Vehicle 140 may be propelled toward a third relay segment, such as relay segment 112.

Vehicle 140 may actuate a trigger in relay segment 112. The relay segment 112 may actuate launching element 150 to launch a third vehicle 146 toward relay segment 114. In some embodiments, track events may be terminated at trigger 148. However, in other events, another relay segment, stunt element, or obstacle may be added to the track such that the track does not terminate at trigger 148.

It should be appreciated that each relay segment may be selectively positioned in the track chain. As an example, relay segment 110 may be at the beginning, middle or end of the track. Similarly, relay segments 112 and 114 may be positioned at the beginning, middle or end of the track. A user may be able to customize the track by positioning the relay segments in a desired order.

It should be appreciated that the track play of each relay segment may be activated directly or indirectly by actuation of the trigger. As an example of indirect activation, the relay segment may include a stunt element performed by either the first or second vehicle. Further, the stunt element may be performed by a third vehicle. Further still, the stunt element may include multiple simultaneous, parallel, and/or sequential stunts performed by a plurality of vehicles, where the stunts may be performed simultaneously, in sequence with one triggering the next, in parallel, or combinations thereof. In still another embodiment, the launching element and/or the trigger may also include stunt elements performed by one of the first and second, or other vehicles. Although described in regards to actuation of the stunt elements via vehicle triggering, alternatively, track play may commence via manual activation of any of the relay segments or stunt elements. While FIG. 1 shows various example relay segments with multiple stage stunts, as well as without stunts, numerous variations in relay elements are possible.

Although shown with regard to a single straight-line track, it should be understood that virtually any number of different track designs may be used without departing from the scope of this disclosure. For example, parallel track configurations may be used, as well as combination sequential/parallel track configurations may be used. Further, various stunts may be performed, rather than the drops and/or loops shown, such as jumping over voids, traversing obstacles, etc.

Figure 2:
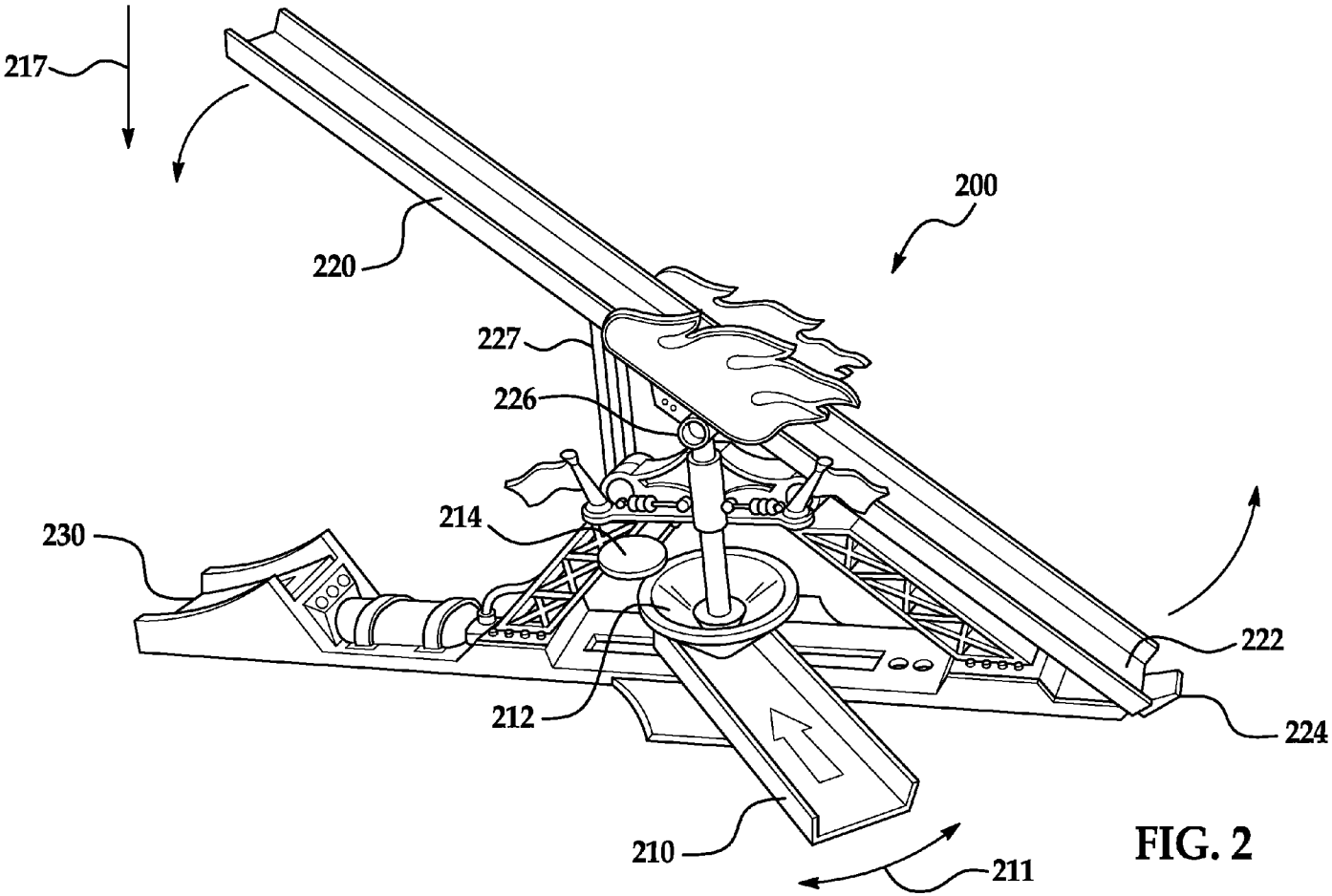
FIGS. 2-11E show example relay segments.

FIG. 2 shows an example relay segment 200 having a teeter-totter styled stunt element to provide indirect launching via automatic and/or manual trigger activation. Specifically, FIG. 2 shows an incoming track section 210 coupled to a conical trigger 212, which can also be actuated via the manual button 214. In this example, the trigger retains the ramp 220 in spring loaded position when the trigger or conical surface 212 thereof is in a downward position, such that contact by an incoming vehicle on track 210 causes the trigger to move vertically, release a catch that then releases spring loaded motion of ramp 220. For example, a vehicle may be pre-loaded at end 222 and held in place by stop 224. Then, upon release, the ramp 220 may rotate about pivot 226 as shown to launch a vehicle stored at 222. The vehicle may then exit the relay segment through exiting track section 230. In accordance with an exemplary embodiment of the present invention, the higher end ramp is pulled downward in the direction of arrow 217 to an urging force provided by a spring biased member or elastic member 227 thus causing the ramp 220 to pivot about pivot 226. The retention of the ramp in the illustrated position with the biasing member 227 extended it is facilitated by a catch that will engage a complementary member of the trigger which is moved out of its retaining position when the conical portion or the manual portion that of the trigger is moved thus releasing the stored potential energy of the elastic member.

While not shown in this example, the exiting track section 230 may be coupled to further track sections that may lead to additional relays segments, for example. Also, incoming track section 210 may be adjustable (e.g., rotatable or pivotally mounted to the relay segment for movement in the direction of arrows 211) to enable an incoming vehicle to enter the relay segment from a plurality of angles. Further, incoming track section 210 may be coupled to track segment that may be mounted to a higher altitude position, such that gravity may "launch" the incoming vehicle. Likewise, exiting track section 230 may also be adjustable.

Figure 3:
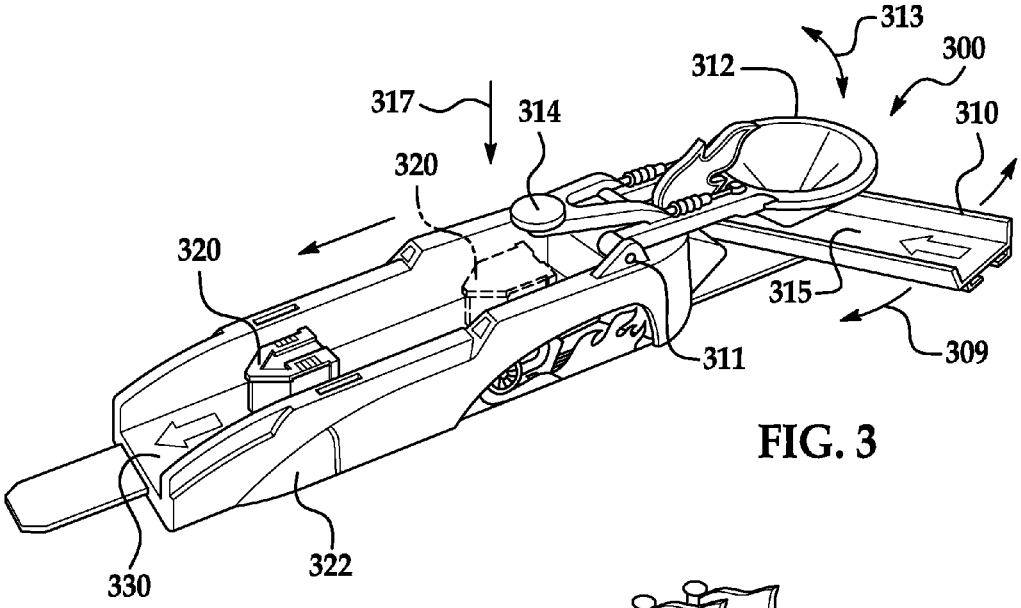
Figure 3A:
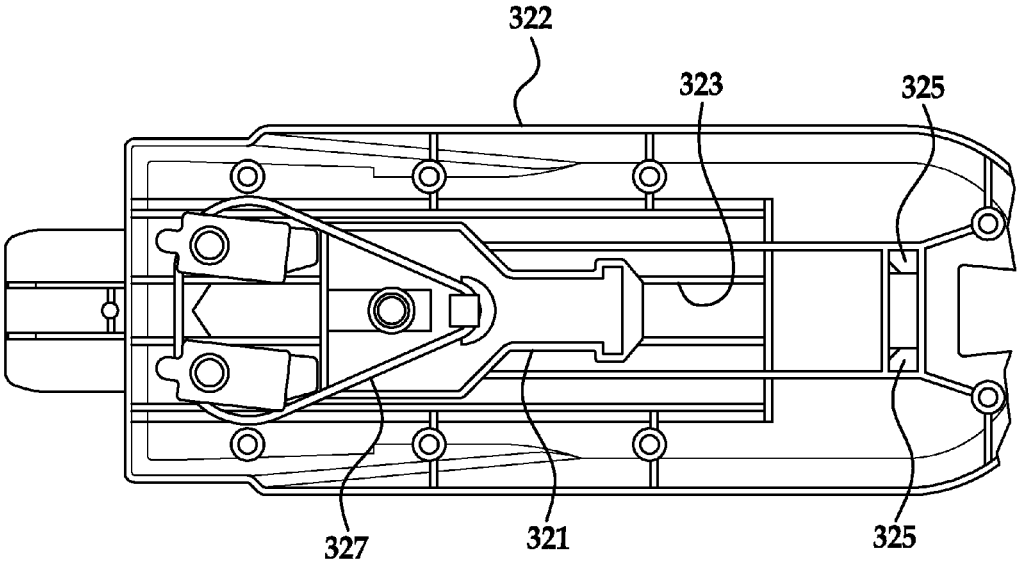
Figure 3B:
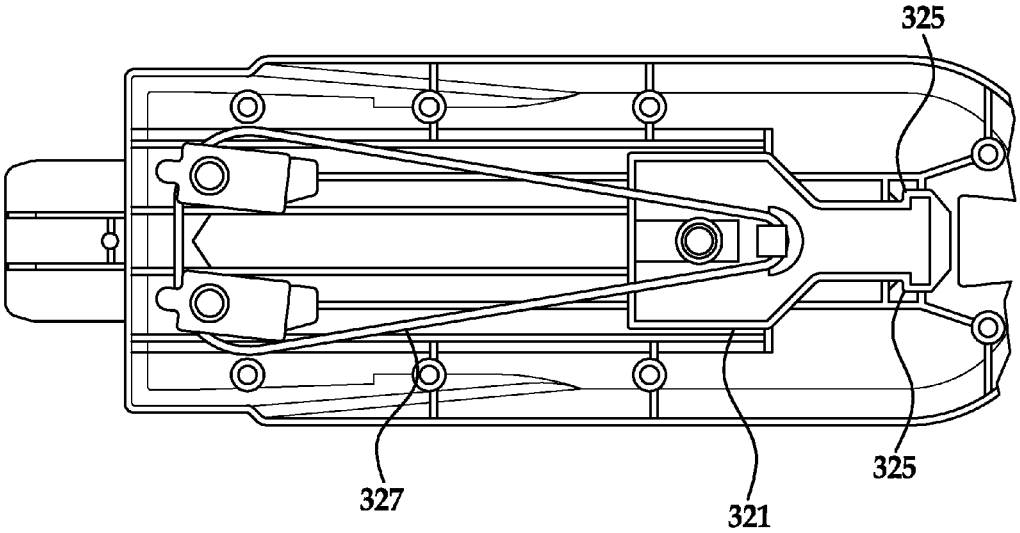

FIGS. 3-3B illustrate an exemplary direct acting relay segment 300. Specifically, FIG. 3 shows an incoming track section 310 coupled to the segment proximate to a conical trigger 312, which can also be actuated via the manual button 314. In this example, the trigger locks a launcher in a loaded position when the launcher is moved to a launch position and the trigger is in the position illustrated in FIG. 3. The trigger releases the stored energy of the launcher when a contact portion of the trigger is moved upwardly to release a catch retaining the launcher in the launch position. In one exemplary embodiment contact of the conical surface of the trigger by an incoming vehicle on track 310 causes the trigger to move vertically, release a catch that is retaining the launcher in the launch position. As illustrated in FIG. 3 a spring loaded launcher or protrusion 320 slides between a launched position (illustrated by the solid lines in FIG. 3) and a launch position (illustrated by the dashed lines in FIG. 3) in launcher 322. Accordingly, and as the launcher slides from the launch position to the launched position a toy vehicle in launcher 322 is pushed out of the relay segment. For example, a vehicle may be pre-loaded in launcher 322 until activation. Then, the vehicle may then exit the relay segment through exiting track section 330.

In this example, the trigger is pivotally mounted to the launching stunt element via pins 311 for movement between a first position and a second position in the direction illustrated by arrows 313, wherein movement of trigger from the first position (illustrated) to the second position (not-illustrated) occurs when a vehicle moves into an area 315 between a contact surface of conical trigger 312 and incoming track segment 310 thus forcing the conical trigger upward and away from track segment 310.

In addition, and in order to provide manual activation of the trigger (i.e., to begin a series of triggering events by launching the first car from a relay segment or a plurality of users can individually launch a car from separate relay segments or any combination thereof) a manual switch 314 is also secured to the trigger such that an application of a force in the direction of arrow 317 will cause the trigger to pivot about pivot pins 311 and move the contact surface of the conical portion away from the track segment 310 and dust release the launcher from its launch position.

Referring now to FIGS. 3*a*-3*b*, a bottom portion of launcher 322 is illustrated. Here a bottom portion 321 of the launcher 320 slides within a slot 323 of the launcher in order to effect movement from the launch position to the launched position. In accordance with one exemplary embodiment of the present invention a catch 325 secures and retains a portion of bottom portion 321 as it slid into the launch position. In order to provide the biasing force for urging the launcher from the launch position to the launched position a biasing element 327 is secured to the launcher and bottom portion 321. In accordance with an exemplary embodiment of the present invention, the biasing element is an elastic member. Of course, it is understood that any biasing element can be used, non-limiting examples include springs, resilient members and equivalents thereof. In addition, it is also understood that any suitable configuration may be provided for the catch and the bottom portion. In an exemplary embodiment and as the trigger or the conical portion of the trigger moves away from the track segment 310 catch 325, which is secured to the trigger and any suitable manner moves away from its retaining position illustrated in FIG. 3*b* and allows the elastic member to slide the launcher from the launch position to be launched position thus propelling a toy vehicle out of launcher 322. It is, of course, understood that the aforementioned description of the movement of the trigger and release of a biasing member is provided as an example and the exemplary embodiments of the present invention are not intended to be limited to the specific embodiment disclosed above. Similarly, exemplary embodiments of the present invention are not limited to launcher described above. For example, other releasable spring biased or otherwise type of toy launchers are found in U.S. Pat. Nos. 4,108,437 and 6,435,929 and U.S. Patent Publication 2007/0293122 as well as those known to those skilled in the related arts.

It should be noted that exiting track sections of each of the relay segments, such as exiting track section 330, may be coupled to further track sections that may lead to additional relays segments. The relay segments may be interchanged such that the track is customized. Also, incoming track sections of the relay segments, such as incoming track section 310, may be adjustable (e.g., rotatably or pivotally mounted to the relay segment for movement in the direction of arrows 309) relative to exiting track section 330 to enable an incoming vehicle to enter the relay segment from a plurality of angles and/or an exiting vehicle to exit the relay segment at a plurality of angles. It being understood that the exiting track section of each relay segment can be coupled to a movable incoming track section of another relay segment via connector track sections releasably secured to each track section via a releasable engagement mechanisms such as a tongue and groove arrangement. Accordingly, and through the use of movable incoming track segment's multiple angles and orientations are capable of being provided by the vehicle tracks set wherein multiple relay segments of installed therein.

Figure 4:
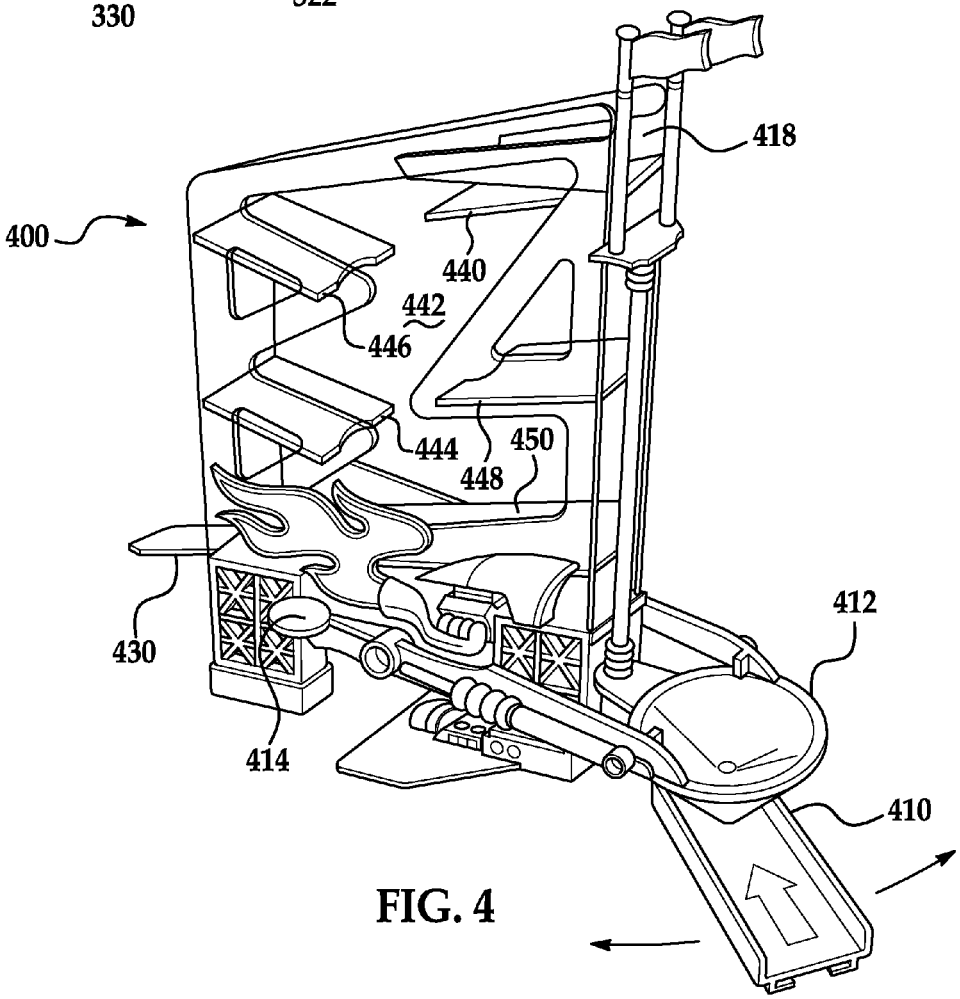

FIG. 4 shows an example indirect acting relay segment 400 having a gravity actuated intermediate falling stunt path. Specifically, FIG. 4 shows an incoming track section 410 coupled to a conical trigger 412, which can also be actuated via the manual button 414. In this example, the trigger may be spring loaded in a downward position, such that contact by an incoming vehicle on track 410 causes the trigger to move vertically, and push a vehicle positioned at the end section 418 to begin the falling stunt. As the vehicle is moves down ramp 440, it falls through the void 442 and may intermittently contact other track sections (e.g., 444, 446, 448) before landing on track 450. If the vehicle successfully lands on track 450, gravity moves the vehicle to be launched and it exits the relay segment through exiting track section 430.

Figure 5:
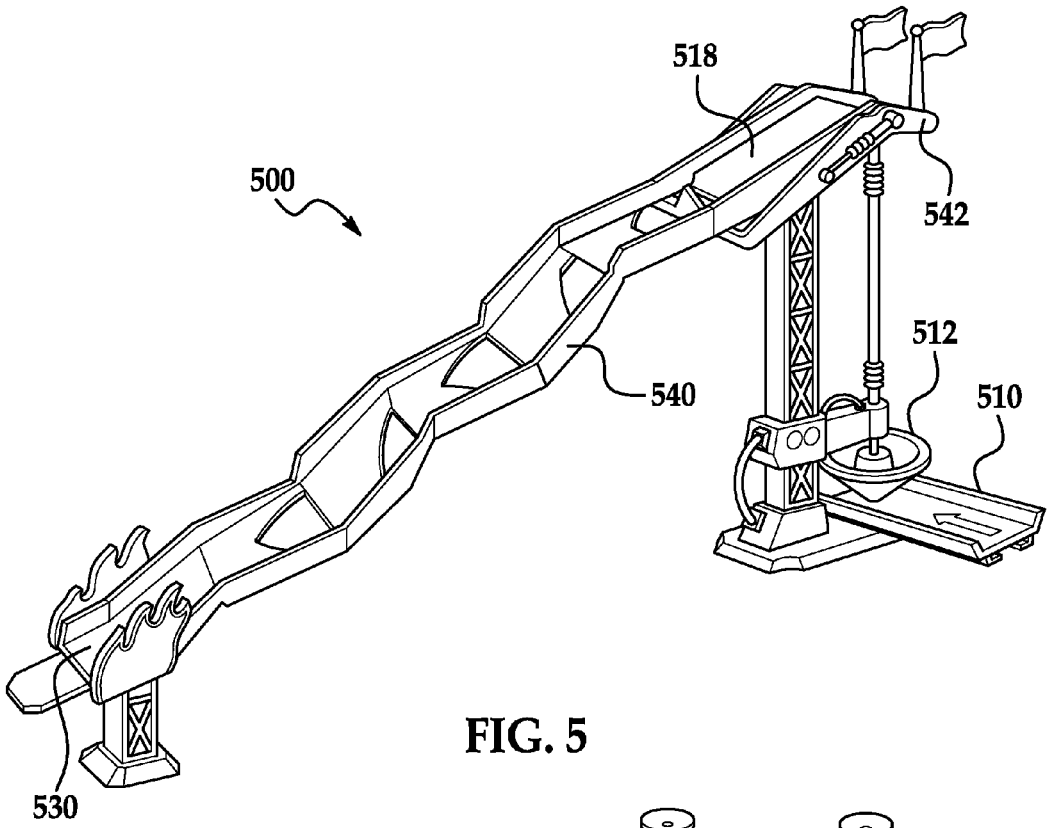

FIG. 5 shows an example indirect acting relay segment 500 having a gravity actuated zig-zag ramp stunt. Specifically, FIG. 5 shows an incoming track section 510 coupled to a conical trigger 512. In this example, the trigger may be spring loaded in a downward position, such that contact by an incoming vehicle on track 510 causes the trigger to move vertically, and push a vehicle positioned at the end section 518 to initiate movement down ramp 540, such as via rotation by platform 542. As the vehicle is moves down ramp 540, if successful, it is launched and exits the relay segment through exiting track section 530.

Figure 6:
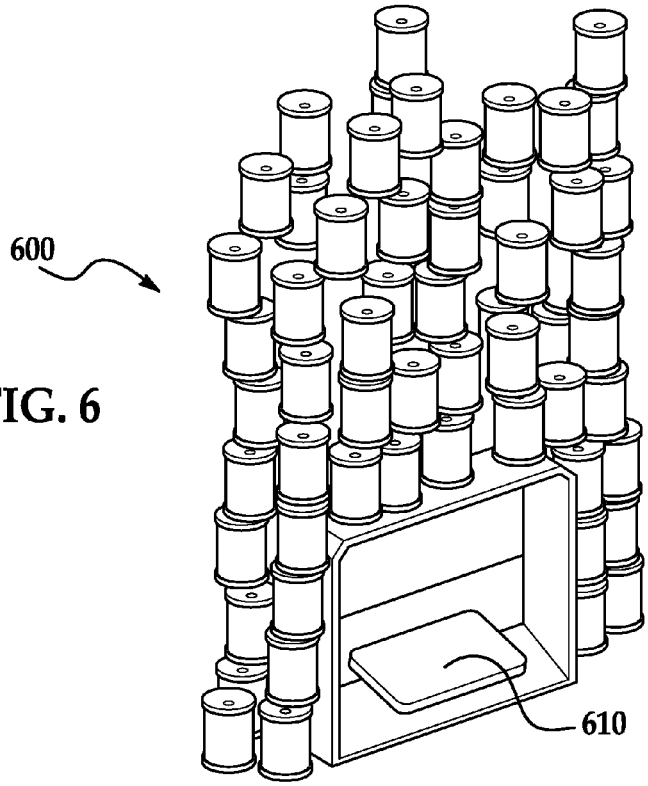

FIG. 6 shows an example relay segment 600 which may be selectively positioned along the track. As an example, the relay segment may include a track receiver 602 such that the track 604 lays into a groove 603 of the relay segment 600 in contrast to sliding male/female connector. A trigger or actuator 605 may be included to effect a stunt. For example, in the illustrated embodiment, activation of the lever (via contact with a traveling toy vehicle on the track) may cause the top of the silo to launched upward to simulate an explosion.

Figure 7:
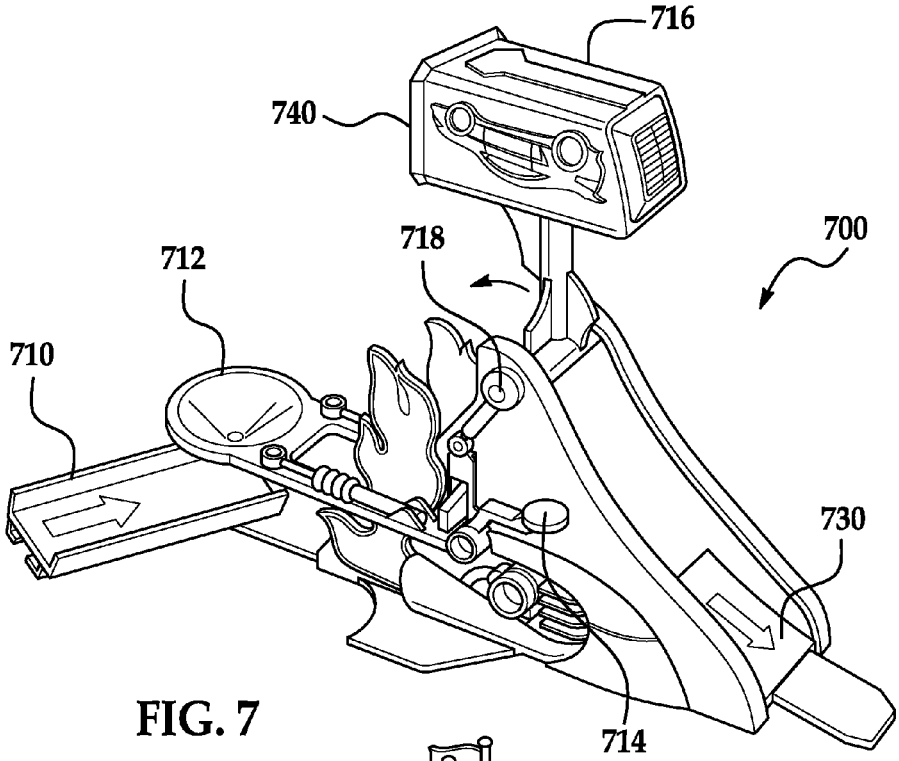

FIG. 7 shows an example indirect acting relay segment 700 having a gravity actuated hammer launch stunt. Specifically, FIG. 7 shows an incoming track section 710 coupled to a conical trigger 712, which can also be actuated via the manual button 714. In this example, the trigger may be spring loaded in a downward position, such that contact by an incoming vehicle on track 710 causes the trigger to move vertically, and initiate rotation of hammer box 716 about axis 718. A vehicle may be pre-loaded and positioned within hammer box 716 (which is open at end 740, not shown) such that upon swinging downward and stopping in the horizontal position, momentum is imparted to a vehicle that is launched out and/or down exiting track section 730, which may serve as a stop to stop rotation of hammer box 716.

While not shown in this example, the exiting track section 730 may be coupled to further track sections that may lead to additional relays segments, for example. Also, incoming track section 710 may be adjustable (e.g., rotatable) relative to exiting track section 730 to enable an incoming vehicle to enter the relay segment from a plurality of angles and/or an exiting vehicle to exit the relay segment at a plurality of angles.

Figure 8:
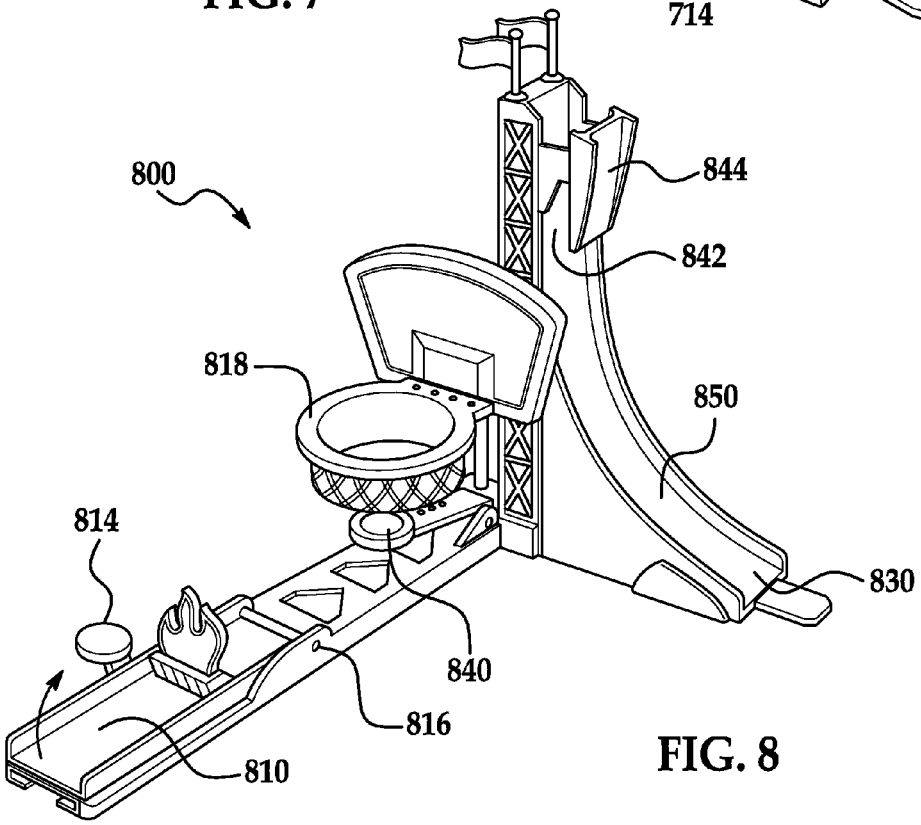

FIG. 8 shows two relay segments 800, including a basketball hoop stunt 802 and a ramp stunt/launcher stunt 804. The relay segments may be positioned in any order on the track. Specifically, basketball hoop stunt 802 includes a spring-loaded platform 810 on which a vehicle may pre-loaded. Upon actuation of the manual button 814, spring-loaded platform 810 rotates about axis 816 and if a vehicle passes through hoop 818, it may actuate a secondary trigger 840.

Another basketball hoop stunt 800*a* is shown in FIG. 8*a*. The relay segment may be configured such that an incoming vehicle is flipped up (e.g., via a spring loaded plate) toward a hoop, and if the vehicle lands in the hoop, a second actuator is triggered to launch a second vehicle in the same or alternative direction as the travel of the first, incoming vehicle.

Similarly, ramp stunt/launcher stunt 804, may be triggered such that, a vehicle, pre-loaded at the top 842 of ramp 850, and held by catch 844, is released (by movement of catch 844) to launch the vehicle out and/or down exiting track section 830, which may actuate or terminate another device, such as rotation of hammer box 716.

Figure 9:
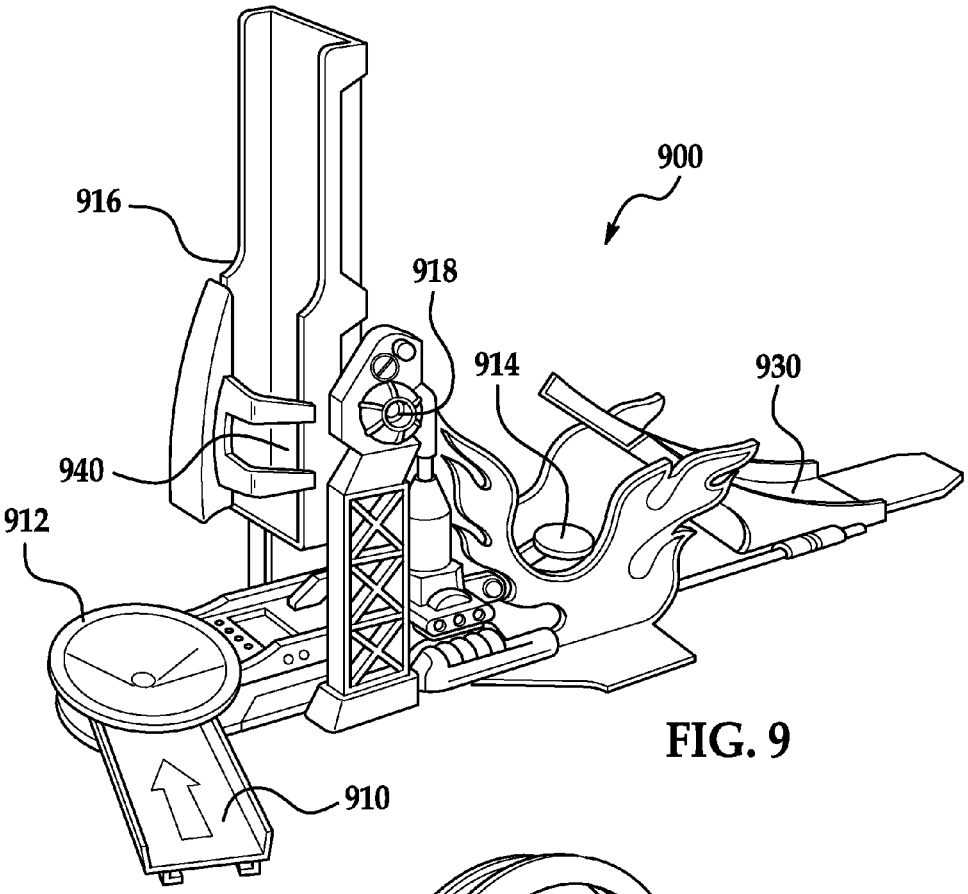

FIG. 9 shows an example indirect acting relay segment 900 having a gravity actuated rotating ramp launch stunt. Specifically, FIG. 9 shows an incoming track section 910 coupled to a conical trigger 912, which can also be actuated via the manual button 914. In this example, the trigger may be spring loaded in a downward position, such that contact by an incoming vehicle on track 910 causes the trigger to move vertically, and initiate rotation of rotating ramp 916 about axis 918. A vehicle may be pre-loaded and positioned within rotating ramp 916 at end 940 such that upon swinging downward and stopping in the downward position, a vehicle is launched down exiting track section 930. In this example, exiting track section 930 is sloped to further increase exiting speed of an exiting vehicle.

While not shown in this example, the exiting track section 930 may be coupled to further track sections that may lead to additional relays segments, for example. Likewise, in this or other examples the incoming track section may be coupled to other relays/stunts via still further track sections. Also, incoming track section 910 may be adjustable (e.g., rotatable) relative to exiting track section 930 to enable an incoming vehicle to enter the relay segment from a plurality of angles and/or an exiting vehicle to exit the relay segment at a plurality of angles.

Figure 10:
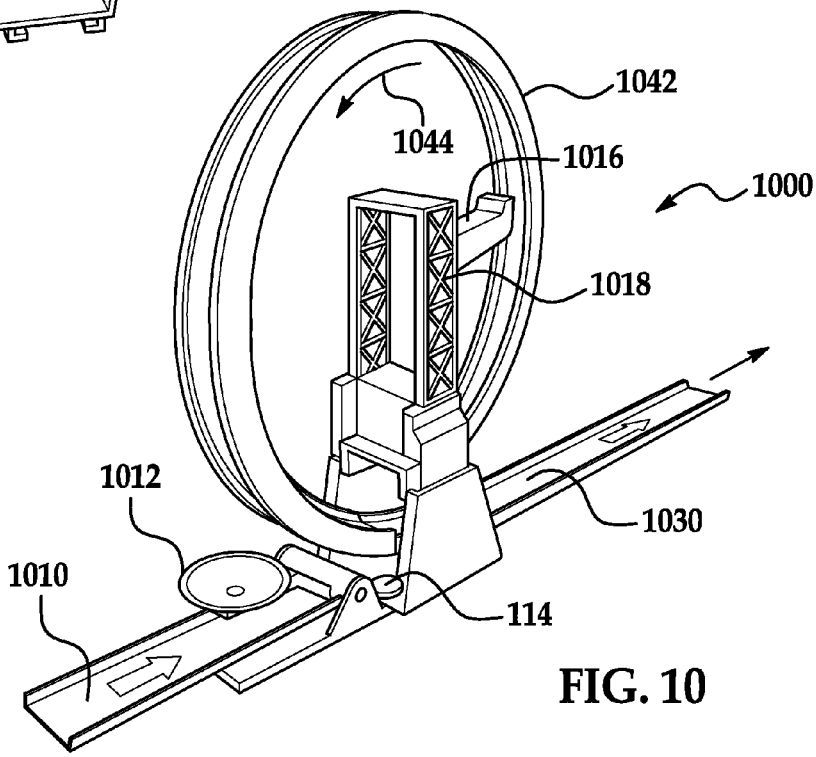
Figure 10A:
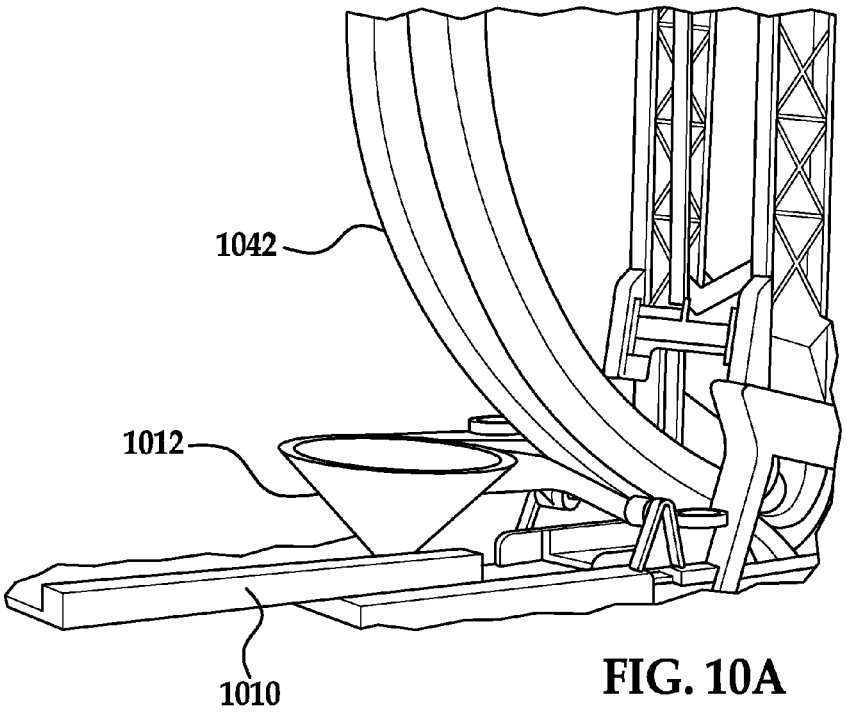
Figure 10B:
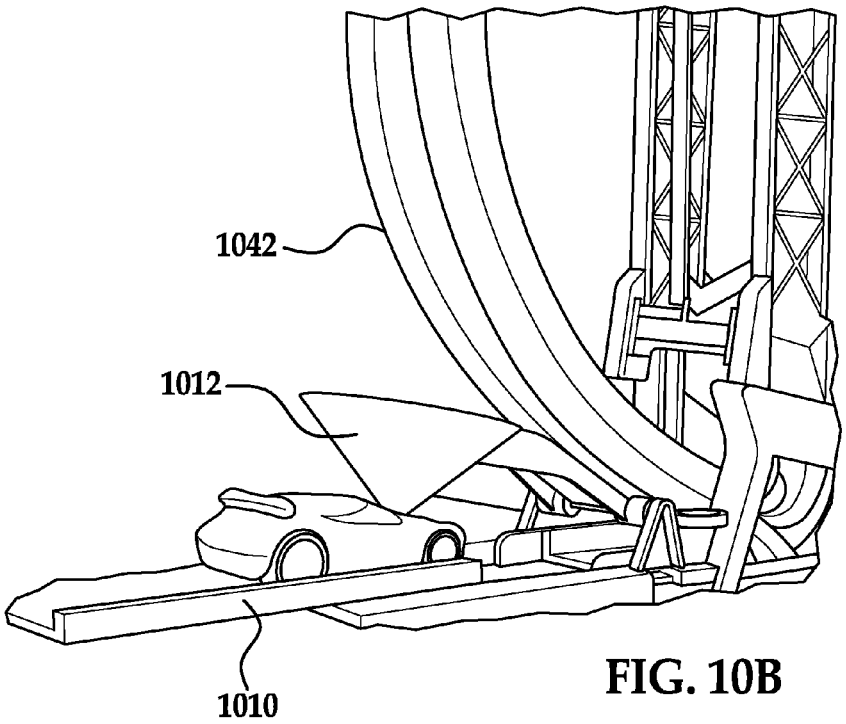

FIG. 10 shows an example indirect acting relay segment 1000 having a loop and launch stunt. Specifically, FIG. 10 shows an incoming track section 1010 coupled to a conical trigger 1012, which can also be actuated via the manual button 1014. In this example, the trigger may be spring loaded in a downward position, such that contact by an incoming vehicle on track 1010 causes the trigger to move vertically and release a catch holding spring loaded launching arm 1016 (note that in FIG. 10, spring loaded launching arm 116 is shown in the fully released state, whereas it is positioned vertically/downward in its pre-loaded state) so that it can rotate about axis 1018 and launch a vehicle pre-loaded at position, generally indicated at 1040. Upon launch, the pre-loaded vehicle travels through the loop track stunt 1042 and is launched out exiting track section 1030. Arrow 1044 indicates the direction of vehicle motion through the loop track stunt 1042. FIG. 10*a* shows the conical trigger 1012 in a first position while FIG. 10*b*. shows the conical trigger in a second position as it is moved up by the toy vehicle and in accordance with an exemplary embodiment of the present invention the trigger releases a launching element for launching a vehicle from the relay segment when the trigger is moved from the first position to the second position.

Figure 11:
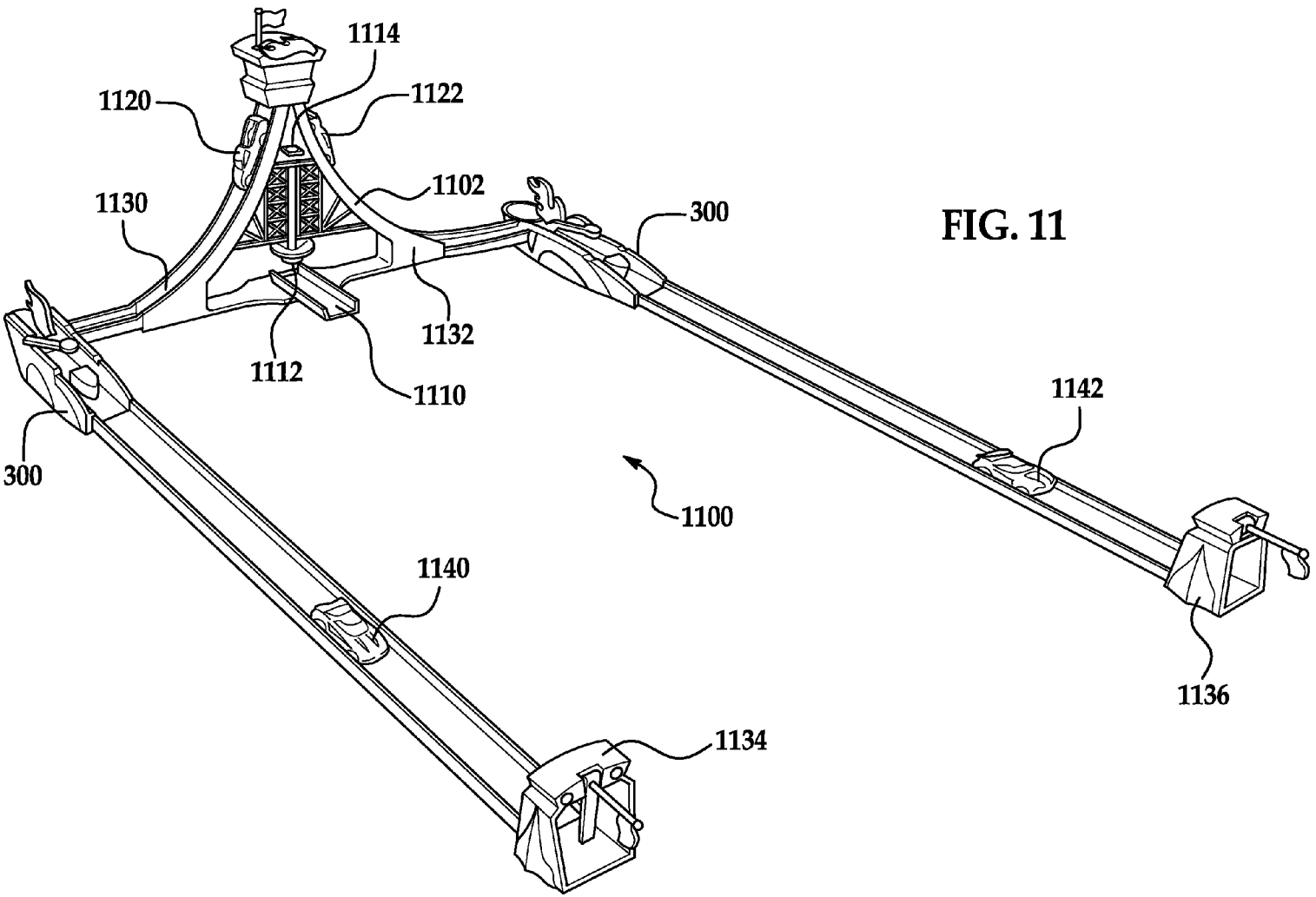
Figure 11A:
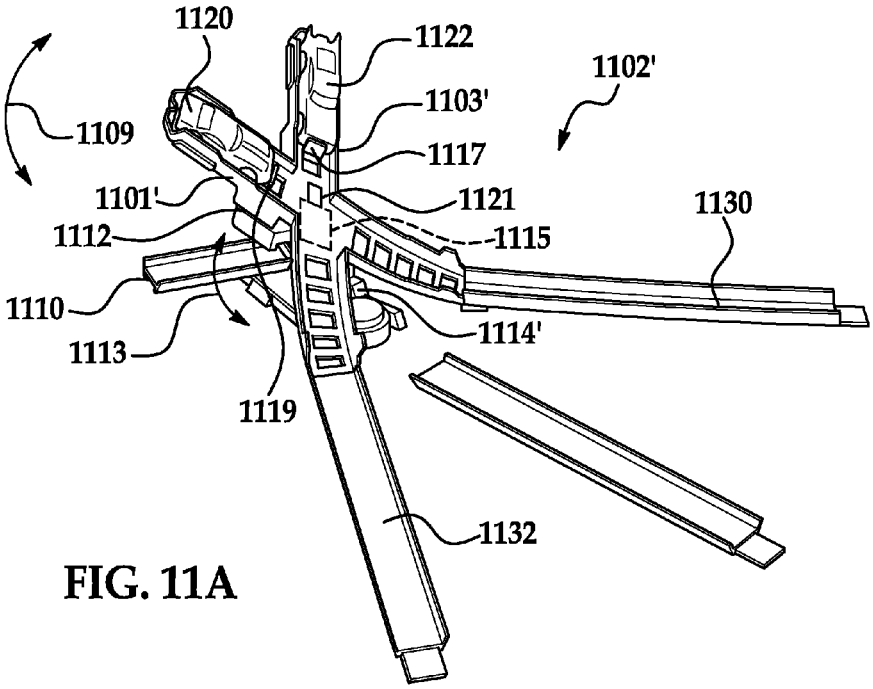
Figure 11B:
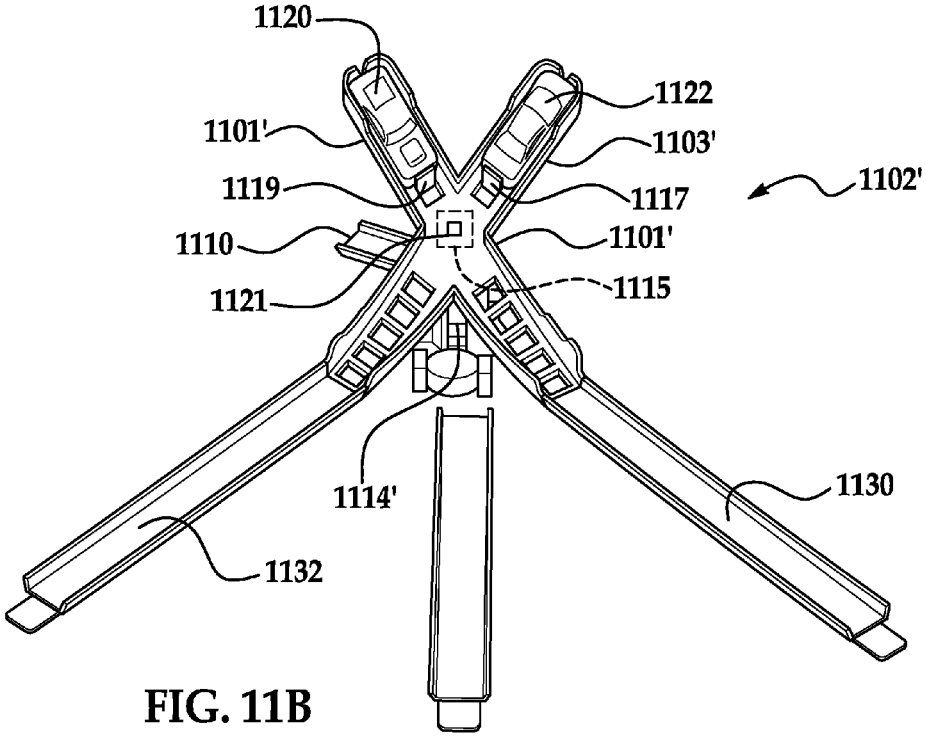
Figure 11C:
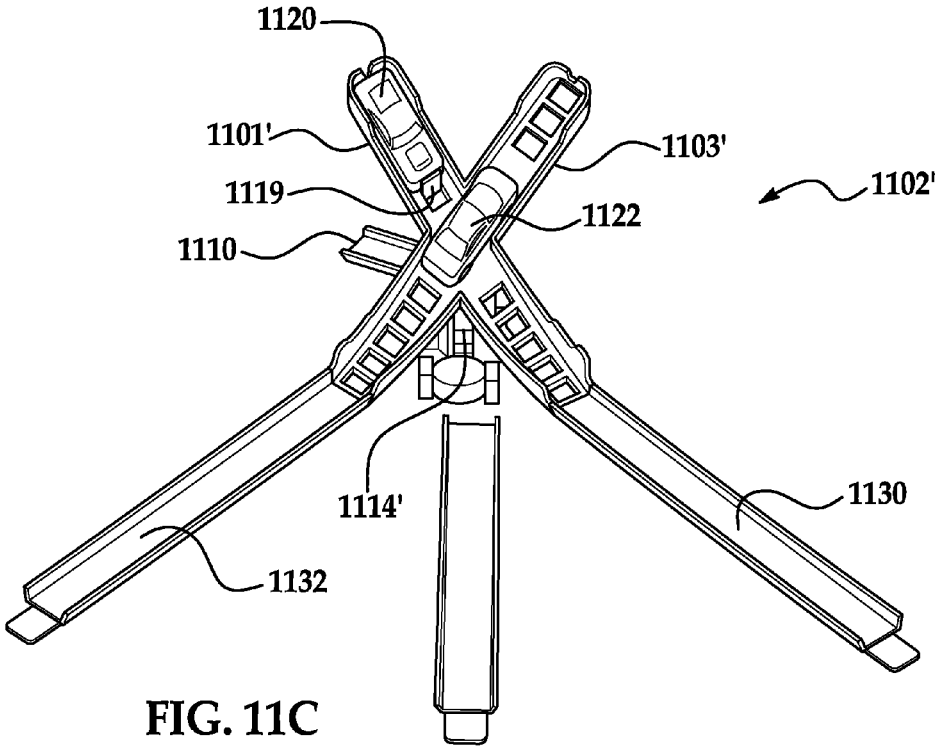
Figure 11D:
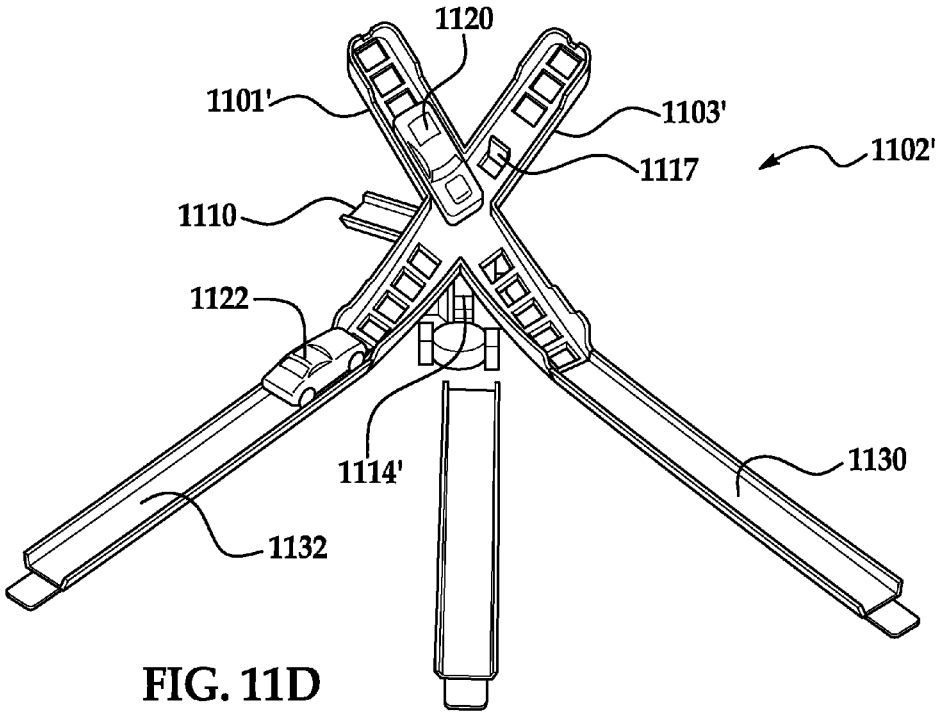
Figure 11E:
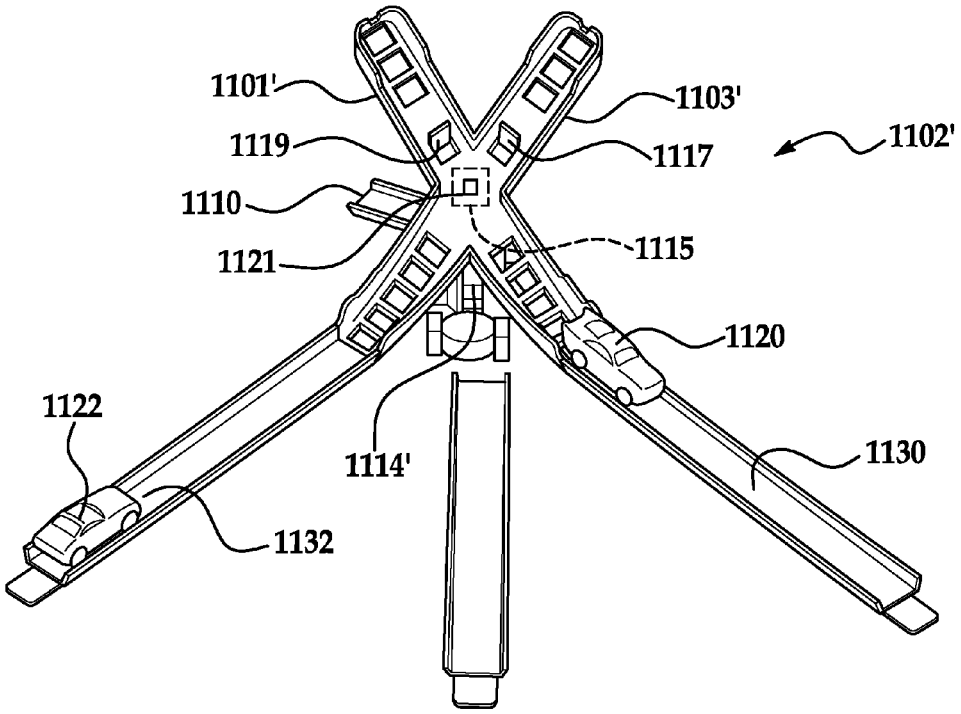

FIG. 11 shows still another track set example, in which motion of a single vehicle may initiate a plurality of vehicles through a plurality of relay segments positioned in parallel configuration. Specifically, as shown in FIG. 11, track set 1100 is shown having a first relay segment 1102 including a dual-action vehicle stunt. Specifically, first relay segment 1102 includes incoming track section 1110 coupled to a conical trigger 1112, which can also be actuated via the manual button 1114. In this example, the trigger may be spring loaded in a downward position, such that contact by an incoming vehicle on track 1110 causes it to move vertically and release a catch holding first and second preloaded vehicles 1120 and 1122, substantially concurrently. Alternatively, the vehicles may be released sequentially. For example, the release of one vehicle may be delayed relative to release of another vehicle.

Continuing with FIG. 11, relay segment 1102 includes a first and second ramp 1101, 1103 leading in different (e.g., opposite) directions, such that vehicles 1120 and 1122 may be launched by gravity to first and second exiting track sections, respectively. Further, track set 1100 may include two direct acting relays, such as relay 300, and finishing flag sections 1134 and 1136. As shown in FIG. 11, relays 300 may be positioned coupled to exiting track sections 1130 and 1132 and finishing flag sections 1134 and 1136 via various track segments. Further, as noted herein, vehicles may be preloaded into the two relays 300 (e.g., 1140 and 1142), which can be launched via actuation of vehicles 1130 and 1132, respectively. In this way, a sequential/parallel race configuration can be formed.

Referring now to FIGS. 11A-11E an alternative relay segment 1102' is illustrated. Here the a first ramp 1101' and a second ramp 1103' are arranged such that a portion of their paths cross each other in a criss-cross manner before leading off in different directions, such that vehicles 1120 and 1122 located at upward or elevated distal ends with respect to their opposite ends may be launched by gravity to first and second exiting track sections, respectively.

Similar to the previous embodiments an incoming or first track segment 1110 is pivotally mounted to the relay for movement in the direction of arrows 1109 and a trigger 1112 is pivotally mounted to the relay for movement in the direction of arrows 1113. Accordingly, a contact portion of the trigger is located above a portion of the incoming track segment such that an incoming vehicle on the track segment 1110 will contact the trigger and move it from a first position to a second position thereby actuating a release mechanism 1115 located within the relay 1102'.

The relay 1102' has a first stop member 1117 associated with track 1103' and a second stop member 1119 associated with track 1101'. Each stop member 1117, 1119 is configured for movement from a first upright blocking position, wherein the vehicle is retained behind the stop to a second downward unblocking position, wherein the vehicle can travel past or over the stop member due to gravity forces pulling it downward.

In one mode of operation, the release mechanism 1115 is coupled to at least the first stop member 1117 via linkage or any other equivalent means, such that movement of the trigger will cause the stop member to move from the first upright blocking position to the second downward unblocking position, wherein the vehicle can travel past the stop member. Numerous means of releasing/moving the stop member from the blocking position are contemplated for example, the stop member may be held in the upright position via a catch or latch that is actuated by the release mechanism 1115 and movement of the catch or latch from a blocking position to an unblocking position will allow the stop to be moved to the downward position by the weight of the vehicle.

Alternatively, the stop may be spring biased into the downward position and the catch or latch holds the stop in the upright position and movement of the catch or latch causes the stop to move to the unblocking position by the biasing force of the spring. In yet another variation, a combination of a spring biasing force and the weight of the vehicle may move the stop into the unblocking position. In yet another variation, the stop members are spring biased into the upward or blocking position and the weight of the toy vehicle is sufficient to move the stop member from the blocking position to the unblocking position when the catch or latch is released via the release mechanism and after the vehicle travels past the stop member stop member is moved back into the blocking position via the biasing force of the spring.

Still further and in one mode of operation the stop members 1117 and 1119 move from the blocking position to the unblocking position sequentially such that stop member 1117 will move first such that vehicle 1122 travels past stop member 1119 before it moves into the unblocking position such that there is no collision of vehicles 1122 and 1120. Of course and in an alternative embodiment, collision of the vehicles may be desired and operation of the stop members may be configured such that the vehicles collide into each other or alternatively operation of the stop members may vary between sequential operation (i.e., no collision) and non-sequential or simultaneous operation wherein the vehicles collide thus, providing an unknown or random outcome. In one exemplary embodiment, movement of the stop members 1117 and 1119 is configured such that the vehicles being released by the stop members will travel down their respective track paths and a "near miss" (e.g., collision avoided) is observed by the user. In other words, the first vehicle 1122 will just have traveled past the stop member holding back the second vehicle 1120 when it is released or as it starts to travel down its track path.

Sequential operation of the stop members 1117 and 1119 may be achieved in numerous ways for example in one mode of operation mechanism 1115 is configured to release stop member 1117 first and then release stop member 1119. Alternatively, mechanism 1115 is configured to only release stop member 1117 and movement of vehicle 1122 down the track segment will cause the same to contact a trigger or switch 1121 pivotally secured to and located in the track segment that vehicle 1122 travels down such that as vehicle 1122 is released and moves down the track path it will contact trigger 1121 and move it from a first position to a second position. Trigger 1121 is coupled to stop member 1119 such that movement of the same from the first position to the second position by the vehicle traveling down the track path will cause stop member 1119 to move from the blocking position to the unblocking position and thus, vehicle 1120 can now travel down its track segment.

Accordingly and in the aforementioned embodiment, operation of relay 1102' allows for sequential release of two vehicles wherein each vehicle travels down a respective path coupled to track sections 1130 and 1132 and having a portion that crosses over or shares a portion of the other vehicle's path. In this embodiment, the first vehicle 1122 must be released first so that it can actuate trigger 1121 and release the second vehicle 1120. In addition, the trigger 1121 is located such that by the time the vehicle has actuated the trigger 1121 it will be out of the way of the second vehicle when it is released from its corresponding stop member. Still further, the trigger will be located such that the second released vehicle will nearly contact the first vehicle thereby providing the excitement of a near miss each time the vehicles are released. In this configuration, a vehicle or object must be placed behind stop member 1117 in order to activate the trigger 1121 that controls stop member 1119.

In addition, and as in the previous embodiments relay 1102' will also have a manual trigger 1114' that when actuated will cause mechanism 1115 to move the stop member or members and allow for the vehicles to travel down a respective vehicle path. This allows the relay 1102' to be the first in series of relay segments coupled together.

Figure 12:
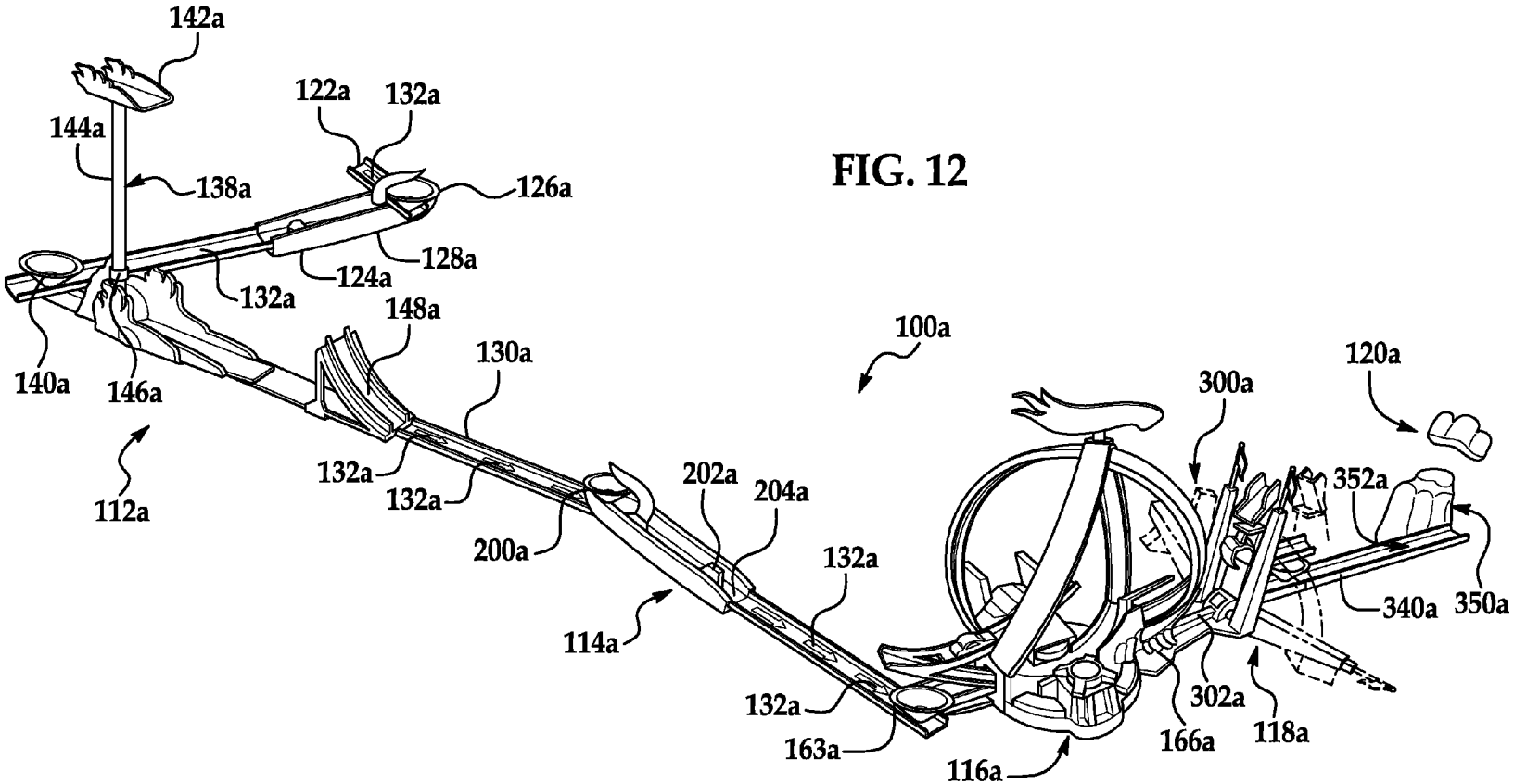
FIG. 12 shows another example toy vehicle track set including a plurality of relay segments.

FIG. 12 further illustrates a relay segment configured as a twin tower stunt element 1200. As an example, in the twin tower stunt element, a single input triggering event may cause simultaneously release of two vehicles moving in opposite directions propelled by gravity. It should be appreciated that a manual trigger may be included in each of the relay segments, including the twin tower stunt element, so that the relay segments may be the first stunt in the series. Moreover, in some large relay segments, there may be two or more manual triggers, such as on the front and back side of the element. For example, in the twin tower stunt element as illustrated there is a front manual activation switch. In some embodiments, there may be a similar activation switch on the back of the stunt element.

FIG. 12 illustrates yet another customizable track set. As with the previous embodiments, the track set may include a plurality of interchangeable relay segments which may be coupled to create a customized expandable track set, wherein the relay segments may include one or more stunt elements and may be selectively positioned at the beginning, middle, or end of the track. In some embodiments, the relay segments may be configured to enable a first toy vehicle to trigger a second toy vehicle to traverse an obstacle or perform a stunt. Further in some embodiments, a relay segment exit vehicle may be released to travel a subsequent relay segment.

It should be appreciated that the track sets described herein may be used for toy vehicles. As an example, the toy vehicles may be 1:64 scale models, however other sized toy vehicles may be also used. One exemplary range would be 1:50 scale of less, again it is, of course, understood that scales greater or less than 1:50 are contemplated to be within the scope of exemplary embodiments of the present invention.

A toy vehicle track set 100*a* having multiple relay segments 110*a*, 112*a*, 114*a*, 116*a*, 118*a* and 120*a* is shown in FIG. 12. As discussed in more detail below, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns. In this way, a user can experience diverse track play and excitement time and time again.

In this example, each relay segment 110*a*, 112*a*, and 114*a* may include an incoming vehicle trigger which may directly or indirectly causes the launching of another outgoing vehicle, also referred to herein as a relay segment exit vehicle. As an example, each relay segment may include an incoming track, such as incoming track 122*a*, for an incoming vehicle, and an exit track, such as exit track 124*a*, for an outgoing vehicle. The exit track of one relay segment may be interchangeably coupled with the incoming track of a second relay segment such that the outgoing vehicle from one relay segment may become the incoming vehicle of a next relay segment.

One or more launchers may be provided to accelerate toy vehicles along the track. As such, the launchers may be configured to engage and urge a toy vehicle to travel along the track. It should be appreciated that although launchers are described herein, vehicles may be manually propelled along the track without the use of a launcher without departing from the scope of the disclosure.

Although any suitable launcher may be used, in the illustrated embodiments, various automatically and manually-triggered release launcher elements are illustrated. A vehicle may be positioned in launch position such that a launch element may slidingly engage the vehicle to propel the vehicle along the track. The launch element may be biased to a launch position, such as by springs or any other suitable biasing mechanism such that release of an activator releases its stored potential energy.

In one example, the relay segments may include incoming vehicle triggers. The triggers may be configured to enable an incoming vehicle to actuate a stunt and release of an outgoing vehicle from the relay segment. The triggers may be positioned such that a vehicle traveling along the track actuates the trigger.

As one example, the vehicle triggers may be conical-shaped triggers (shown in FIG. 12 at 126*a*) or other shaped triggers. As an example, conical-shaped trigger 126*a* may have a cone angle of approximately 45 degrees, which may be actuated vertically via contact with a horizontally moving incoming vehicle. It should be appreciated that the cone angle may be of any suitable angle such that an incoming vehicle actuates the trigger. Thus, as a non-limiting example the cone angle may be anywhere from 5-90 degrees.

Further, while this example shows a conical trigger, alternatively, it may be planar shaped and angled (e.g., approximately 45 degrees) relative to an incoming track. As a further example, an example trigger may have a flat, angled plane formed by a plurality of ridges) that is configured to be contacted by a vehicle on a track. Again, although in one example the trigger may have an angle of approximately 45 degrees, any suitable angle may be applied (e.g. 5-90 degrees) such that a vehicle actuates the trigger. Further, the trigger may be engaged under or along the side of the track, such that the vehicle actuates the trigger by traveling over or through a portion of the track.

In some relay segments, actuation of a trigger by a first vehicle initiates a stunt and release of a second outgoing vehicle on the track set. In some embodiments, manual triggers may also be included, alone or in combination, with the vehicle triggers. Manual triggers may be configured to be actuated such that a stunt is initiated and/or an outgoing vehicle is released from the relay segment. The outgoing vehicle may travel to a second relay segment.

It should be appreciated that the track play of each relay segment may be activated directly or indirectly by actuation of a trigger. As an example of indirect activation, the relay segment may include a stunt element performed by either a first or second vehicle. Further, the stunt element may be performed by a third vehicle. Further still, the stunt element may include multiple simultaneous, parallel, and/or sequential stunts performed by a plurality of vehicles, where the stunts may be performed simultaneously, in sequence with one triggering the next, in parallel, or combinations thereof. In still another embodiment, the launching element and/or the trigger may also include stunt elements performed by one of the first and second, or other vehicles. Although described in regards to actuation of the stunt elements via vehicle triggering, alternatively, track play may commence via manual activation of any of the relay segments or stunt elements.

As an example and referring again to FIG. 12, in the configuration illustrated, track play may be commenced with stunt element or relay segment 110*a*. For example, actuation of manual release or manual trigger 102*a* may propel or launch a toy vehicle (not shown) along exit track 124*a* toward a second relay segment 112*a*. In one example embodiment, a relay segment may enable a variable change of vehicle traveling direction (between an incoming and outgoing vehicle), thus further providing variable configurations for more diverse track play.

It is noted that track connector sections, as shown for example at 130*a*, may be interposed between relay elements extending the distance between a first and second relay element. Thus, in addition to selective positioning of each relay segment, track connector sections may be selectively positioned to enable customization of the track since each of the incoming track sections they are releasably secured thereto are rotatably mounted to the relay segment.

One or more portions of the track set, such as the incoming track and exit track of the relay segments and/or the track connector segment may include direction indicators, shown at 132, such as molded-in arrows, or cut-outs which may indicate vehicle direction and/or assembly instructions for a toy track set. For example, the direction indicators may aid in the ease of assembly for an expandable track set, may provide specific direction of vehicle travel used to initiate stunts, or enable passage past obstacles. Although the direction indicators are shown as a row of cut-out arrows, it should be appreciated that the direction indicators may be of any size and/or shape to indicate assembly direction and/or vehicle travel direction. Further, although a plurality of arrows is illustrated, a single arrow or other cut-out may also be used without departing from the scope of the disclosure. Further, in some embodiments, the direction indicators may be positioned in a center of the track so that the wheels of the vehicles are not impeded. It further should be appreciated that although shown as cut-outs, the direction indicators may be surface indicators, raised moldings, etc. In an exemplary embodiment, the arrows are integrally molded with the track and/or relay segment.

For example, a vehicle released from relay segment 110*a* and traveling along track 130*a* in the direction of the direction indicators may contact or engage a second relay segment, e.g. relay segment 112*a*. As described in more detail below, each relay segment may actuate a stunt. Stunts may include one or more, as well as any combination of, loops, jumps, collisions, simulated explosions, vehicle crashes, vehicle drops, vehicle lifts, vehicle obstacles, vehicle spins and other vehicle obstacles. In some embodiments, stunt vehicles may be preloaded for release upon actuation of the relay segment trigger (e.g. actuation by an incoming vehicle of the vehicle trigger or manual actuation of a trigger).

For example, relay segment 110*a* may be a stunt element, such as a falling and pivoting ramp element 138*a*. Upon contact or actuation of trigger 140*a*, a falling and pivoting ramp stunt event may be initiated. A stunt vehicle (not shown) may be pre-positioned on platform 142*a*. In the falling and pivoting ramp stunt event, platform 142*a* may be rotatably coupled to arm 144*a* which may be pivotally coupled through pivot 146*a* to the relay segment. Upon actuation by an incoming vehicle, the arm 144*a* may swing from a first generally vertically-extended position (shown) to a second generally horizontally-extended position. Further, platform 142*a* may rotate such that the platform rotates to generally correspond to enable release of the stunt car down exit track 148*a*. As such, the pre-positioned vehicle may be released down exit track 148*a* toward the next relay segment, such as relay segment 114*a*.

Addition details illustrating an example falling and pivoting ramp element 112*a* are shown in FIG. 2. As shown, an incoming track 150*a* may enable an incoming vehicle to contact or actuate trigger 140*a*. Although shown as a conically-shaped trigger, it should be appreciated that the trigger may be any suitable, manual and/or vehicle, actuated switch. The incoming vehicle may be stopped at trigger 140*a*.

Actuation of trigger 140*a* may release arm 144*a* from a first position. The first position, as illustrated, is a substantially vertical position, where platform 142*a* is in a substantially parallel plane to the ground surface. Upon release of arm 144*a* from the first position, arm 144*a* pivots or swings about pivot point or hinge 146*a* such that the arm falls as indicated by arrow 152*a*. Further, in some embodiments, platform 142*a* may be rotatably coupled to arm 144*a* such that it may rotate as indicated at arrow 154*a*.

Figure 13:
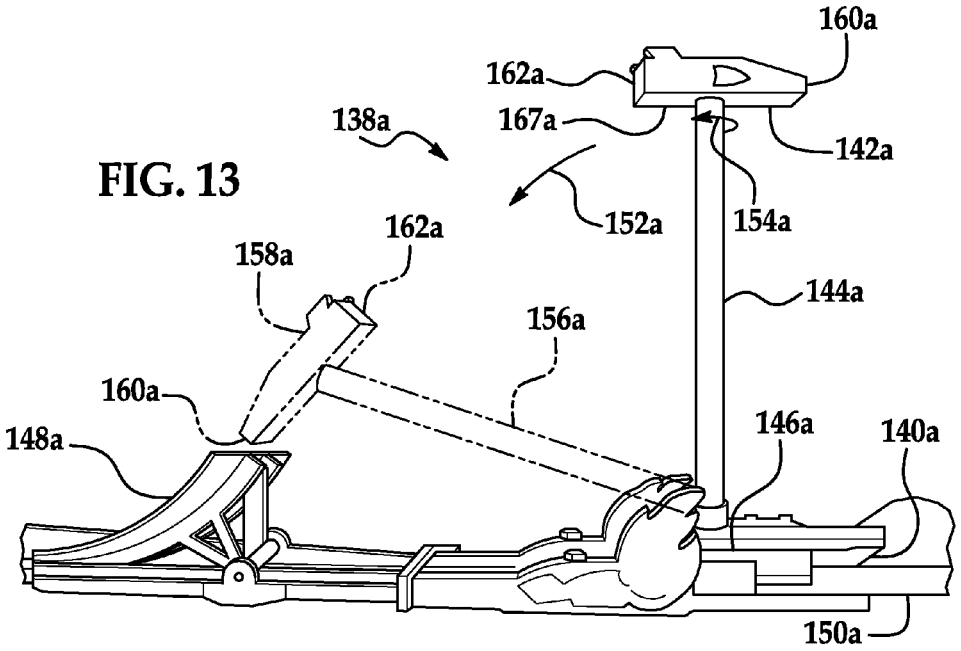
FIGS. 13-17 illustrate still other relay segments in accordance with exemplary embodiments of the present invention.

Release of arm 144*a* and rotation of platform 142*a*, results in the arm and platform moving to a vehicle release position indicated in dashed lines in FIG. 13. As shown at 156*a*, the arm may be substantially parallel to the ground surface such that platform 142*a* is substantially aligned with exit track 148*a*. Further, at 158*a*, the platform has rotated such that a front portion 160*a*, with an opening for vehicle release, is aligned with the exit platform 148*a*.

In one embodiment, the platform 142*a* includes a front portion 160*a* and a rear portion 162*a*. Rear portion may include a stop wall 164*a* to prevent a preloaded vehicle from prematurely releasing from the platform. Additional vehicle engagement features, such as detents may further retain the preloaded vehicle in the platform during the stunt. As discussed above, upon rotation of the platform, front portion 160*a* aligns with exit track 148*a*. The angle of the platform in the release position enables the vehicle to break away from the engagement features and travel down exit track 148*a* toward a subsequent relay segment.

In some embodiments, lock features may be provided to lock the arm in the first and second positions. Release structures may be further provided to enable a user to release the arm from the first and second positions. Further, although not shown in detail in regards to the falling and pivoting ramp element, the relay segments may be configured to fold into compact configurations to reduce packaging size and for ease of storage. Additional examples regarding relay segment folding are disclosed in more detail below.

Referring back to FIG. 12, following activation of relay segment 112*a*, and release of a preloaded vehicle from platform 142*a* onto exit track 148*a*, the preloaded vehicle is now an incoming vehicle for the next relay segment, such as relay segment 114*a*. Thus, although described in this example where activation of relay segment 112*a* results in subsequent release of a vehicle to activate relay segment 114*a*, other configurations are possible and contemplated. Thus, it should be appreciated that each relay segment may be selectively positioned in the track chain. As an example, relay segment 110*a* may be at the beginning, middle or end of the track. Similarly, relay segments 112*a*, 114*a*, 116*a*, 118*a*, 120*a* may be positioned at the beginning, middle or end of the track. A user may be able to customize the track by positioning the relay segments in a desired order or combination.

Relay segment 114*a* is an example of a direct acting relay segment. An incoming vehicle may actuate a trigger 200*a* which may effect release of a preloaded vehicle from launcher 202*a*. The preloaded vehicle may exit relay segment 114*a* toward relay segment 116*a* along exit track 204*a*.

Direct acting relay segment 114*a* is similar to the relay segment illustrated in FIG. 3 wherein a launching stunt element 300, including an incoming track 310 pivotally mounted thereto proximate to conical trigger 312, which can also be actuated via the manual button 314. In this example, the trigger is pivotally mounted to the launching stunt element via pins 311 for movement between a first position and a second position in the direction illustrated by arrows 313, wherein movement of trigger from the first position (illustrated) to the second position (not-illustrated) when a vehicle moves into an area 315 between conical trigger 312 and incoming track segment 310.

Movement of the conical trigger 312 again causes release of stored potential energy to move a launching member in a manner similar to that described with respect to FIGS. 3-3*c*, wherein contact by an incoming vehicle on track 310 causes the trigger to move vertically, release a catch that then releases spring loaded launcher protrusion 320 in launcher 322. For example, a vehicle may be pre-loaded in launcher 322 until activation. Then, the vehicle may then exit the relay segment through exiting track section 330.

It should be noted that exiting track sections of each of the relay segments, such as exiting track section 330, may be coupled to further track sections that may lead to additional relays segments. The relay segments may be interchanged such that the track is customized. Also, incoming track sections of the relay segments, such as incoming track section 310, may be adjustable (e.g., rotatable) relative to exiting track section 330 to enable an incoming vehicle to enter the relay segment from a plurality of angles and/or an exiting vehicle to exit the relay segment at a plurality of angles.

Referring back to FIG. 12, an outgoing vehicle from relay segment 114*a* is an incoming vehicle for relay segment 116*a*. Incoming vehicle travels along incoming track 163*a* to actuate trigger 164*a* of relay segment 116*a*. Relay segment 116*a* may be a stunt element, such as an exchanger stunt element or exchanger. The incoming vehicle initiates the stunt, following which a pre-loaded stunt vehicle performs the stunt and exits stunt at 166*a* toward the subsequent stunt 118*a*.

Figure 14:
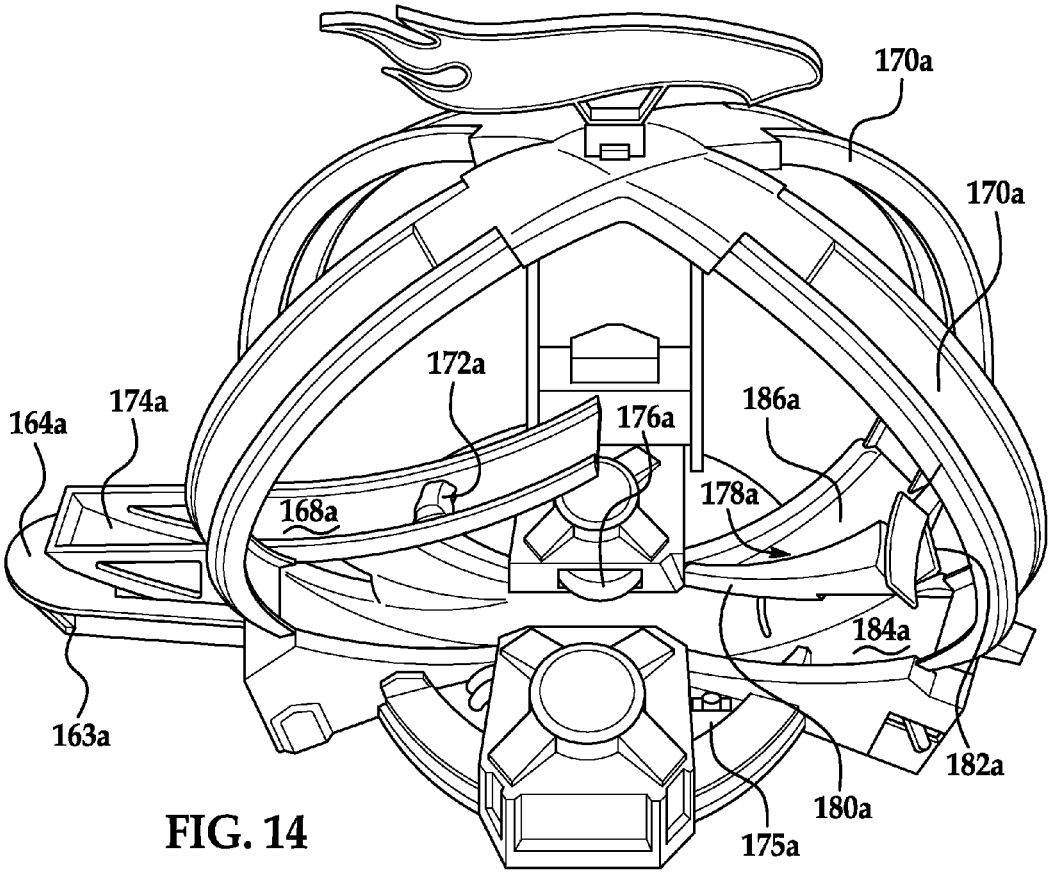

Specifically and as illustrated in FIG. 14 stunt element 161 is configured to provide a multiple loop stunt for a preloaded vehicle. As shown, incoming track 163*a* is pivotally mounted to the stunt element proximate to a conical trigger 164*a*. It should be appreciated that although shown as a conical trigger, the trigger may be any suitable shape such that a vehicle traveling on track 163*a* can activate the stunt. Further, in some embodiments, a manual trigger may also be provided. In this example, the trigger is spring loaded in a downward position, such that contact by an incoming vehicle on track 163*a* causes the trigger 164*a* to move vertically and release a catch that then releases a preloaded vehicle down ramp 168*a* into the exchanger loops 170*a*.

As illustrated, a preloaded vehicle may be positioned at the top of ramp 168*a* and held in launch position by stop 172*a*. Upon actuation of trigger 163*a*, stop 172*a* is released and the preloaded stunt vehicle launches down the ramp to direction changer 174*a* and then through booster 176*a*. Booster 176*a* may be any device to impart addition acceleration onto the toy vehicle. For example, booster 176*a* may be motorized wheels which further launch the vehicle into loops 170*a*. A switch 175*a* may be used to turn on the booster motor.

A directional key 178*a* directs the vehicle into alternative loops. For example, in the illustration, the direction key 178*a* has a path-defining section 180*a* which provides a rail edge defining the vehicle pathway and a contact switch 182*a* which upon contact with the vehicle as it travels along the defined pathway is flipped such that the key first defines a first pathway 184*a*, and upon contact with the vehicle defines a second pathway 186*a*. Each time the vehicle goes around the loop, the direction key is switched such that the vehicle alternatively travels the first pathway and then the second pathway.

In some embodiments, a timer may be used to time the vehicle's travel in loops 170*a*. For example, the vehicle may continue to travel in the loops for a predetermined period, such as a period of 5 seconds or any other preset time period. Following the predetermined period, the vehicle may be ejected from the loops. In other embodiments, the vehicle may perform a predetermined number of loops prior to ejection from the loops.

Ejection of the vehicle from loops 170*a* may occur after a predetermined event, a predetermined time, or in some embodiments, upon a user's activation. The vehicle may be ejected from exchanger stunt element 161*a*. For example, in some embodiments, completion of the predetermined event or time may actuate the directional indicator platform such that it raises up defining a vehicle ejection path.

Figure 15:
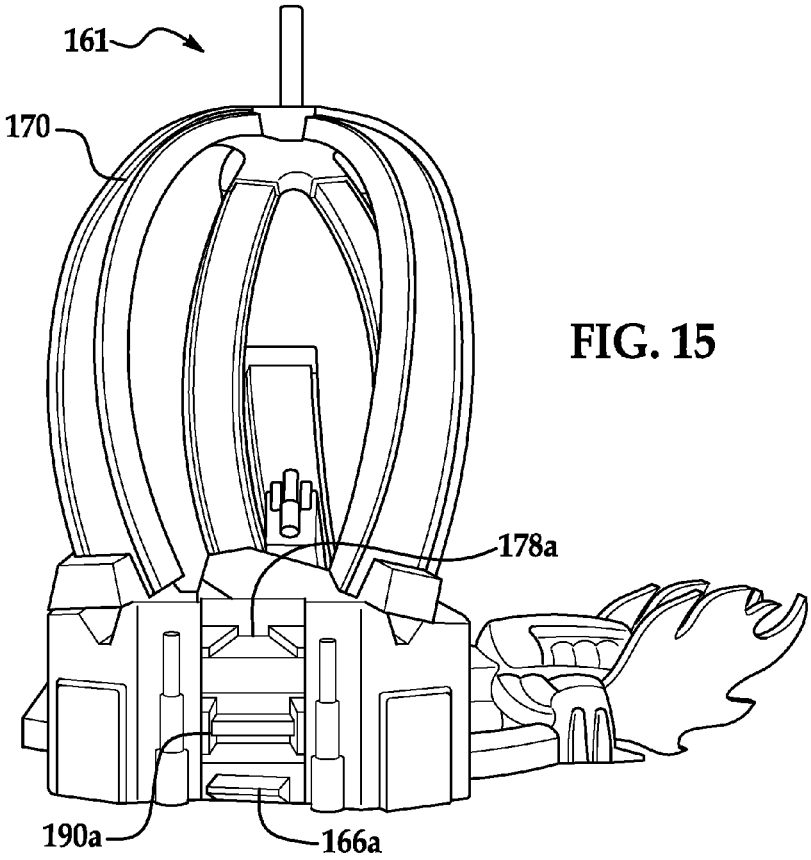

As shown in FIG. 15, a cavity 190*a* is provided under the directional indicator 178*a*. In some embodiments, following completion of the loop portion of the stunt, the directional indicator may move to allow the vehicle to follow a vehicle ejection path to exit track 166*a*. In other embodiments, completion of the loop portion of the stunt may trigger a preloaded stunt vehicle positioned in cavity 190*a* to be launched out along exit track 166*a*.

In such embodiments, the vehicle traveling the loops may be ejected from the loops such that the vehicle falls from the exchanger stunt element. For example, the directional indicator may block the traveling path and causes the vehicle to impinge against the tip of the directional indicator and be forced from the track. In some embodiments, additional switches or changes in the boosters may be provided to break the vehicle's travel path resulting in the vehicle being discharged from the loops.

Returning back to FIG. 12, the outgoing vehicle released from relay segment 116*a* along exit track 166*a* may travel to relay segment 118*a*. This outgoing vehicle of relay segment 116*a* is incoming vehicle for relay segment 118*a*. Relay segment 118*a* may be a stunt element, such as a tower stunt element. The incoming vehicle initiates the stunt, following which a pre-loaded stunt vehicle exits stunt element at 340*a* toward a subsequent relay segment.

Figure 16:
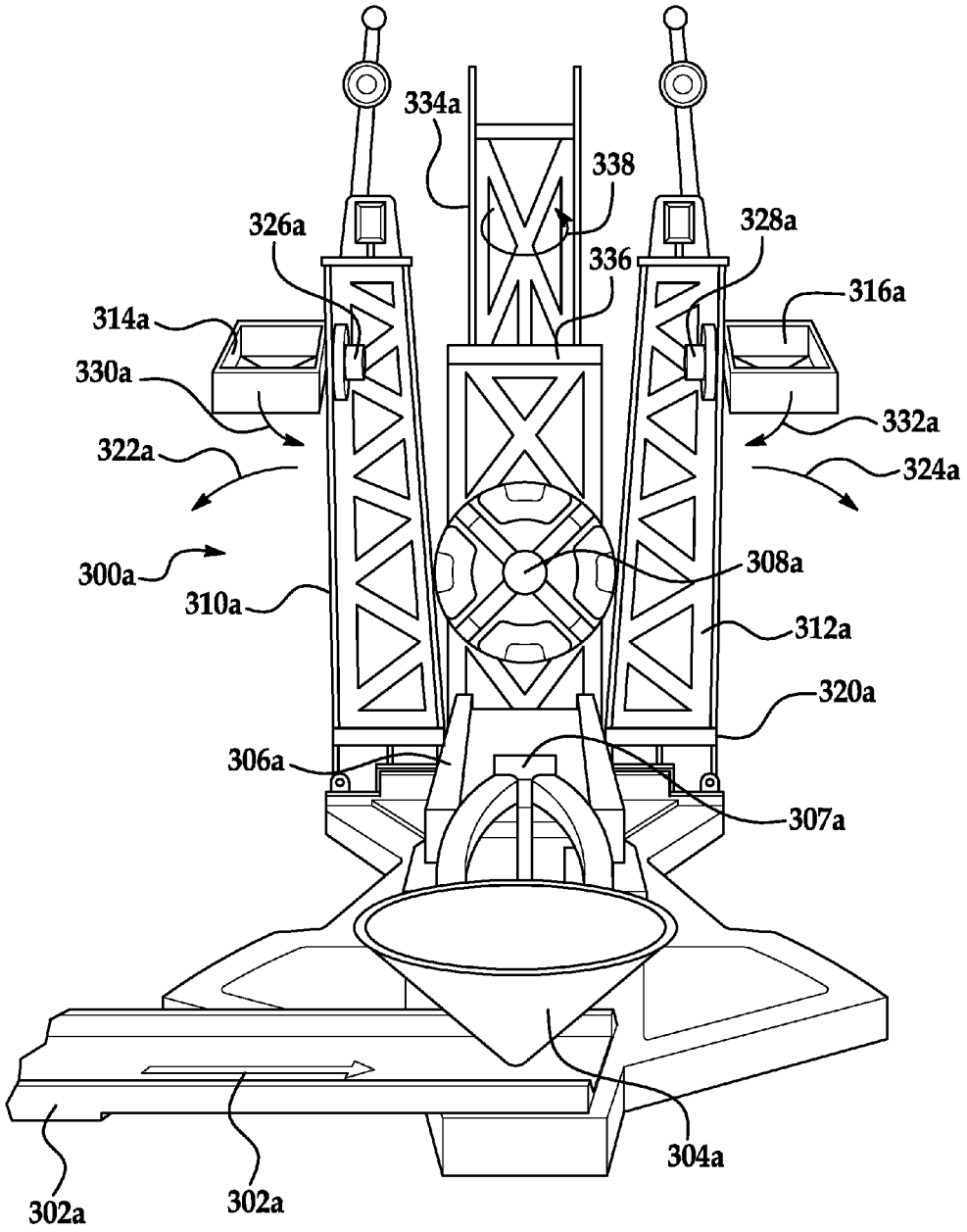

FIG. 16 illustrates an example tower stunt element 300*a* in more detail. As illustrated, tower stunt element 300*a* is configured to provide a multiple vehicle stunt. As shown, incoming track 302*a* is coupled to a conical trigger 304*a*, which can also be actuated via one or more manual buttons or actuators. Actuation of trigger 304*a* results in initiation of a tower stunt, including release of a plurality of preloaded vehicles from the tower. For example, the trigger may be spring loaded in a downward position, such that contact by an incoming vehicle on track 302*a* causes the trigger to move vertically and release a catch that then initiates a first part of the multiple stage vehicle stunt.

As an example, a first stunt vehicle may preloaded into launch cavity 306*a*, wherein cavity 306*a* includes a launching structure such as a spring-loaded launch slider 307*a* which upon activation, such as through trigger 304*a*, slides forward. Motion is imparted to the preloaded stunt vehicle such that the stunt vehicle launches towards a target, such as bulls eye 308*a*. Although shown as a bulls eye, any design configuration is possible for the target.

Additionally, additional stunt vehicles may be preloaded into the release boxes 314*a* and 316*a* on side towers 310*a* and 312*a* respectively. Impact on the target, such as bulls eye 308*a*, may actuate a second stunt stage. In the second stunt stage, side towers 310*a*, 312*a* may be released such that the towers 310*a*, 312*a* fall outwards about hinges 318*a* and 320*a* as indicated by arrow 322*a* and 324*a* respectively. The release boxes are rotatively coupled to the towers such that upon actuation of the second stunt stage the release boxes rotate from a storage position to a release position. The storage position may be any suitable position where a vehicle does not fall from the release boxes. Thus, in some embodiments, the storage position may be such that the release boxes are parallel to the ground surface. In other embodiments, the release boxes may be angled such that the vehicles are retained in the storage boxes.

Actuation of the second stunt stage effect the release boxes 314*a*, 316*a* to rotate about pivot points 326*a*, 328*a* as indicated by arrows 330*a*, 332*a*. In the release position, the release boxes are angled such that the preloaded stunt vehicles fall from the boxes. Further, towers 310*a* and 312*a* fall outward such that preloaded vehicles and the towers crash into the ground surface.

A third stunt stage may be activated upon completion of the second stunt stage. For example, rotation of the towers from the base may actuate a switch to initiate a third stunt stage. In the third stunt stage, a release box 334*a* may be preloaded with another stunt vehicle. The release box may be in a first position facing the incoming track 302*a* and trigger 304*a*. The release box may be rotatively coupled to the top of the tower for rotation about pivot point 336*a*. Upon actuation of the third stunt stage, the release box may rotate from the first position to a release position where the preloaded vehicle is released down exit track 340*a*. As such, in the release position, the release box rotates 180 degrees such that it faces exit track 340*a*. It is noted that a structural detent mechanism may be used to hold the vehicle in the first position. This detent mechanism may include structure such as the top surface of the tower which when in the first position prevents the vehicle from releasing. In other embodiments, a moveable gate or structure may be provided which prevents movement of the vehicle when in the first position but allows the preloaded vehicle to release when in the release position.

As such the tower stunt element may be considered a multi-stage stunt element. In this multi-stage stunt element, completion of each stage actuates a further stage. Specifically, in the illustrated embodiment, actuation of the multi-stage stunt element results in actuation of a first stage where a first preloaded vehicle impacts a target; completion of the target impact actuates a second stage where two preloaded vehicles are released and two towers fall outward toward a ground surface; completion of the tower fall actuates a third stage where a fourth preloaded vehicles is launched down exit track 340*a*. This vehicle is the outgoing vehicle of the tower stunt element and becomes the incoming vehicle for the subsequent stunt.

Again referring back to FIG. 12, the vehicle released from relay segment 118*a* traveling along exit track 340*a* may further engage a relay segment element 120*a*. In one embodiment, relay segment element 120*a* is a single vehicle stunt element where the incoming vehicle is the outgoing vehicle. As an example, relay segment element 120*a* may be an explosion stunt element 350*a*. As such, the vehicle may actuate a trigger, such as an overhead vehicle trigger 352*a* while being retained on the track. The trigger may initiate a simulated explosion such as explosion of the top of the silo as shown in FIG. 12. Following actuation of the trigger 352*a*, the vehicle may continue along and exit relay segment 118*a*. Additional stunt elements may be added to the end of the track or the track may be terminated.

Figure 17:
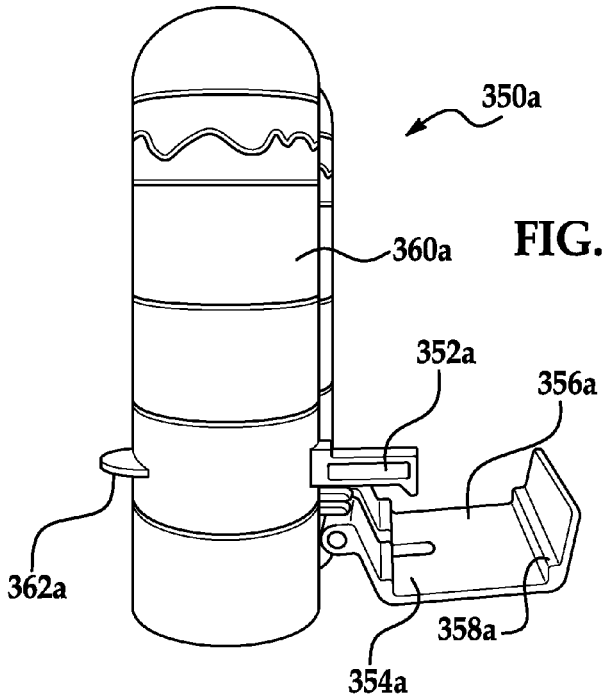

An example explosion stunt element 350*a* is shown in more detail in FIG. 17. It is noted that the explosion stunt element is an overlap element, in contrast to a linking element. Linking elements interconnect by linking one track segment into another track segment. The track segments removably lock together to form a continuous track. Typically, the linking elements including sliding male/female connectors. In contrast, as an overlap element, element 350*a* includes a track bed 354*a* which is configured to be positioned such that the track travels through the track bed. As an example and as shown in FIG. 17, the track bed may include a track receiver 356*a* such that a section of the track, such as a track connector section, may be slid into the receiver 356*a* and retained by retainer 358*a*.

A vehicle traveling along the track may actuate trigger or lever 352*a* to effect a stunt. Although shown as an overhead trigger, the trigger may be in any suitable position which does not substantially impede the travel of the vehicle. In other embodiments, the trigger, and/or additional structure following actuation of the trigger, may stop the travel of the vehicle. In the illustrated embodiment, activation of the lever (via contact with a traveling toy vehicle on the track) may cause the top of the silo 360*a* to launch upward to simulate an explosion. Although in the illustrated embodiment the silo explodes in a single piece, in alternative embodiments, multiple portions of the explosion element may separate. Stunt element further comprises a manual trigger element 362*a*, manual element 362*a* is coupled to 352*a* such that movement of manual element 362*a* causes a catch to release a spring to launch a top portion 361*a* away from the stunt element 350 to simulate an explosion.

While FIG. 12 shows various example relay segments with multiple stage stunts, as well as without stunts, numerous variations in relay elements are possible. Further, although shown in regards to a single track, it should be understood that virtually any number of different track designs may be used without departing from the scope of this disclosure. For example, parallel track configurations may be used, as well as combination sequential/parallel track configurations may be used. Further, various stunts may be performed, rather than the drops and/or loops shown, such as jumping over voids, traversing obstacles, etc.

Figure 18:
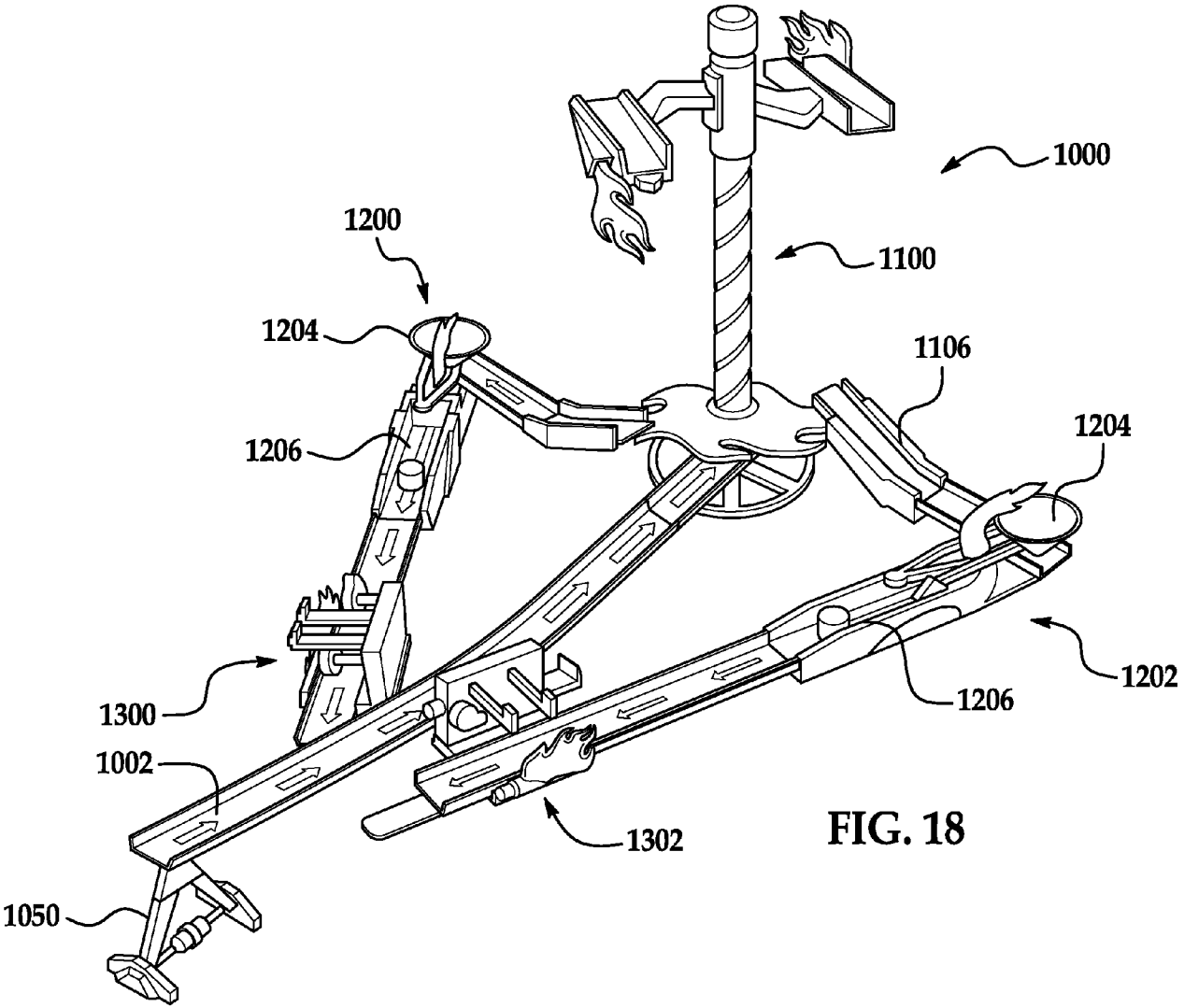
FIG. 18 shows still another example toy vehicle track set including a plurality of relay segments.

FIG. 18 provides another example track set 1000*a*. Track set 1000*a* includes a plurality of relay segments, 1100*a*, 1200*a* and 1300*a*. Further, example track set 1000*a* illustrates track accessory 1050*a*. As discussed regards to FIG. 12, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns. Similarly, track accessories may be selectively positioned anywhere along the track.

As an example track accessory, flip accessory 1050*a* enables the user to selectively raise the track 1002*a* to improve vehicle travel along the track. Such an accessory enables adjustment of the track such that the speed of the vehicle may be increased. Other accessories may be used to increase or decrease speed, adjust the angle or the track, or otherwise alter the vehicle pathway. As such, the flip accessory may be coupled to one or more track segments that may be mounted to a higher altitude position, such that gravity may "launch" the incoming vehicle.

Track 1002 may be attached to a pivot plate 1064. In some embodiments, track 1002, such as a track connection section, may be snapped onto pivot plate 1064. In other embodiments, the track may be slid onto pivot plate 1064 or otherwise coupled to plate 1064. Further, although described as a pivot plate in this example, it should be appreciated that the pivot plate may be any suitable structure to enable support and coupling of the track. Use of the flip accessory may enable the track to be positioned such that a steep angle is created for vehicle travel. Vehicles released from the top of the track will increase speed such that the vehicles have sufficient speed to actuate the various triggers of the relay segments. Further, increased vehicle speed enhances play value of the track set.

A vehicle released on track 1002*a* may travel to relay segment 1100*a*. Relay segment 1100*a* may be a stunt element, such as a spiral crash stunt element. Incoming track 1102*a* may enable the incoming vehicle to actuate a trigger initiating a spiral crash stunt event. Completion of the stunt may result in two vehicles being released from two exit tracks 1104*a*, 1106*a*. Two vehicles are now traveling on the track set. Alternative pathways may be defined for such vehicles or parallel pathways. As described in more detail below, in the illustrated embodiment, the example track set has been configured such that a first vehicle travels to relay segment 1200*a* and 1300*a* and the second vehicle travels to relay segment 1202*a* and 1302*a*.

Figure 19:
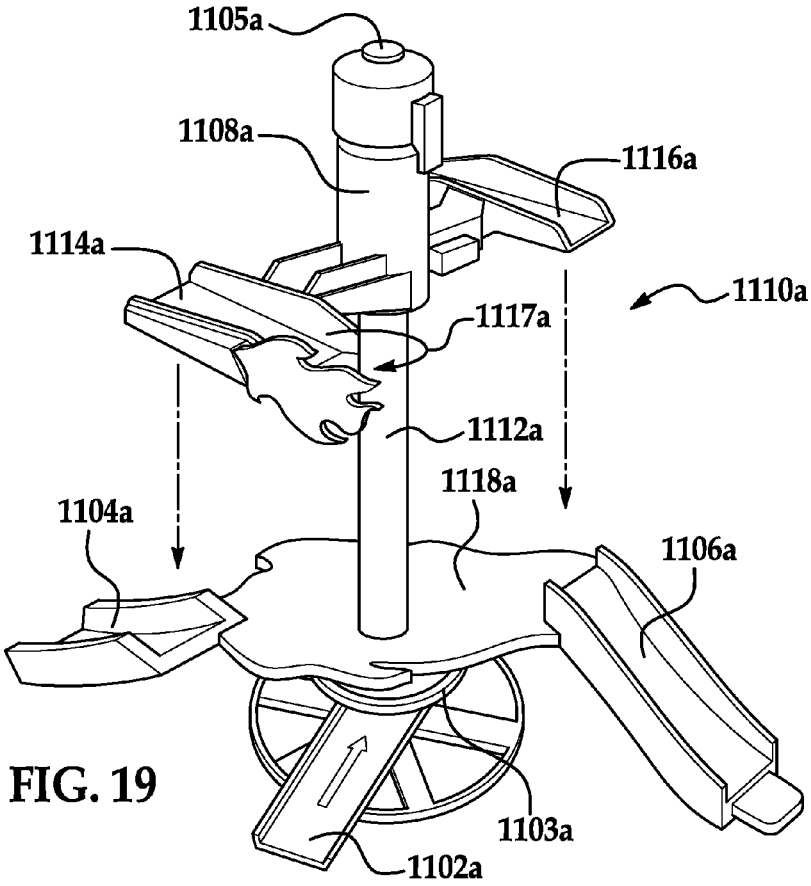
FIGS. 19 and 20 illustrate still other relay segments in accordance with exemplary embodiments of the present invention.

FIG. 19 illustrates an example spiral crash stunt element 1110*a*. As illustrated, spiral crash stunt element is configured to provide a spiral crash drop for two preloaded vehicles. As shown, incoming track 1102*a* is coupled to a vehicle trigger, such as a conical trigger 1103*a*. It should be appreciated that other trigger configurations are possible, including other vehicle trigger configurations, as well as manual trigger configurations, such as a manual trigger 1105*a*. In this example, the vehicle trigger 1103*a* may be spring loaded in a downward position, such that contact by an incoming vehicle on track 1102*a* causes the trigger to move vertically and through a rod linkage release traveler 1108*a* from a start position such that the traveler spirals down rod 1112*a* releasing preloaded vehicles onto exit tracks 1104*a* and 1106*a*.

Two preloaded vehicles may be positioned on carriers 1114*a* and 1116*a*. The carriers extend outward and are part of traveler 1108*a*. Upon actuation of trigger 1103*a*, traveler 1108*a* may be released from the start position such that the traveler rotates downwards as indicated by arrow 1117*a* about rod 1112*a*. Gravity pulls the traveler downwards with the rod including spiral coil structures which force the traveler to spin as it heads down the rod. A stop plate 1118*a* stops the traveler in a release position where both carrier 1114*a* and 1116*a* are aligned with exit tracks 1104*a* and 1106*a*, respectively. Preloaded vehicle may be released onto the exit tracks as outgoing vehicles from spiral crash stunt element 1110*a*.

It should be noted that each of the relay segments may be configured to fold to enable storage and/or reduce packing size. As such, many of the pieces of each relay segment are articulated to enable the pieces to fold and the structure to collapse inward. Further, in some embodiments, the relay segments are configured such that at least a top and bottom surface are substantially planar. The substantial planarity enables the relay segment to be more easily packaged or stacked for storage. The folding enables easy storage without the difficulties and frustrations that arise when such structures need to be disassembled for storage or packing.

As discussed above, spiral crash stunt element 1110*a* is configured as relay segment 1100*a* in FIG. 18. After actuation of relay segment 1100*a*, two preloaded vehicles are released on exit tracks 1104*a* and 1106*a* respectively. Additional relay segments may be interposed to improve game play. For example, in the illustrated embodiment, a direct acting relay segment, such as a launch stunt element as shown and discussed in regards to FIG. 3 is shown in the example track set. However, it should be appreciated that any other stunt element may be selectively connected to one or both of exit tracks 1104*a* and 1106*a*.

Referring back now to FIG. 18, outgoing vehicles from relay segments 1200*a*, 1202*a* may be incoming vehicles for relay segments 1300*a*, 1302*a* respectively. As an example, relay segments 1300*a*, 1302*a* may be any stunt element. As illustrated, both relay segment 1300*a*, 1302*a* are flip stunt elements.

Figure 20:
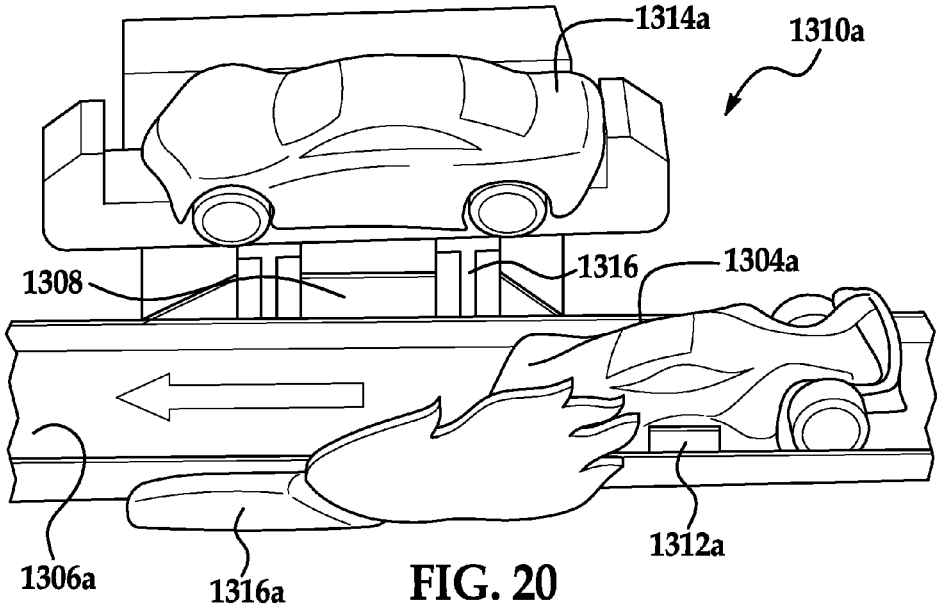

FIG. 20 illustrates an exemplary flip stunt element 1310*a*. As illustrated, flip stunt element 1310*a* is configured to flip a preloaded stunt vehicle. As shown, incoming track 1304*a* enables a vehicle 1312*a* to contact a trigger 1308*a* and then exit on exit track 1306*a*. Flip stunt element 1310*a* may be a stunt element where the incoming vehicle is the outgoing vehicle. As such, the vehicle may actuate a trigger, such as an overhead vehicle trigger 1308*a*, while being retained on the track. The trigger may actuate the flipping of a preloaded vehicle 1314*a* from a carriage 1316*a*. Following actuation of the trigger 1308*a*, the vehicle may continue along and exit relay segment 1310*a* along exit track 1306*a*.

Similar to the explosion stunt element described above, flip stunt element is an overlap element. As such, flip stunt element 1310*a* includes a track bed 1316*a* which is configured to receive a section of the track, such as a track connector section. The track may be slid into the track bed.

Carriage 1316*a* is configured to hold the preloaded vehicle prior to actuation of the flip stunt element. The vehicle may be supported by extensions and is configured to rotatively connected to the carriage such that activation of trigger 1308*a* causes rotation of the carriage such that the toy vehicle held therein is flipped or thrown from the track area.

Figure 21:
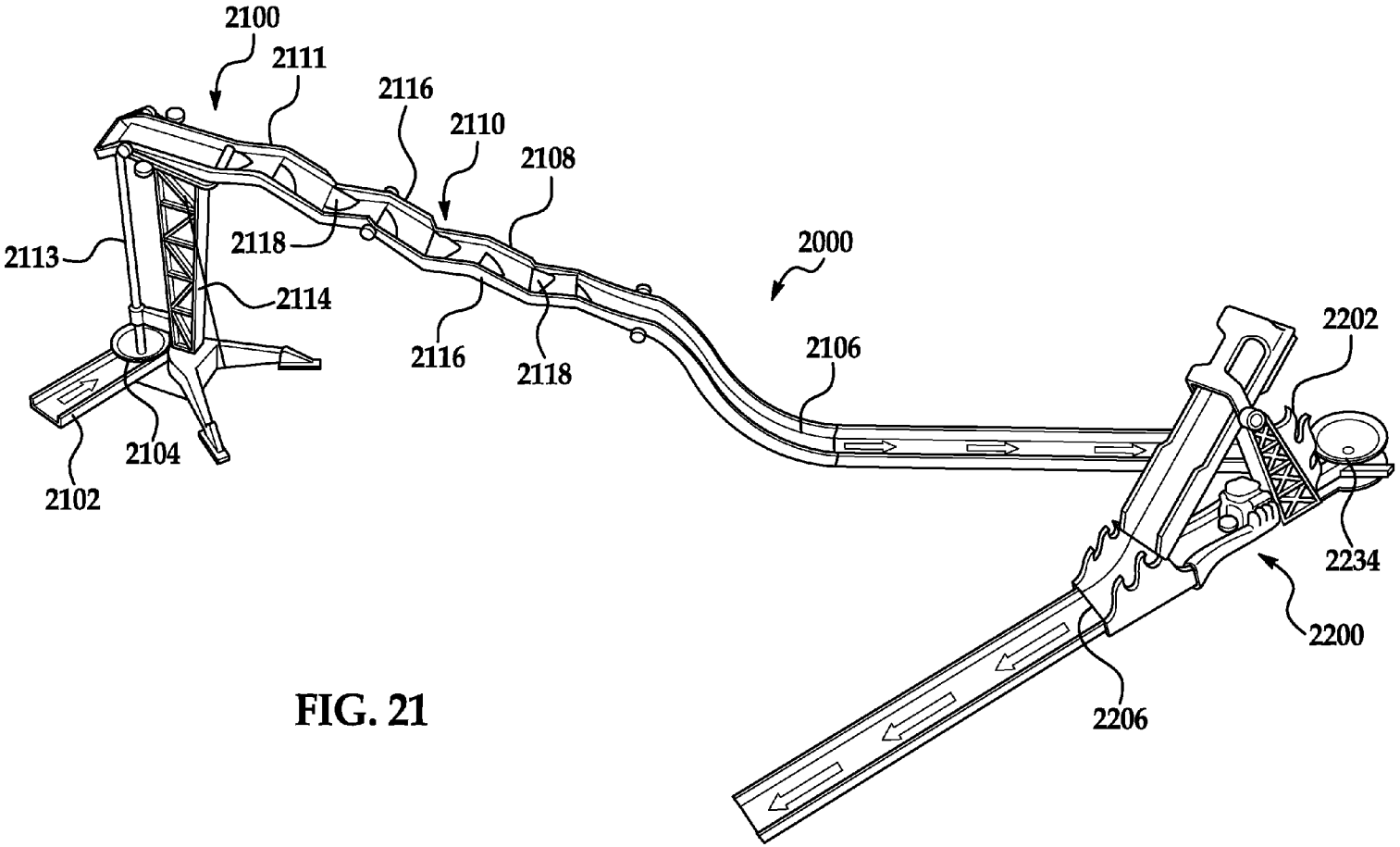
FIG. 21 illustrated still another toy vehicle track set in accordance with another exemplary embodiment of the present invention.

Referring now to FIG. 21 another exemplary track set 2000 is illustrated. Track set 2000 includes relay segments 2100 and 2200. As discussed with regard to FIGS. 12 and 18, each relay segment may be selectively positioned in the beginning, middle or end of the track. A user may customize the track by positioning the relay sections in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns.

In the illustrated track set 2000 an incoming vehicle travels along incoming track 2102 to actuate trigger 2104 of relay segment 2100. Relay segment 2100 may be a stunt element, such as a gravity-actuated zig-zag ramp stunt element. Thus, the incoming vehicle initiates the stunt, following which the pre-loaded stunt vehicle exits stunt 2100 at 2106 toward the subsequent stunt 2200.

Specifically, FIG. 21 illustrates an example gravity-actuated zig-zag ramp stunt element 2110. As illustrated, zig-zag ramp stunt element 2110 is configured to provide a zig-zag track path 2108 for a preloaded stunt vehicle. As shown, incoming track 2102 is coupled to a conical trigger 2104. It should be appreciated that other trigger configurations are possible, including other vehicle trigger configurations, as well as manual trigger configurations. In this example, the trigger may be spring loaded in a downward position, such that contact by an incoming vehicle on track 2102 causes the trigger to move vertically and release a vehicle stop 2111 (such as through rod linkage 2113) such that a preloaded stunt vehicle stored at 2112 is released down zig-zag track path 2108.

The zig-zag ramp stunt element 2110 includes a support brace 2114 which maintains the start of the zig-zag track path in a relatively high vertical position. Gravity enables the car to move down the path. Although not required, in some embodiments, a spring-loaded launcher may be provided to further accelerate the vehicle along the zig-zag track path.

In some embodiments, various structures or designs may be used to indicate to a user the position for placing a preloaded vehicle. For example, different textures, paint or designs may be used to indicate that a vehicle should be loaded for activation in the stunt element.

In some embodiments, the zig-zag track may include angled sections which slow a vehicle down as it travels down the path. Rails 2116 may prevent the vehicle from careening off of the track. Further, cut-outs 2118 may be provided in the track to further disrupt the vehicles motion adding excitement to the stunt element. In some embodiments, the cut-outs and track shaped may provide enhanced excited my slowing the vehicle down such that additional anticipation is created.

It should be appreciated that other stunt elements may include speed control elements. These speed control elements include speed retarders and speed accelerators. Speed retarders, such as built-in delayed releases, controlled drops, speed, etc., may enhance play value by increasing the anticipation of an event. Further, speed accelerators, including ramp inclines, may, for example, increase play value by keeping vehicles moving through the track set.

In accordance with an exemplary embodiment of the present invention and referring to FIG. 21, the outgoing vehicle from relay segment 2100 travels to relay segment 2200. The outgoing vehicle is now the incoming vehicle for relay segment 2200 and travels along incoming track 2202 to actuate trigger 2204 of relay segment 2200. Relay segment 2200 may be a stunt element, such as a shock drop stunt element. Thus, the incoming vehicle initiates the stunt, such that pre-loaded stunt vehicle exits stunt 2200 at 2206 toward a subsequent relay element (not shown) or end.

Figure 22:
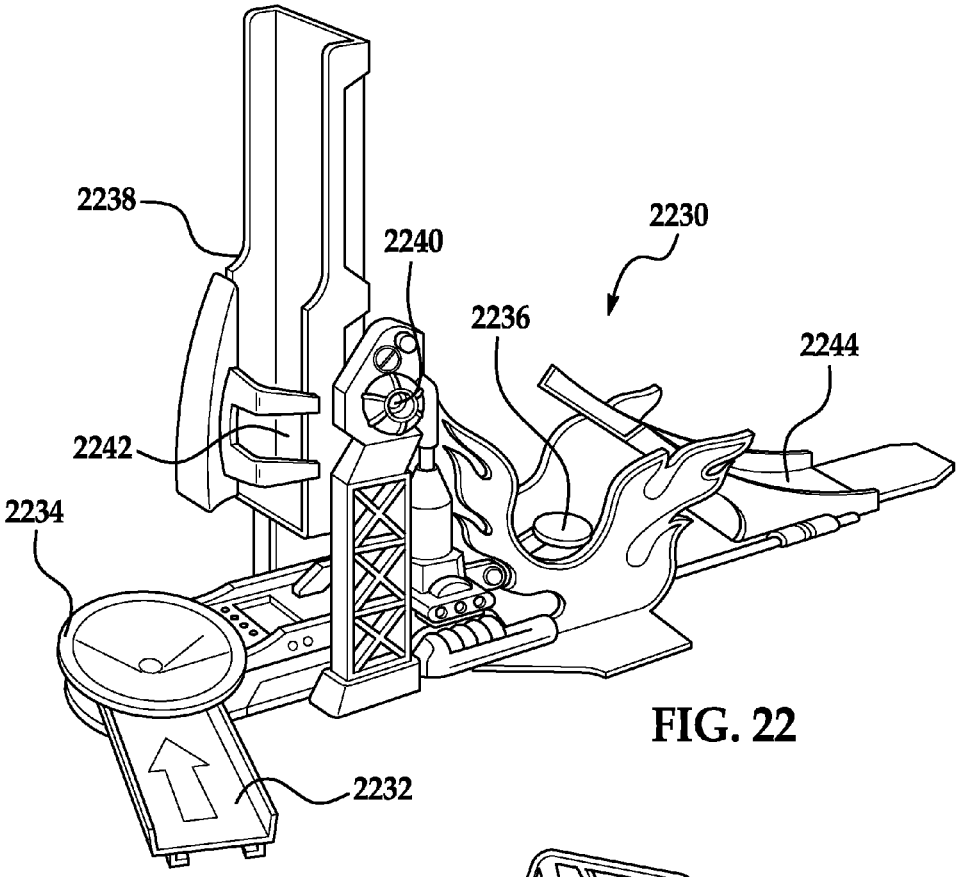
FIGS. 22-23 illustrate yet another exemplary relay segment in accordance with another exemplary embodiment of the present invention.

FIG. 22 illustrates rotating ramp launch stunt 2230 as an example of an indirect acting relay segment having a gravity actuated rotating ramp launch stunt. Specifically, an incoming track 2232 is moveable mounted to the relay segment proximate to a conical trigger 2234, which can also be actuated via the manual button 2236. In this example, the trigger when in the downward position locks an actuatable spring loaded member in an unreleased or loaded position, such that contact by an incoming vehicle on track 2232 causes the trigger to move vertically, and initiate rotation of rotating ramp 2238 about axis 2240. A vehicle may be pre-loaded and positioned within rotating ramp 2238 at end 2242 such that upon swinging downward and stopping in the downward position, a vehicle is launched down exiting track section 2244.

Figure 23:
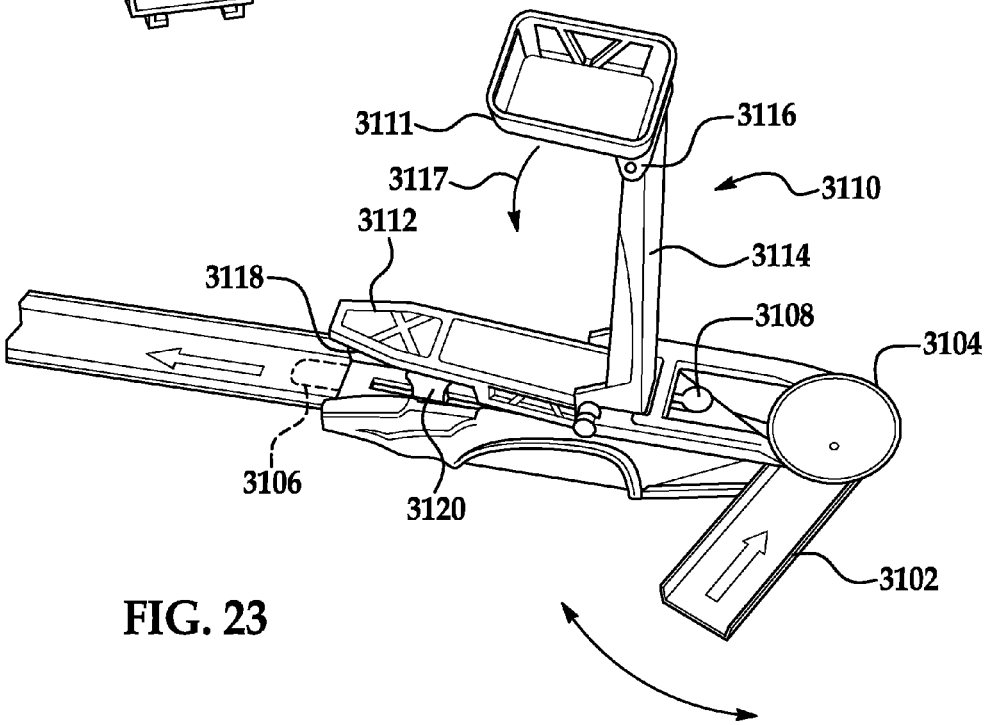

Referring now to FIG. 23 still another relay segment is illustrated. Here the relay segment is a free-fall stunt element 3110. As illustrated, free-fall stunt element 3110 is configured to provide a free fall stunt for a preloaded vehicle. As shown, incoming track 3102 is coupled to a conical trigger 3104, which can also be actuated via the manual button 3108. In this example, the trigger may configured to release a spring loaded stunt element such that contact by an incoming vehicle on track 3102 causes the trigger to move vertically and release a catch that then releases a vehicle basket 3111 such that a preloaded stunt vehicle free falls to target 3112.

The vehicle basket 3111 may be hingedly connected to an arm 3114 as indicated at pivot point 3116. A vehicle may be preloaded in the basket. Activation of trigger 3104 results in the basket swinging downwards, as indicated by arrow 3117, such that the vehicle drops out of the basket and falls toward the ground. FIG. 23 illustrates the basket 3111 in a pre-trigger configuration, where the basket is substantially perpendicular to the arm.

In some embodiments, the preloaded stunt vehicle is configured to fall onto a target 3112. The target may be part of a platform or other structure. Upon impact with the target, a third vehicle may be released. As an example, a second preloaded vehicle may be positioned in cavity 3118. Cavity 3118 may include launching structure such as a spring loaded launch slider 3120 which upon activation slides forward, causing the second preloaded stunt vehicle to be accelerated toward exit 3106. This second preloaded vehicle becomes the outgoing vehicle of relay element 3100.

Figure 24:
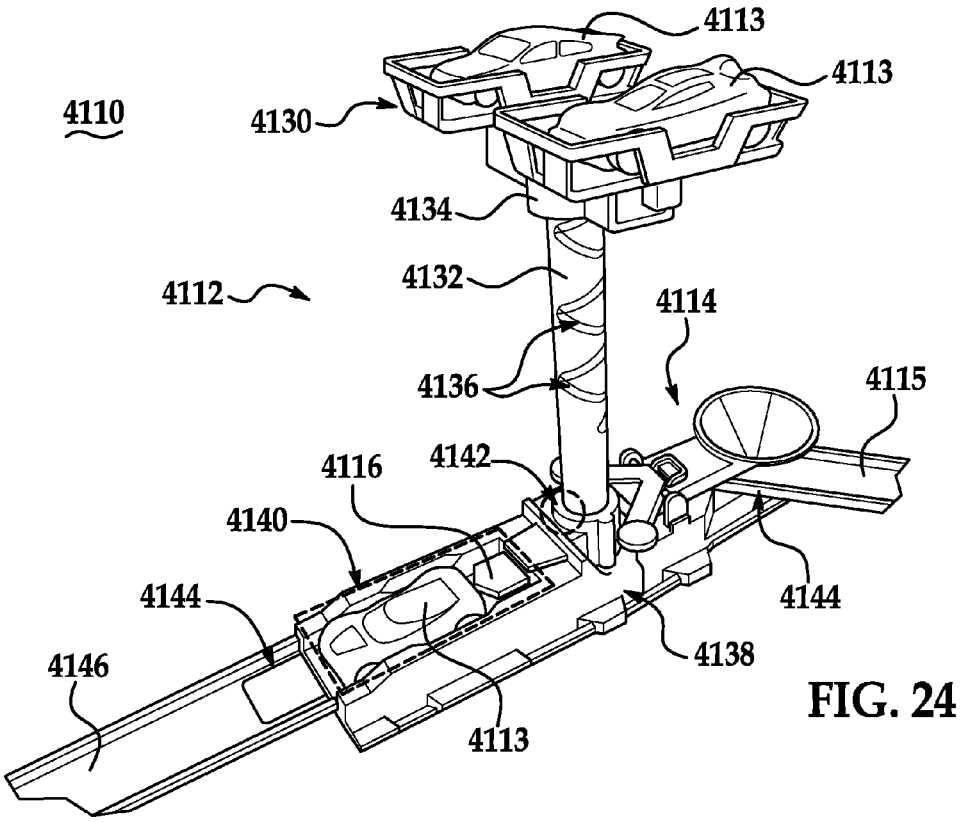
FIGS. 24-47 illustrate various other exemplary embodiments of the present invention.
Figure 25:
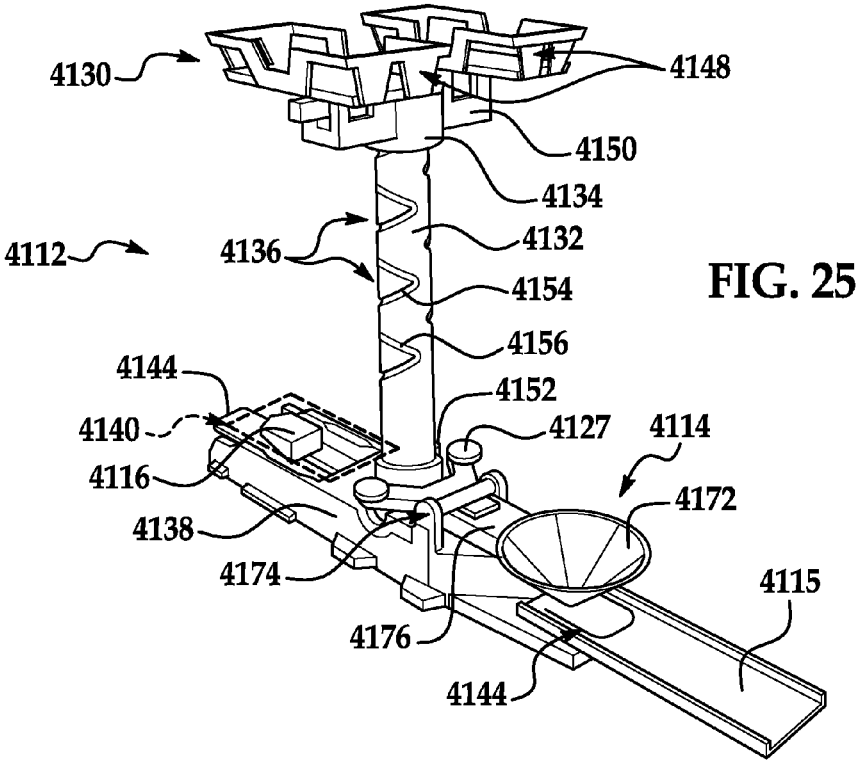
Figure 26:
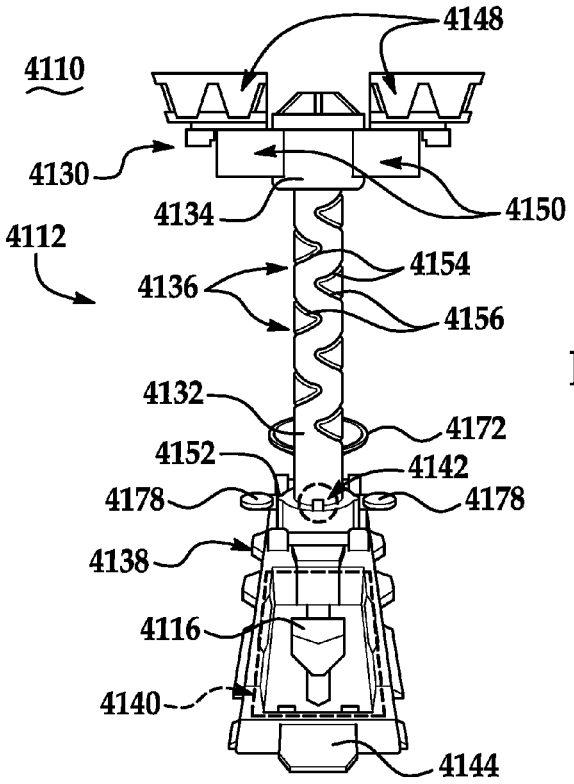
Figure 27:
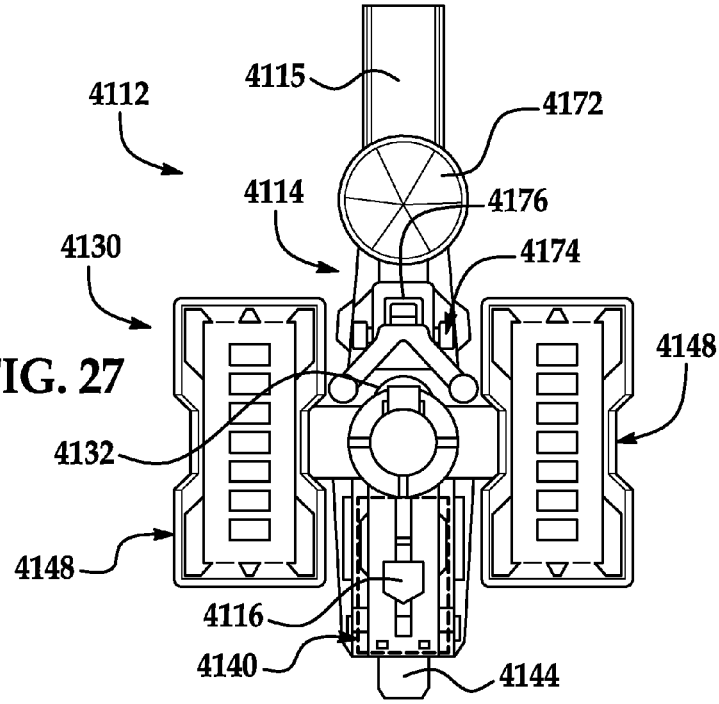
Figure 28:
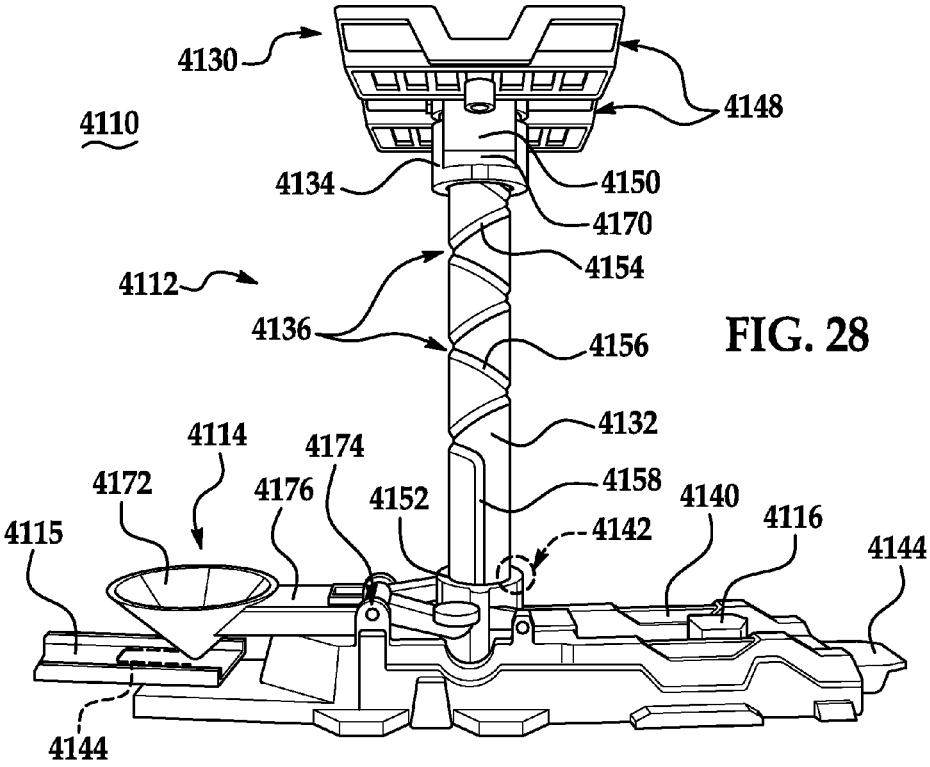
Figure 29:
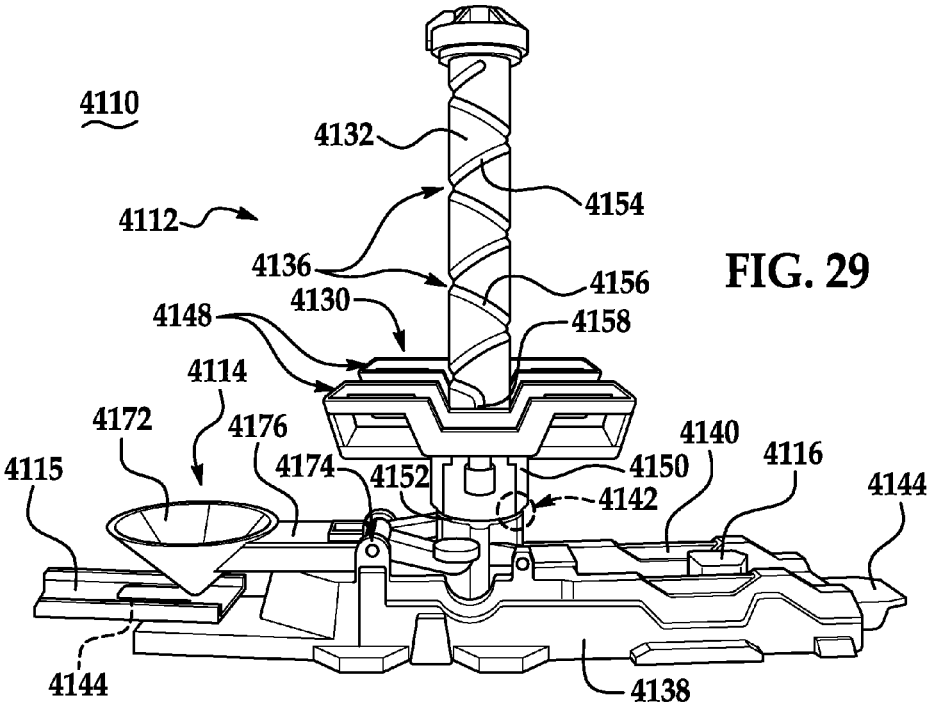

Referring now to FIGS. 24-47 alternative exemplary embodiments of the present invention is illustrated. Here a track set 4110 having a relay segment 4112 is shown at least in FIG. 24. In this embodiment, a user may customize the track set by positioning relay segment 4112 in any desired portions of a track set as well as a track set having other relay segments disclosed herein.

As illustrated, relay segment 4112 has a first actuator or trigger 4114 and a second actuator or launcher 4116. The first actuator of the relay segment 4112 may also be referring to an incoming vehicle trigger, movable member or release mechanism which may directly or indirectly causes the launching of another outgoing vehicle or object from the relay segment 4112 via second actuator or launcher 4116, wherein the outgoing vehicle or object from one segment may become the incoming vehicle or object of a next segment that strikes the trigger, movable member or release mechanism of the next segment.

Although any suitable launcher may be used, in the illustrated embodiments, various automatically and manually-triggered release launcher elements are illustrated. In one implementation, a vehicle may be positioned in a launch position such that a launch element may slidingly engage the vehicle to propel the vehicle along the track. The launch element may be biased to a launch position, such as by springs, elastic bands or any other suitable biasing mechanism such that release of an activator releases its stored potential energy.

In one embodiment, the relay segments may include a trigger, such as a conically shaped trigger, angled or curved trigger shapes that are not necessarily conical or a movable member. In some relay segments, actuation of a trigger by a first vehicle or object initiates a stunt and release of a second vehicle on the track set.

Referring now to at least FIGS. 24-47 relay segment 4112 is illustrated. As in the previous embodiment, the relay segment has a trigger mechanism or actuator 4114 similar to the previous embodiments wherein movement of the trigger mechanism from a first position to a second position will cause the relay segment 4112 to perform a function and release an object releasably coupled to the first actuator. As illustrated, first actuator 4114 has a first track segment 4115 pivotally secured to the relay proximate to the trigger such that an incoming vehicle may move trigger 4114 from a first position to a second position. Once trigger 4114 is moved to the second position a tab or tabs or other suitable device holding an object to the relay segment is retracted and the object is free to travel towards the second actuator. In one embodiment, the pivotal movement of the track segment 4115 is in a first plane and the pivotal movement of the trigger is in a second plane, wherein the first plane is different from the second plane. In one non-limiting embodiment, the first plane is perpendicular to the second plane.

Additionally, first trigger 4114 can also have a manual trigger mechanism 4127 that will retract the tab and cause an object to travel towards the second actuator. This allows the relay to be the first in a series of relay segments coupled together.

The relay segment includes further incorporates a carrier or an accessory vehicle carrier 4130 moveably attached to a central tower or guide member 4132. Accessory vehicle carrier 4130 and central tower 4132 are particularly configured such that the vehicle carrier descends the central tower under the force of gravity and maintains an oscillatory rotation over a substantial portion of the descent. Rotation of vehicle carrier 4130 during descent is controlled by interactions between a collar 4134 associated with vehicle carrier 4132, and surface grooves 4136 on central tower or guide member 4132 as will be discussed below.

As shown, the relay may further include a base 4138 that supports the guide member or central tower 4132 and connects the same to a launch impulse element, second actuator or launcher 4116.

The second actuator can in one embodiment be configured to have a launch bay 4140 supported or secured to the base. Alternatively, the launch bay may be located elsewhere with respect to the base. Movement of the first actuator or trigger will cause the vehicle carrier to descend down the guide member until a trigger 4142 of the second actuator is contacted and the second actuator launches an object 4113 from the launch bay. In one embodiment, launch bay 4140 is proximate a connector 4144 which is used to link relay segment 4112 to another relay segment via a track segment 4146. Still further and as disclosed herein, object 4113 may be a toy vehicle.

As described herein, the relay segment 4112 may be incorporated into a toy vehicle playset 4110 that includes a plurality of toy vehicles or cars, and one or more track segments for directing toy vehicles, to effect a cause-and-effect chain of events for educational and/or entertainment purposes.

As illustrated, the relay segment includes and/or is arranged between a first track segment 4115 and a second track segment 4146. In one embodiment, the first track segment is configured to direct a toy vehicle 4134 towards the first actuator or trigger, which is configured to be actuated by the impact of vehicle 4113 and actuation of the first trigger causes the vehicle carrier to be released and descend from a top portion of the guide member under the force of gravity.

The surface grooves of the guide member or central tower interact with elements of the carrier collar, which as will be described below, regulate rotational movements of the carrier with respect to the guide member. The surface grooves are particularly configured to induce an oscillating helical rotation of the vehicle carrier during at least a portion of the descent of down the guide member, and to arrest rotation of vehicle carrier during at least a final portion of the descent to result in a final vertical "drop", which in one embodiment will cause the trays of the carrier to pivot from a first position to a second position as will be discussed below.

At or near the end of the descent of the guide member, the carrier will actuate the trigger 4142 of the second actuator, which causes an element of the second actuator or launcher to launch an object down track segment 4146. In one non-limiting example shown, the element is configured to propel a toy vehicle out of the launch bay onto the second track element.

In one embodiment, the vehicle carrier is configured to have one or more trays 4148 attached to the central collar by support arms 4150. In some embodiments, the collar is fully integrated with the carrier and the trays are configured as baskets. However, other configurations of the carrier are within the scope of the present disclosure. Some examples may include alternatives to vehicle trays to hold toy vehicles during descent of the carrier. Some examples may include direct attachment of the vehicle trays or alternative holders to the collar. Some other examples may include a collar that separates from other elements of the vehicle carrier and still further and as will be discussed below the carrier will have a pair of trays configured to hold objects (e.g., toy vehicles, etc.) therein and the trays are pivotally secured to the carrier and/or collar such that they can move from a first position to a second position when the collar hits the bottom of the base and/or guide member of the relay segment. In one embodiment and as the trays pivot from the first position to the second position, the objects held therein are thrown from the tray and/or carrier.

The trays, support arms, and collar may, but are not required to, be arranged or configured to stabilize the relay segment and/or other elements of the playset during play activity. Stability of relay segment may be increased by arrangements of the trays which accommodate centrifugal forces generated by rotation of the carrier, and/or withstand changes in the velocity and/or direction of rotation of carrier during descent. For example, the vehicle trays and support arms may be symmetrically arranged about the central collar to equalize centrifugal forces during rotation.

At least FIGS. 24-27, 32 and 42 show the collar and the carrier at a first raised position near the top of guide member while at least FIGS. 28, 33, 36, 45, 46 and 47 show the collar and the vehicle carrier at a second, or base, position near the bottom of the guide member 4152. The carrier descends from the first raised position to the second base position under the force of gravity, and oscillates around the guide member during at least a portion of the descent by reversing its direction of rotation multiple times.

Gravity powered descent by the carrier is facilitated by holding the guide member in a substantially vertical orientation on the base and rotational movement of the carrier with respect to the guide member is facilitated by configuring the guide member to be a substantially cylindrical column. The surface of guide member in one embodiment is molded, impressed, or otherwise modified to control rotational, directional, and/or velocity parameters of the vehicle carrier during gravity powered descent. In one embodiment, the external surface of the guide member or central tower has one or more grooves which describe a path that the carrier can follow through interactions with the collar. However, a guide member that presents a path of external or internal ridges, fins, pins, flanges, or other physical or optical features as means to induce an oscillating rotation of the carrier during descent, are within the scope of the present disclosure.

The attached FIGS. illustrate that the guide member or central tower has two surface grooves on opposite sides of the same, generally indicated at 4136. The surface grooves form continuous paths from substantially near the top to the bottom of the guide member. As shown by this example, a plurality of grooves having substantially similar configurations may be arranged adjacent each other on sides of the guide member/tower, without intersection.

The surface grooves that extend from near the top to near the bottom of central tower do so without a change in the vertical direction. Surface groove paths that do not reverse vertical direction may facilitate a descent of the vehicle carrier that is motivated substantially or entirely by gravity. However, alternative examples in which surface grooves reverse vertical direction on the tower are within the scope of the present disclosure. Some alternative examples may include bumps or hills along the surface groove pathway, which a descending carrier may overcome by momentum and/or motorized mechanisms.

The surface grooves are configured to cause an accessory or vehicle carrier to rotate in an oscillating manner during descent from a first raised position to a second base position. Accordingly, grooves that have substantially spiral, or "helical", trajectories around the guide member will induce rotation during descent by a carrier that is configured to follow the grooves. Helical surface grooves that reverse their rotational direction multiple times will induce oscillatory rotation around central tower or guide member. In the illustrated examples, the guide member contains a plurality of continuous surface grooves, each having helical trajectories that reverse their rotational direction multiple times between a dextrorotatory or "clockwise" 4154 direction and a levorotatory or "counterclockwise" 4156 direction.

As illustrated, the helical surface grooves may oscillate around at least an upper portion of the guide member and may have a substantially regular period of oscillation. However, the surface grooves that oscillate along other portions of the central tower and/or oscillate with irregular periods are within the scope of this disclosure. In some examples, the spiral deflection angle may be greater or lesser than those shown in the FIGS. or may vary between and/or within individual segments of the descent. In some examples, the first and/or last rotational directions of the surface grooves may be reversed from those shown in the FIGS. The number of oscillations, oscillation frequency, spiral deflection angle, distance moved along the guide member or central tower during oscillations, speed of movement, and combination or sequence of rotational and non-rotational descent of the carrier may vary without limitation within the scope of the present disclosure.

The surface grooves may also be configured to induce the carrier to fall without rotation for a last portion of the descent of guide member or central tower. For example, the path of the surface grooves changes from a substantially spiral trajectories 4154, 4156 on an upper portion of the guide member to a substantially vertical trajectory 4158 on a lower portion of the guide member. Limiting rotation of accessory the carrier for a final portion of the descent of the guide member may facilitate interactions with trigger 4142 causing the vehicle carrier to drop rapidly and gain vertical momentum prior to impact. Limiting rotation of the carrier for a final portion of descent may also stabilize the base and/or connections with other elements of toy vehicle playset. Still further and in one embodiment, when the carrier hits the base member the trays may pivot from the first position to the second position wherein the object held therein is thrown therefrom (See at least FIGS. 45-47).

The collar in one embodiment is configured to follow or "track" along with the surface grooves during descent. In one embodiment, the collar has an inner diameter slightly larger than the diameter of guide member or central tower. Alternatively, the collar may include components that penetrate this inner diameter to engage the surface grooves. In one embodiment, the collar has a plurality of guide pins 4160 circumferentially arranged around its inner surface to engage each surface groove on the guide member. Alternatively, the collar will have channels or other features that responsively engage alternative surface modifications of the guide member to result in an oscillatory descent of vehicle carrier.

Figure 30:
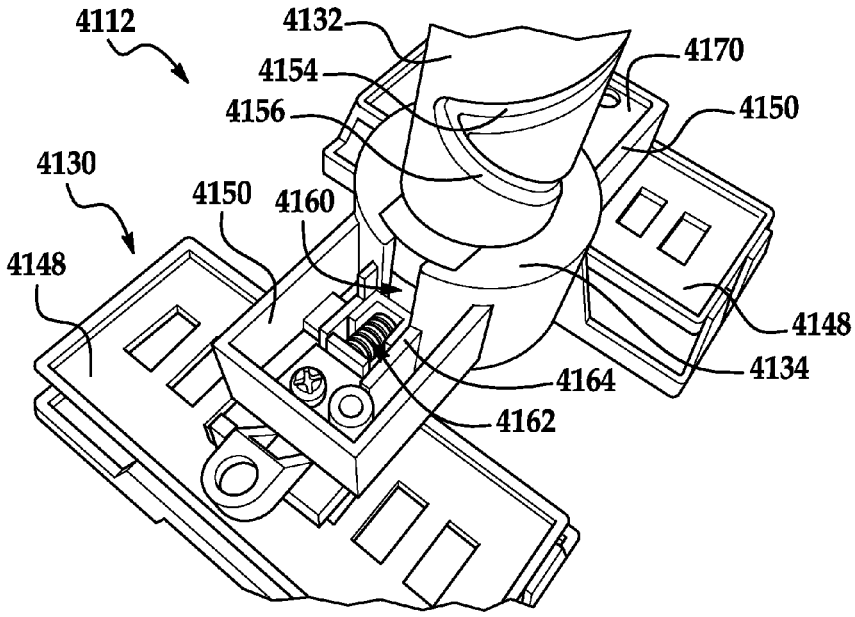

As illustrated in at least FIG. 30 the guide pin or pins are pushed by a compression spring 4162 into firm interaction with surface groove. The compression spring can be supported by a spring chamber 4164, and may be housed at least partly within the support arms of the vehicle carrier wherein the arm housing the guide pin and compression spring includes a protective cover 4170.

In an exemplary embodiment, the relay segment has a trigger 4114 for inducing the descent of the carrier along the guide member. As in the previous embodiments, the trigger 4114 has an impact surface 4172 pivotally connected to the relay segment at a pivotable joint 4174 via an arm 4176. In various embodiments, the relay may also have one or more alternate, auxiliary, or manual actuation levers 4127 to provide an alternate method of activating descent of the carrier or vehicle carrier.

In one exemplary embodiment, the impact surface is angled or has a conical shape and is positioned proximate to the first or incoming track segment of the relay that directs objects or toy vehicles towards the impact surface. In one embodiment, the first or incoming track segment and/or the second or outgoing track segment are pivotally secured to the relay.

The impact surface is configured to translate horizontal impact of a moving object into a vertical lift of the first trigger, which when moves causes release of the vehicle carrier from a first raised position on the guide member since the trigger is coupled to a mechanism for releasing the carrier. In one non-limiting exemplary embodiment, the mechanism includes a tab 4178 that is located at or near the top of guide member/central tower and fits into a channel 4180 in an upper surface of the collar. The tab when engaged into the collar prevents rotation of collar, which is required for the carrier to descend down the guide member under the control of the angled surface grooves. In one embodiment, the guide member has a cap 4182 that partly covers tab 4178 without interfering with the collar or other elements of the vehicle carrier.

Figure 31:
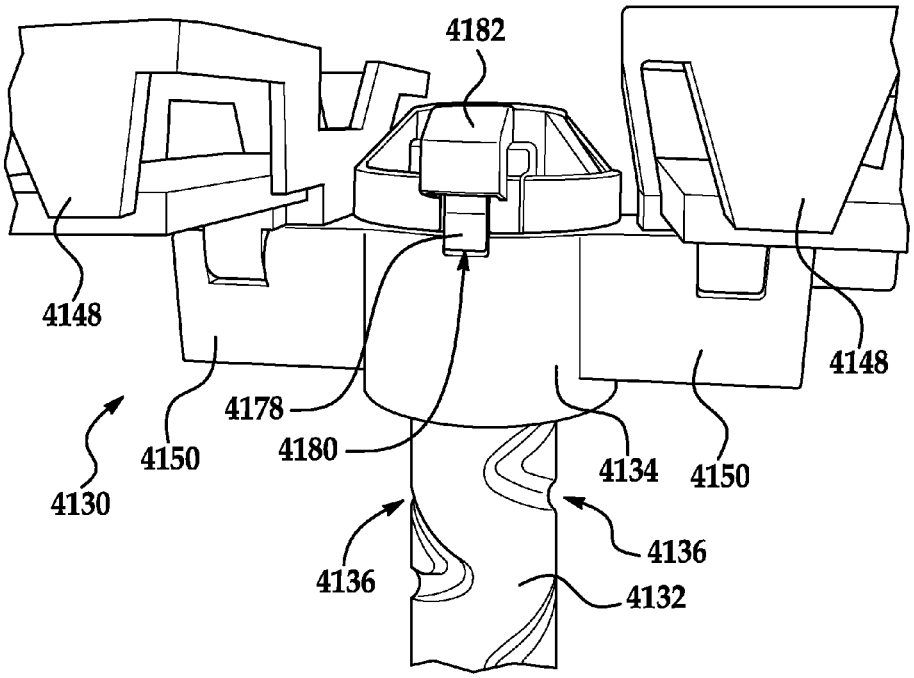
Figure 32:
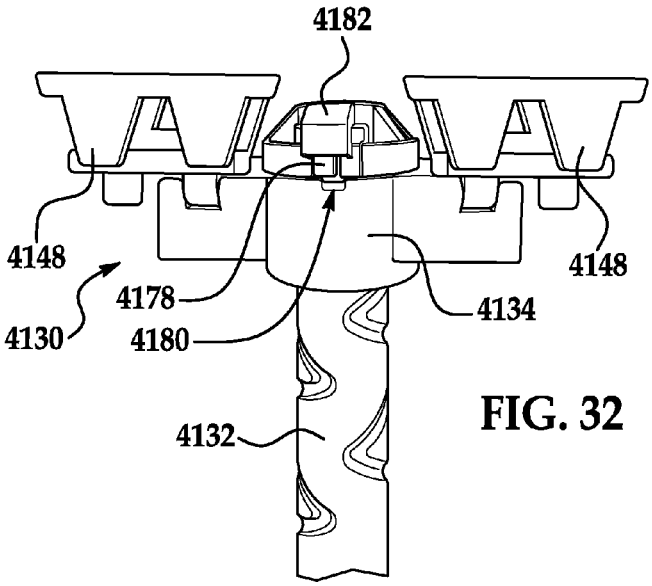
Figure 33:
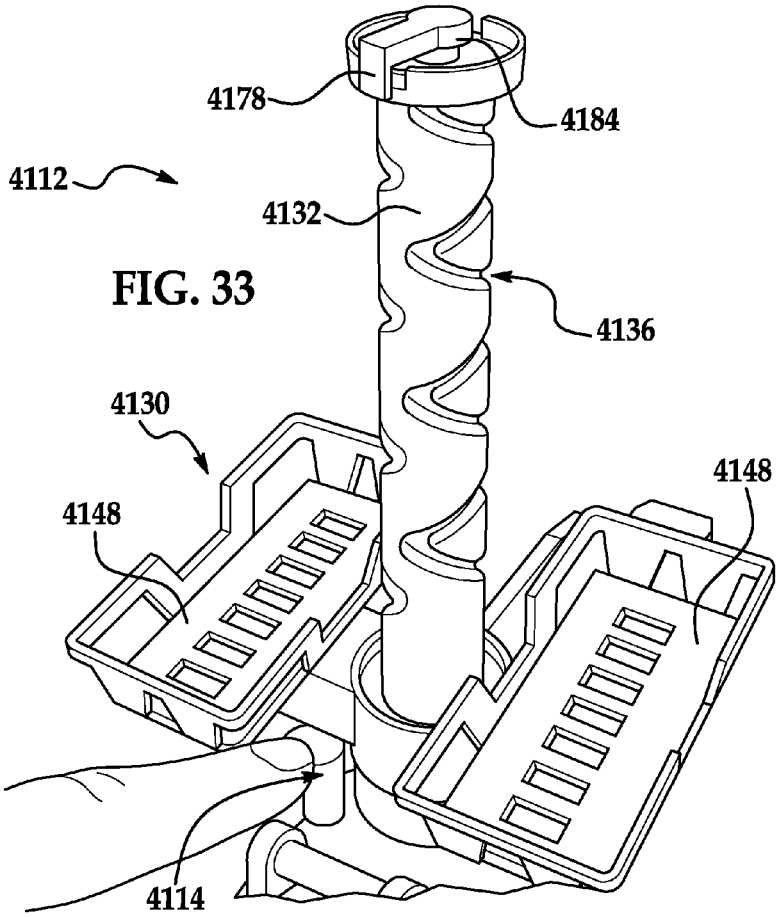

FIG. 31 shows the tab in a first lower position, where it engages channel 4180 to prevent rotation of the collar 18. FIG. 32 shows that the tab has moved to a second upper position, where it disengages the channel to initiate a rotational descent of the carrier. In one embodiment, activation of the first trigger lifts tab 4178 from the first lower position to the second upper position. The tab is connected to a shaft 4184 that moveably traverses the guide member through its center. In one embodiment, activation of the first trigger raises the shaft, and thus raises the associated tab from a first lower position to a second upper position. The cap is configured to allow for movement of the tab and the shaft between the first lower position and the second upper position.

Figure 34:
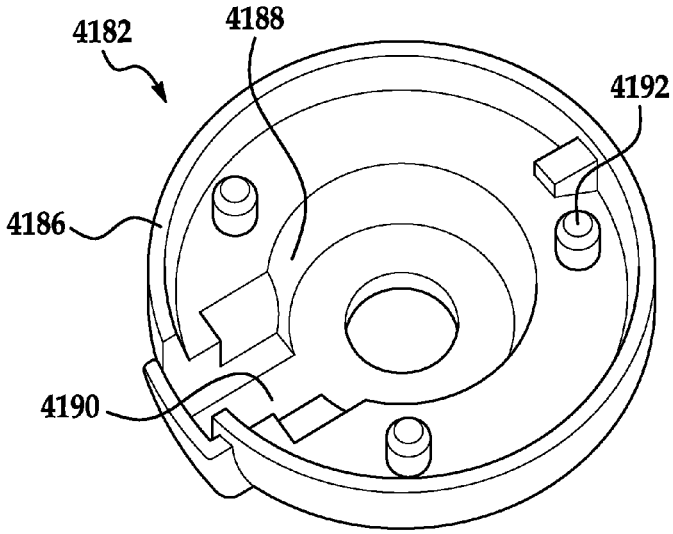
Figure 35:
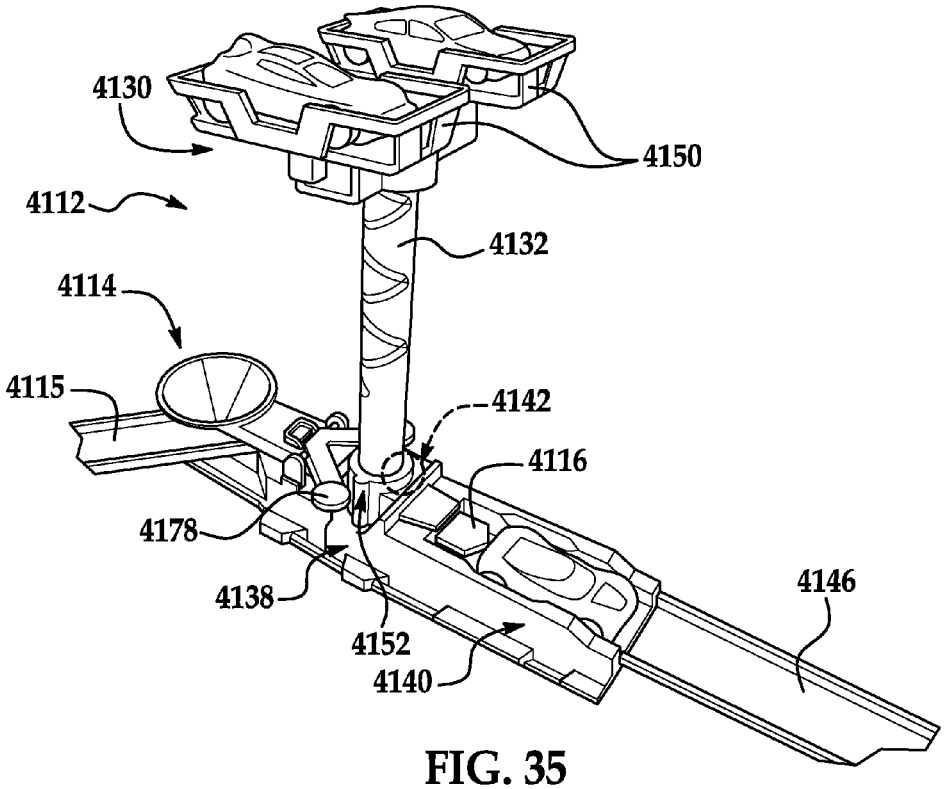
Figure 36:
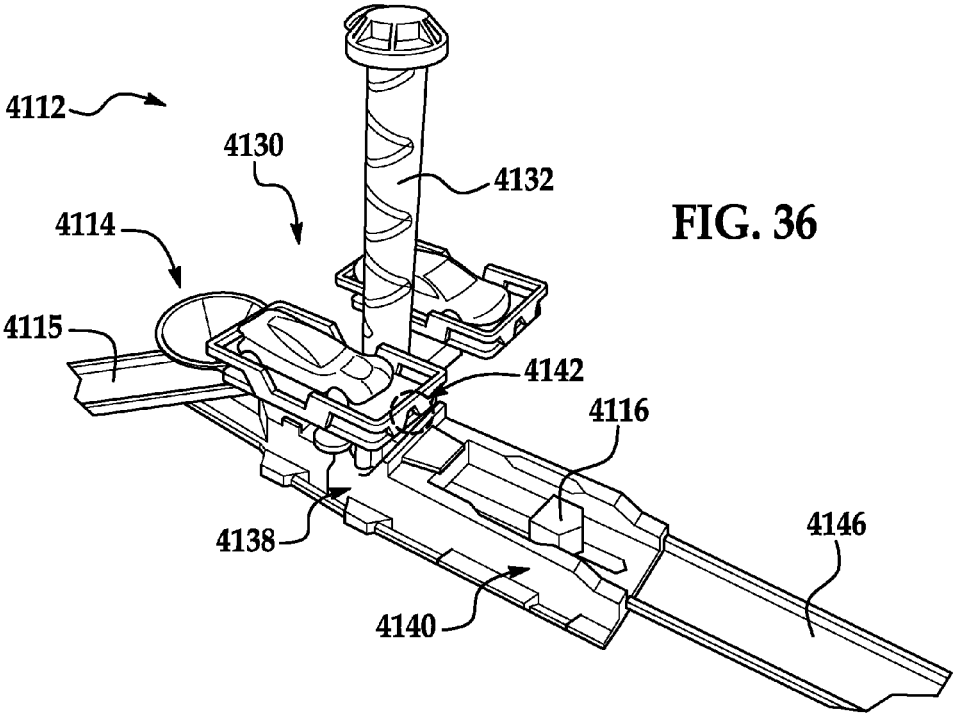
Figure 37:
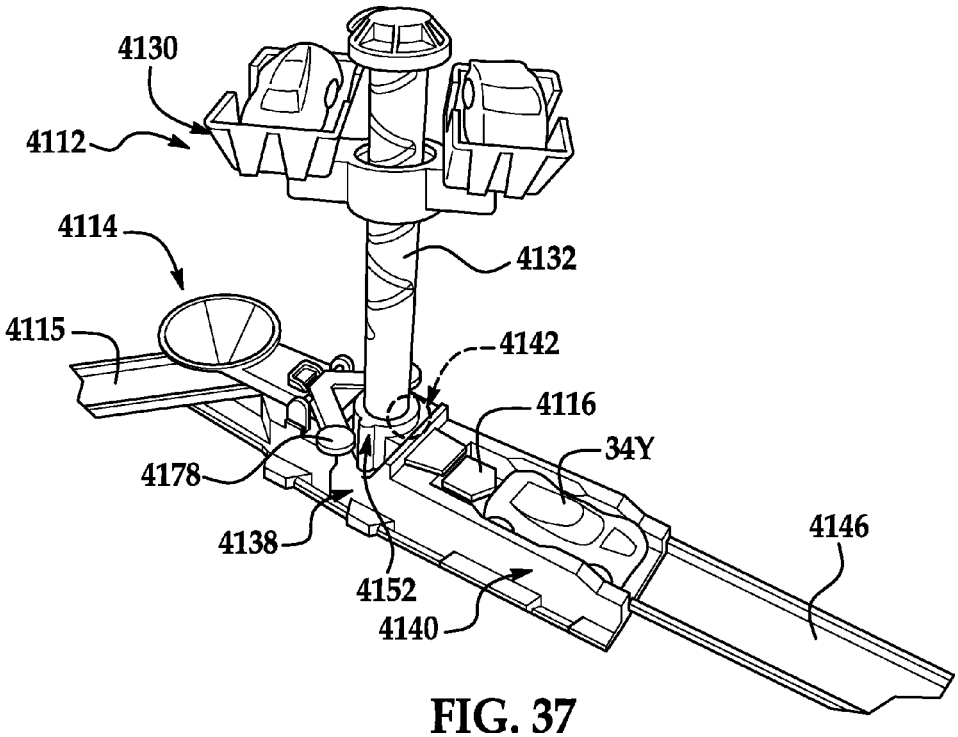
Figure 38:
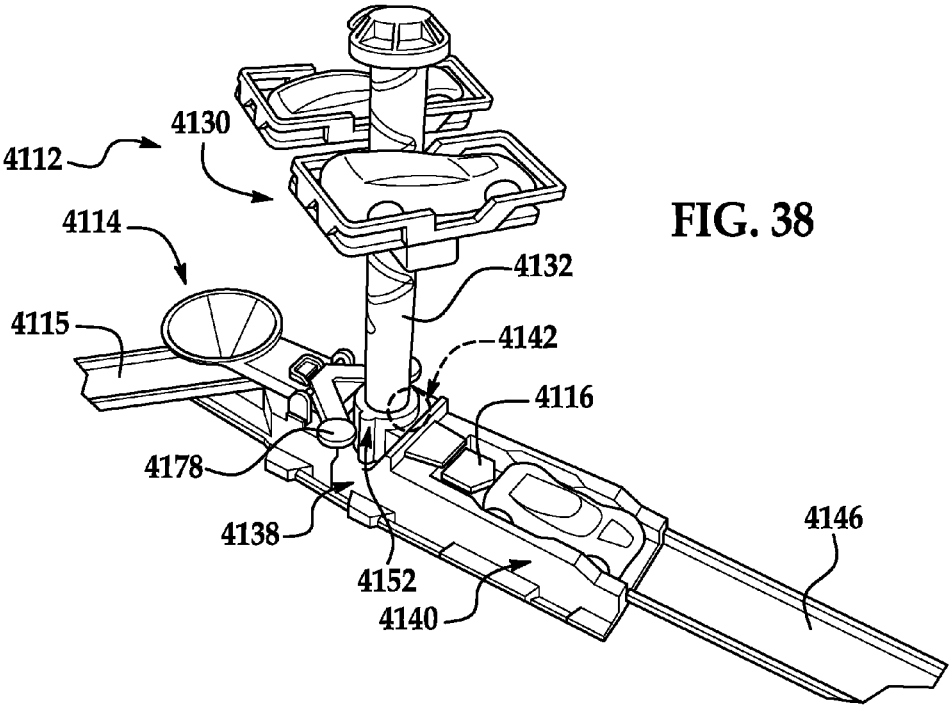
Figure 39:
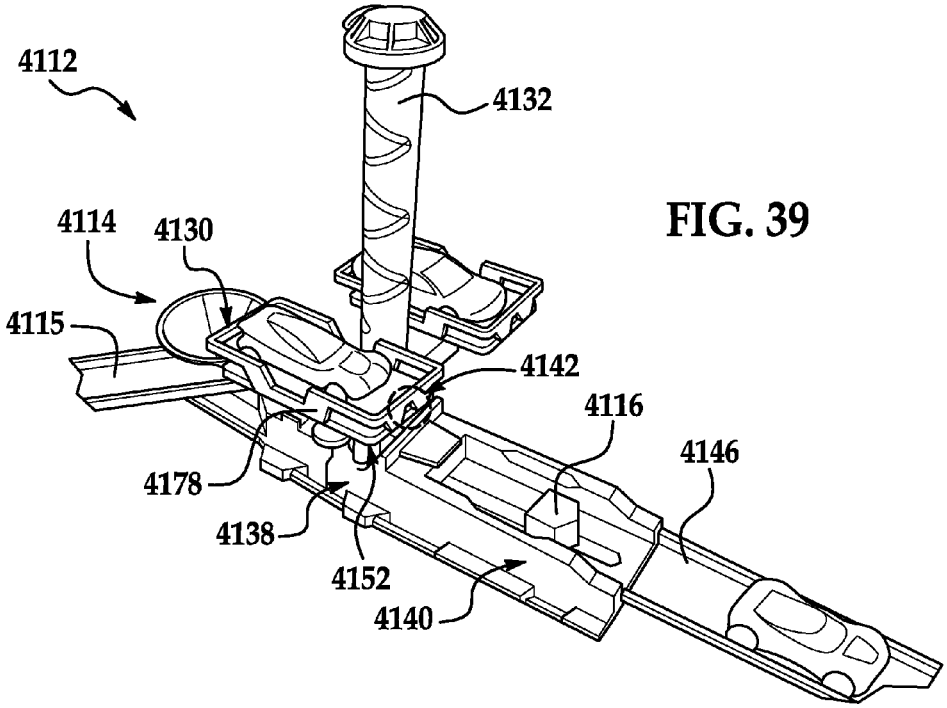
Figure 40:
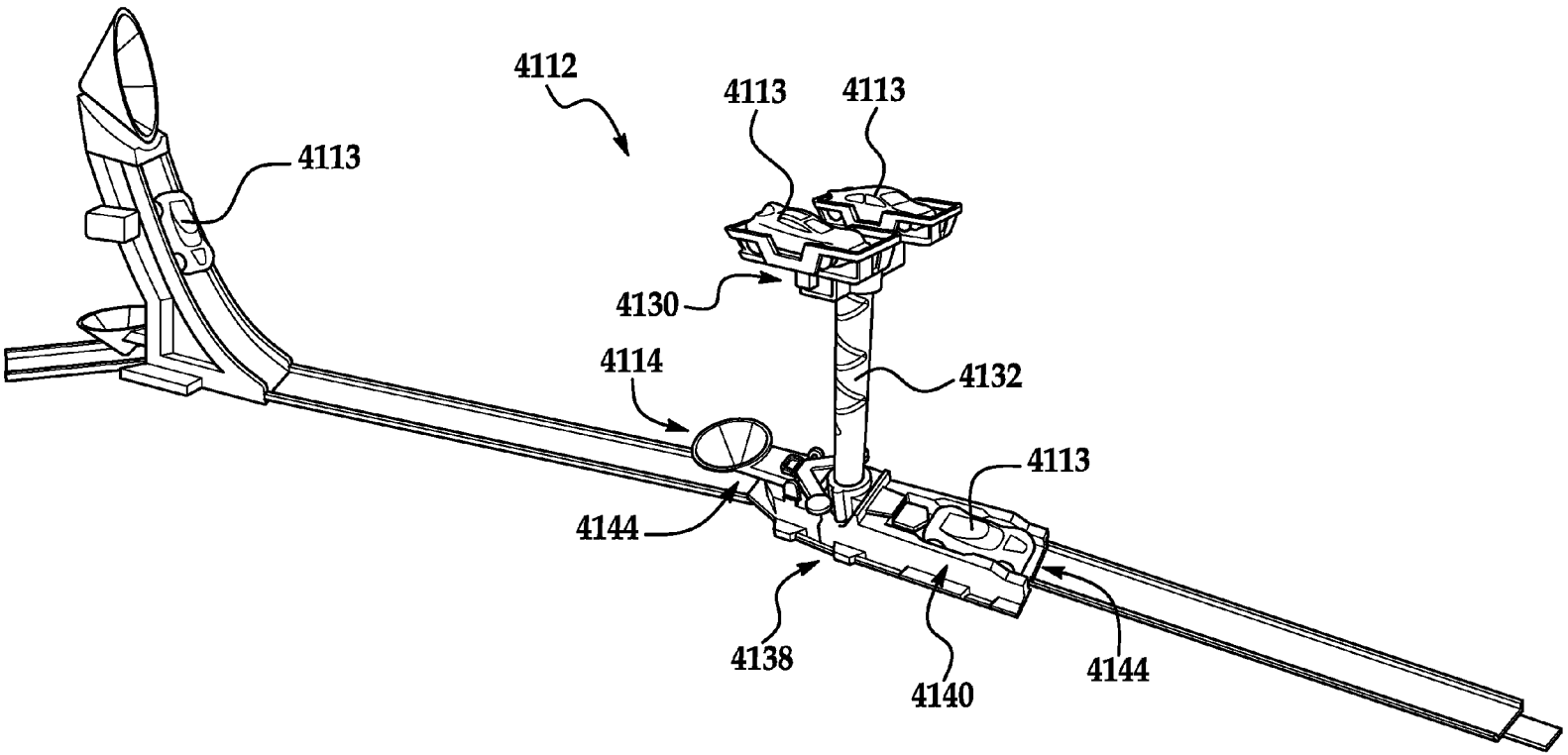
Figure 41:
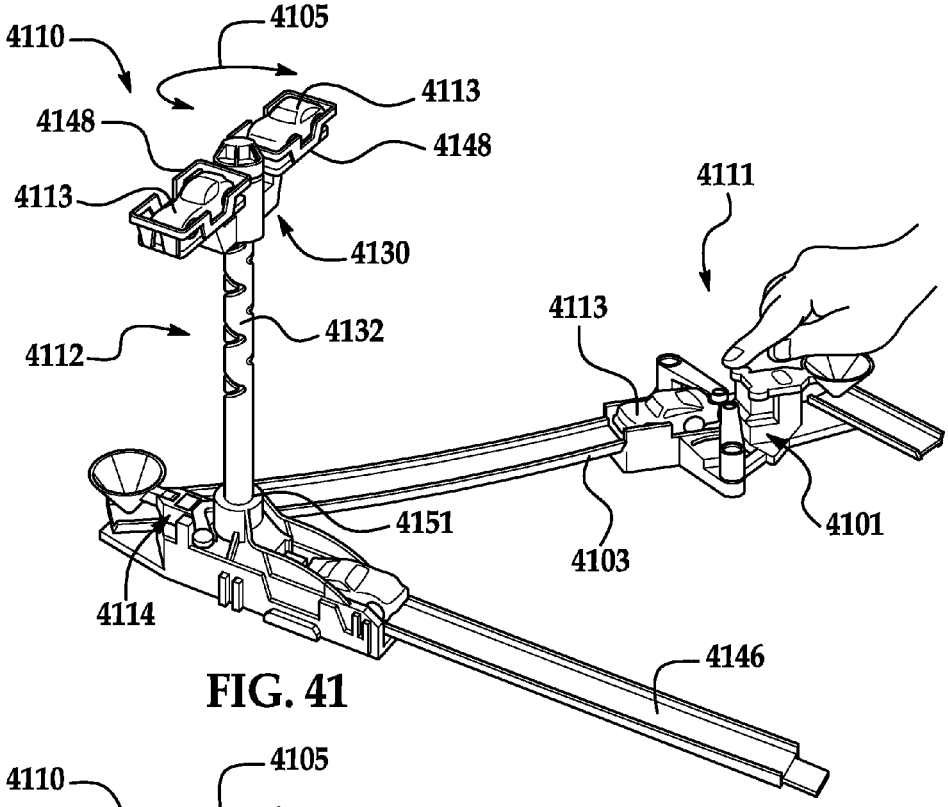
Figure 42:
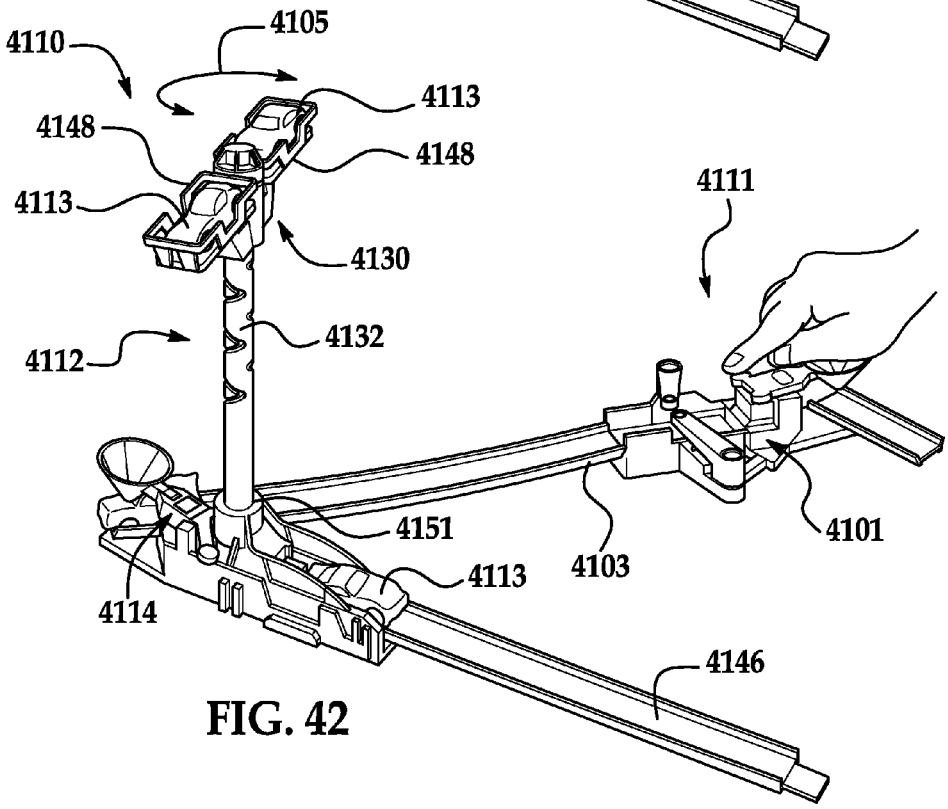

FIG. 34 illustrates the inner surface of the cap, wherein the cap has a lip 4186 with an inner diameter slightly larger than the outer diameter of the guide member to which the cap is secured to. The cap also includes a central cavity 4188 having a diameter and a depth that accommodate the size and the movement of the shaft therein. The cap further includes a side cavity 4190 having a width and a depth that accommodate the width and the movement of the tab therein. Notwithstanding these elements, the cap may include additional improvements for example, the cap may include one or more fittings, such as a post 4192 to facilitate the attachment of the cap to the guide member, an alignment of the central cavity with the shaft, and/or an alignment of the side cavity with the tab.

The relay segment is also configured to enable the carrier to initiate the launch of a toy vehicle or car at the end of the carrier's descent down the guide member. In one embodiments, the trigger 4142 is located at the bottom of the guide member where it is actuated by direct impact of the collar as the bottom of the carrier's decent. To facilitate the interaction between of the collar and the trigger 4142, the lower end of the guide member is configured as a substantially horizontal step or "foot" that is wider than the diameter of the guide member and that exceeds at least the inner diameter of the collar. In this embodiment, the tower foot directly arrests the descent of the carrier by blocking downward travel of the same and to enable a descending carrier to activate the second actuator or launcher by direct impact, at least a portion of the trigger 4142 projects through the foot.

Launcher or second actuator 4116 is configured to move rapidly and forcefully from the first activated position to the second fired position by a release of stored energy. Nonexclusive illustrative examples of mechanisms by which the launcher may be driven and/or powered include electric motors and elastic elements such as various types of springs or rubber bands. The launcher may also be configured to continuously, intermittently and/or repeatedly apply propulsive force. Further details of a vehicle launcher containing such a launch element are disclosed in U.S. Patent Application Publication No. US20080268743, the complete disclosure of which is incorporated by reference in its entirety for all purposes.

In one embodiment the launcher is arranged on the base to induce motion in, or propel, a toy vehicle or car down a second track segment when the trigger 4142 is actuated by the descending carriage.

As illustrated in the attached FIGS. initial, final and sequential stages of action of the relay segment are provided. Upon actuation of the first trigger the carrier is released from its first raised position near the top of the guide member and the carrier descends the guide member or tower by rotating with repeated reversals of direction of rotation during descent. In one nonexclusive example, the carrier rotates substantially more than 120 degrees but less than 180 degrees between each reversal of rotation direction. Of course, other degrees of rotation greater or less than the aforementioned values are considered to be with the scope of exemplary embodiments of the present invention.

Figure 43:
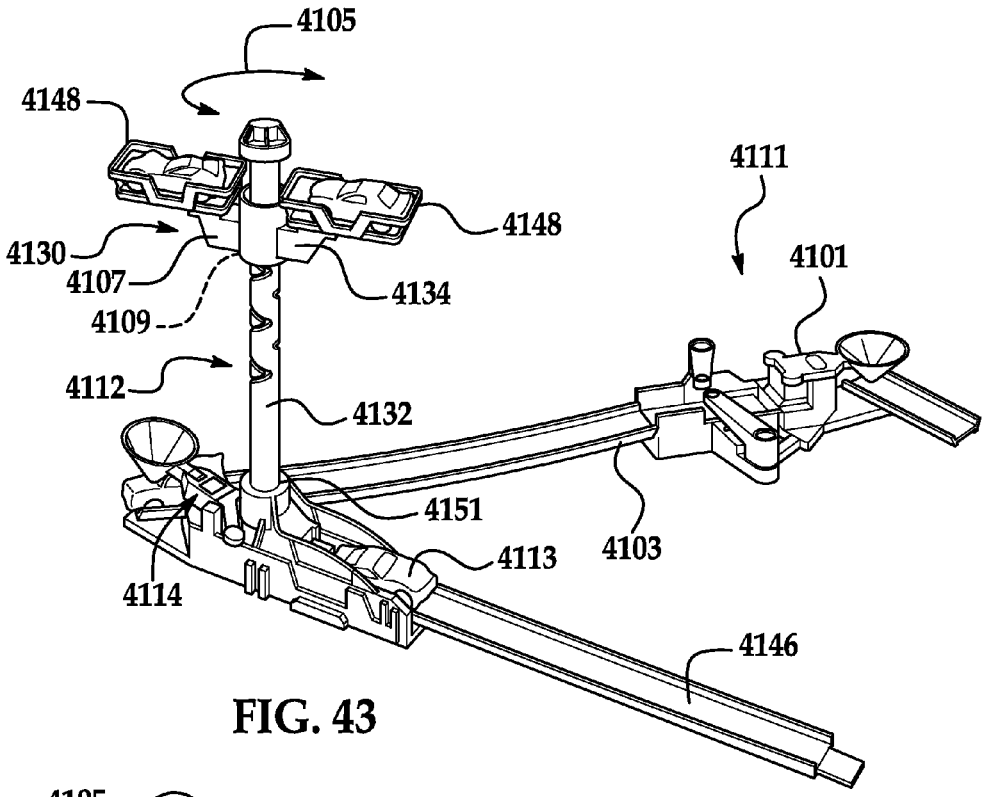
Figure 44:
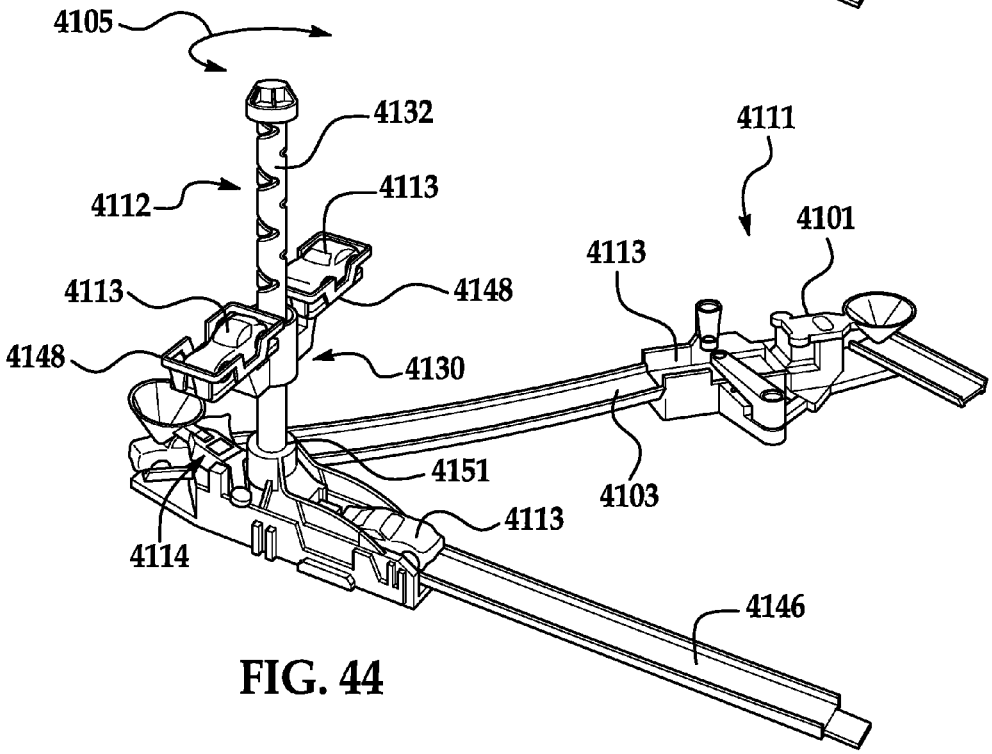
Figure 45:
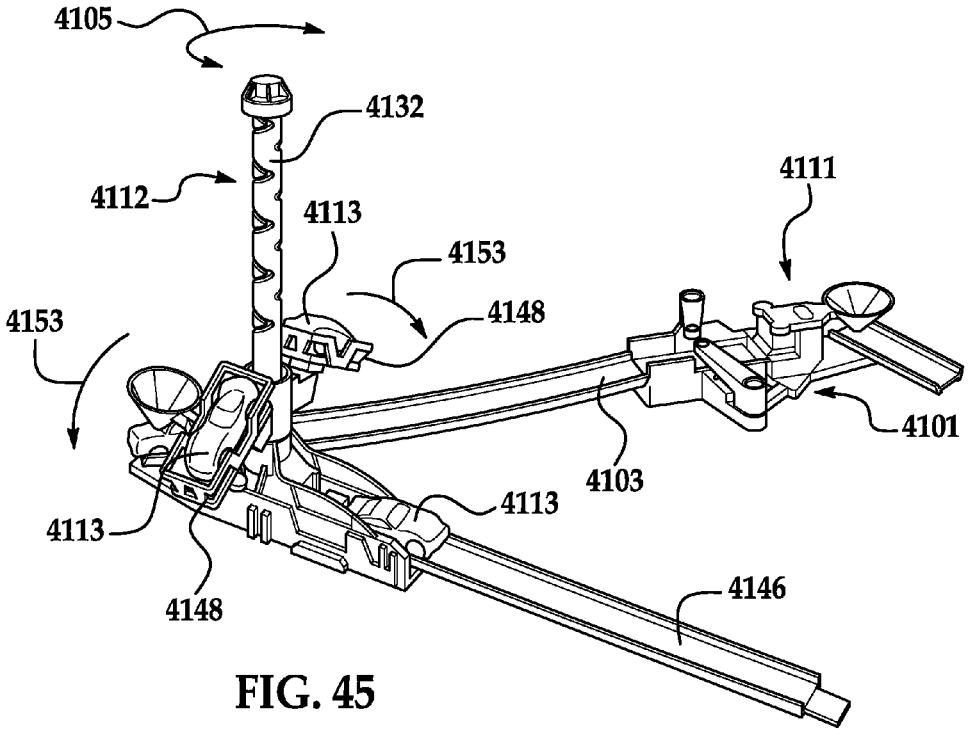
Figure 46:
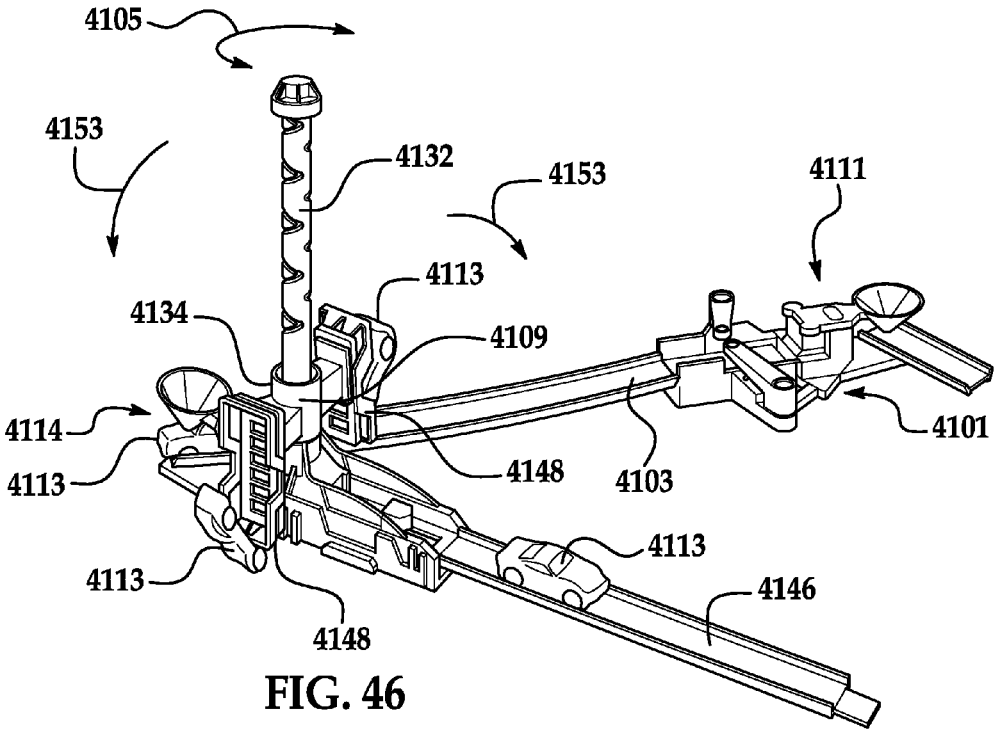
Figure 47:
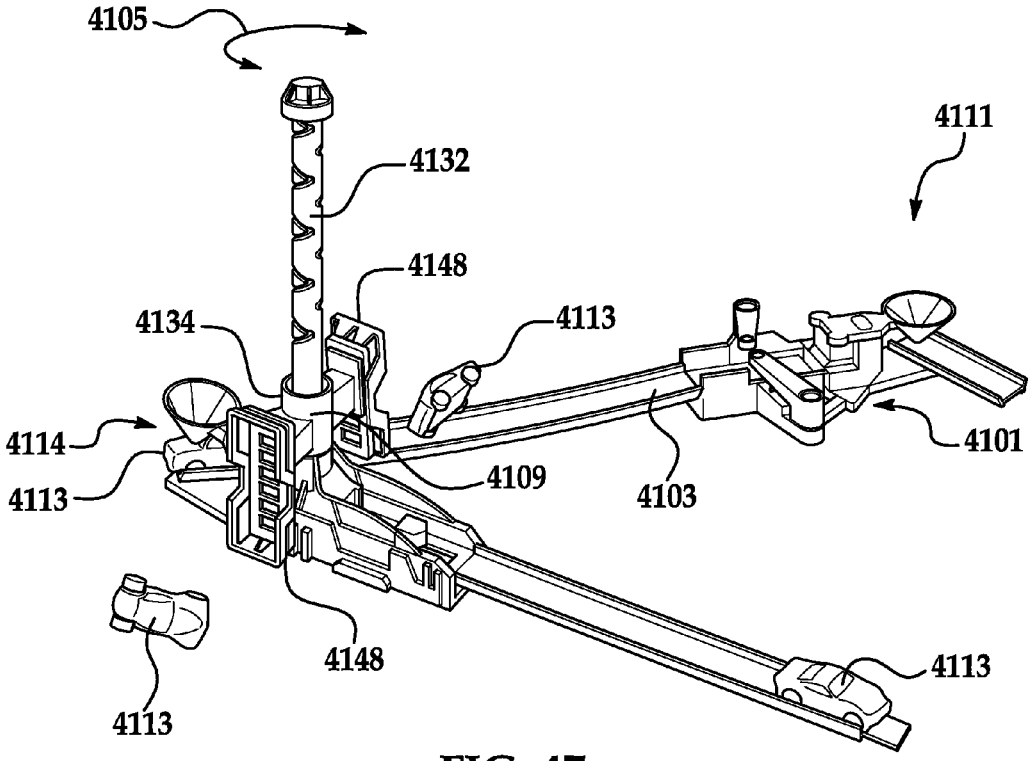

Referring now to FIGS. 40-47 an alternative exemplary embodiment of the present invention is provided. Here the track set 4110 is illustrated with another relay segment 4111, which similar to the other embodiments disclosed herein has a launcher 4101 for launching an object or toy vehicle along a track segment 4103 that is coupled to or aligned with track segment 4115 such that the launched object will contact the first actuator or trigger 4114 of relay segment 4112. As illustrated in FIG. 43, the vehicle has contacted the impact surface of the trigger 4114 and moved it upwardly from the incoming or first track segment. Reference is made to the following U.S. Pat. Nos. 1,673,538; 1,756,608; 2,149,677; 3,395,482; and 4,219,198 the contents each of which are incorporated herein by reference thereto.

As discussed, above and due to this movement of the trigger the carrier is released from a top portion of the guide member and begins to travel downwardly through reciprocal movement in the direction of arrows 4105 and by engaging the grooved surface of the guide member as discussed above. In this embodiment, the trays 4148 of the carrier are pivotally mounted to the same and/or collar 4134 via a pin 4107. In one implementation, the trays are retained in a first position illustrated in FIGS. 43 and 44 by a releasable catch 4109 that is configured to engage a surface or feature of the tray such that it is retained in the first position.

Thereafter and when the carrier has travelled all the way down the tower or guide member, the releasable catch is engaged by a feature 4151 of the base member such that the releasable catch is moved from an engaging position to a disengaging position such that the tray is no longer held in the first position and the weight of the tray and/or the object disposed therein will cause the tray to pivot in the direction of arrows 4153 towards the second position and throw the vehicles from the tray. In one embodiment, the releasable catch is spring biased into the engaging position wherein a portion of the catch engages a portion of the tray and retains it in the first position and contact of the releasable catch or a portion thereof will overcome the biasing force of the catch and release the tray from the first position. Alternatively, the releasable catch may be configured such that a "final drop" or contact of the carrier to the base (e.g., carrier hitting base member) is sufficient to cause the spring biasing force to be overcome and thus, the carriers are able to pivot into the second position. In this embodiment, there is no need for a releasable catch to be engaged as the force of the carrier contacting the base is sufficient enough to cause the trays to pivot from the first position to the second position by overcoming this spring biasing force that retains them in the first position. In yet another alternative, the trays are retained in the first position by frictional engagement of a portion of the tray with a catch and contact of the carrier with the base member is sufficient to overcome this frictional engagement. Of course, numerous variations are contemplated and exemplary embodiments contemplate a releasable tray that is retained in a first position and subsequently released and pivoted into a second position when the carrier makes contact with the base member.

In the embodiments of FIGS. 40-47, the trays are arranged such that a substantial portion of the tray extends from the collar such that upon release of the releasable catch the tray pivots or moves to the second position due to the imbalance of weight on the opposite sides of the axis of the pins 4107. For example, the trays are configured to have an orientation that is 90° offset from the orientation in FIGS. 24-39 or in other words in one embodiment, the longer length of the tray is parallel to the collar or carrier and in another embodiment the same longer length of the tray is perpendicular or orthogonal to the carrier or collar. Of course, other angular configurations of the trays with respect to the carrier or collar are contemplated to be within the scope of exemplary embodiments of the present invention and the same are not intended to be limited to the specific orientations mentioned above. Other alternative embodiments contemplate spring biased mechanisms to move or pivot the trays from the first position to the second position.

In yet another alternative embodiment, each of the trays are retained in the first position by a spring biased releasable catch 4109 that is configured to engage a surface or feature of the tray such that it is retained in the first position and the catch and a spring biased in force is configured such that the impact of the carrier onto the base from its final "vertical drop" (e.g., grooves 20 are arranged such that near the end of its travel from the top, the carrier will no longer rotate and it will merely drop vertically thus building up momentum before contacting the base) and will be sufficient enough to overcome the biasing force and any interference engagement of the releasable catch 4109 with a surface of the tray. Still further and in another embodiment, the releasable catch and the spring biasing force and the position of the tray with respect to pins 4107 will cause the same to be released from the releasable catch regardless of whether a vehicle or object is disposed within the tray. In other words, a sufficient portion of the tray overhangs the pivot axis of pin 4107 in a cantilever fashion such that when the carrier makes contact or impacts the base during its final vertical drop the tray will overcome the biasing force of the releasable catch and pivot from the first position to the second position as illustrated in the attached FIGS.

In addition and as discussed above, the carrier will contact a trigger that actuates the launcher and launches a toy vehicle away from the relay 4112 along an outgoing or second track segment that may be coupled to an incoming track segment of still another relay. As previously discussed, the incoming and outgoing track segments may pivotally secured to the relays to allow for unique configurations and variations in game play.

Exemplary embodiments of the present invention provide relay segments or actuators that are easy to assemble and operate stunts that can be rearranged and repositioned for numerous play configurations.

While the present invention has been described in terms of specific embodiments, it should be appreciated that the spirit and scope of the invention is not limited to those embodiments. The features, functions, elements and/or properties, and/or combination and combinations of features, functions, elements and/or properties of the track set may be claimed in this or a related application. All subject matter which comes within the meaning and range of equivalency of the claims is to be embraced within the scope of such claims.

What is claimed is:

1. A relay for a toy track set, the relay comprising:

a first actuator;

a second actuator;

an object movably secured to the relay for movement from a first elevated position to a second lower position;

a first trigger moveably secured to the first actuator for movement between a first position and a second position wherein movement of the trigger from the first position towards the second position causes the first actuator to release the object from the first elevated position such that the object travels towards the second lower position; and a second trigger coupled the second actuator wherein movement of the second trigger launches an object from the second actuator, wherein the guide member is configured to induce an oscillating rotation of the carrier about the guide member by reversing a direction of rotation multiple times during the descent from the first raised position to the second base position.

2. The relay as in claim 1, wherein the first trigger has an angled contact surface located above the first track segment.

3. The relay as in claim 2, wherein the first trigger has an inverted conically shaped contact surface and the first trigger further comprises a manual release for moving the first trigger from the first position to the second position.

4. The relay as in claim 1, wherein the object is a carrier having a pair of trays secured to a collar that is configured to slide along an exterior surface of a guide member of the relay as the carrier moves from the first elevated position to the second lower position.

5. The relay as in claim 4, wherein the pair of trays are pivotally secured to the collar for movement from a first position to a second position when the carrier is in the second lower position.

6. The relay as in claim 5, wherein the pair of trays are configured to releasably retain a toy vehicle therein and wherein the object launched by the second actuator is a toy vehicle and the first vehicle track segment and the second vehicle track segment are configured to receive and guide toy vehicles thereon.

7. The relay as in claim 1, wherein the first trigger is located above a first vehicle track segment, wherein the second actuator is coupled to a second vehicle track segment and the trigger is moved from the first position towards the second position by a toy vehicle travelling on the first vehicle track segment and the object launched by the second actuator is another toy vehicle launched on the second vehicle track segment, wherein the second trigger is moved when the object movably secured to the relay is at the second lower position and wherein the first vehicle track segment is pivotally mounted to the rely and the second vehicle track segment is pivotally mounted to the second actuator.

8. A relay for a toy playset, comprising:

a base structure;

a guide member mounted to the base;

a carrier moveably mounted to the guide member, wherein the carrier is configured to descend along the guide member from a first raised position to a second base position by the force of gravity;

a launcher configured to propel an object away from the relay;

a first trigger configured to activate the descent of the carrier from the first raised position; and a second trigger configured to activate the launcher, wherein the second trigger is configured to be actuated by the carrier when it reaches the second base position, wherein the guide member is configured to induce an oscillating rotation of the carrier about the guide member by reversing a direction of rotation multiple times during the descent from the first raised position to the second base position.

9. The toy as in claim 8, wherein the carrier and the guide member are configured to induce a rotation of the carrier around a central axis of the guide member during at least a portion of the descent from the first raised position to the second base position.

10. The toy as in claim 9, wherein the guide member further comprises a surface groove that defines a continuous path between the first raised position and the second base position, at least a portion of the continuous path having a helical trajectory; and wherein the carrier further comprises an element configured to engage the surface groove and cause the carrier to follow the continuous path between the first raised position and the second base position.

11. The toy as in claim 8, wherein the guide member includes a surface groove that defines a continuous path between the first raised position and the second base position, at least a portion of the continuous path having an oscillating helical trajectory that reverses a direction in a reciprocating manner about the guide member; and the vehicle carrier includes an element configured to penetrate the surface groove and thereby constrain the carrier to follow the path between the first raised position and the second base position, such that the vehicle carrier undergoes an oscillating rotation during at least a portion of the descent from the first raised position to the second base position.

12. The toy as in claim 11, wherein at least an initial portion of the continuous path has an oscillating helical trajectory; and at least a final portion of the path has a substantially linear trajectory aligned with the force of gravity to induce a descent of the carrier.

13. An interchangeable toy track set, comprising:

a plurality of interchangeable relay segments each of which may be coupled to each other to create a plurality of variations for the toy track set, wherein at least one of the plurality of interchangeable relay segments comprises:

a base structure;

a guide member mounted to the base;

a carrier moveably mounted to the guide member, wherein the carrier is configured to descend along the guide member from a first raised position to a second lower position by the force of gravity;

a launcher configured to propel an object away from the relay on an outgoing track segment;

a first trigger configured to activate the descent of the carrier from the first raised position, wherein the first trigger is positioned to receive an object launched by another relay segment;

a second trigger configured to activate the launcher, wherein the second trigger is configured to be actuated by the carrier when it reaches the second base position; and wherein the object propelled onto the outgoing track segment is received on an incoming track segment of another relay and wherein the guide member is configured to induce an oscillating rotation of the carrier about the guide member by reversing a direction of rotation multiple times during the descent from the first raised position to the second base position.

14. The interchangeable toy track set, as in claim 13, wherein the first trigger has an angled contact surface located above the first track segment.

15. The interchangeable toy track set, as in claim 13, wherein the object is a carrier having a pair of trays secured to a collar that is configured to slide along an exterior surface of a guide member of the relay as the carrier moves from the first elevated position to the second lower position.

16. The interchangeable toy track set, as in claim 15, wherein the pair of trays are pivotally secured to the collar for movement from a first position to a second position when the carrier is in the second lower position.

17. The interchangeable toy track set, as in claim 16, wherein the pair of trays are configured to releasably retain a toy vehicle therein and the track segments are configured to receive toy vehicles thereon and wherein the object is a toy vehicle.

* * * * *